US010431903B2

(12) United States Patent
Ng et al.

(10) Patent No.: US 10,431,903 B2
(45) Date of Patent: Oct. 1, 2019

(54) ANTENNA SYSTEMS WITH LOW PASSIVE INTERMODULATION (PIM)

(71) Applicant: Laird Technologies, Inc., Earth City, MO (US)

(72) Inventors: Kok Jiunn Ng, Perak (MY); Wei Tat Ng, Kedah (MY); Tze Yuen Ng, Kedah (MY); Yih Jia Teoh, Kedah (MY)

( * ) Notice: Subject to any disclaimer, the term of this patent is extended or adjusted under 35 U.S.C. 154(b) by 287 days.

(21) Appl. No.: 15/419,528

(22) Filed: Jan. 30, 2017

(65) Prior Publication Data

US 2017/0141480 A1 May 18, 2017

Related U.S. Application Data

(63) Continuation of application No. PCT/US2015/037930, filed on Jun. 26, 2015.

(30) Foreign Application Priority Data

Aug. 1, 2014 (MY) ..... PI2014702124

(51) Int. Cl.
*H01Q 9/04* (2006.01)
*H01Q 21/06* (2006.01)
(Continued)

(52) U.S. Cl.
CPC ..... *H01Q 21/065* (2013.01); *H01Q 1/42* (2013.01); *H01Q 1/48* (2013.01); *H01Q 1/521* (2013.01);
(Continued)

(58) Field of Classification Search
CPC ..... H01Q 1/48; H01Q 9/065
See application file for complete search history.

(56) References Cited

U.S. PATENT DOCUMENTS

2007/0126640 A1 6/2007 Lee
2009/0237314 A1* 9/2009 Lalezari ..... H01Q 9/28 343/721
(Continued)

FOREIGN PATENT DOCUMENTS

JP 2005072915 A 3/2005
WO WO-2012112022 A1 8/2012
WO WO-2015041768 A1 3/2015

OTHER PUBLICATIONS

International Search Report and Written Opinion dated Sep. 22, 2015 for PCT Application No. PCTUS2015037930 filed Jun. 26, 2015 (published as WO 2016018547 on Feb. 4, 2016), 13 pages.

*Primary Examiner* — Hoang V Nguyen
*Assistant Examiner* — Awat M Salih
(74) *Attorney, Agent, or Firm* — Harness, Dickey & Pierce, P.L.C.; Anthony G. Fussner

(57) ABSTRACT

Exemplary embodiments are provided of antennas and antenna systems including the same. In an exemplary embodiment, an antenna generally includes an upper radiating patch element, a ground plane spaced apart from the upper radiating patch element, and a feed point positioned adjacent the ground plane. A first feeding element electrically couples (e.g., via proximity coupling or direct galvanic coupling) the upper radiating patch element to the feed point. A second feeding element electrically couples (e.g., via proximity coupling or direct galvanic coupling) the upper radiating patch element to the feed point. A shorting element electrically couples (e.g., via proximity coupling or direct galvanic coupling) the upper radiating patch element to the ground plane. In other exemplary embodiments, the antenna systems include one or more ground planes and one or more antennas.

21 Claims, 51 Drawing Sheets

(51) Int. Cl.

| | |
|---|---|
| ***H01Q 21/28*** | (2006.01) |
| ***H01Q 1/48*** | (2006.01) |
| ***H01Q 1/52*** | (2006.01) |
| ***H01Q 21/24*** | (2006.01) |
| ***H01Q 1/42*** | (2006.01) |

(52) U.S. Cl.
CPC ..... *H01Q 9/045* (2013.01); *H01Q 9/0421* (2013.01); *H01Q 21/24* (2013.01); *H01Q 21/28* (2013.01)

(56) References Cited

U.S. PATENT DOCUMENTS

| | | | | |
|---|---|---|---|---|
| 2012/0081252 | A1 | 4/2012 | Pan | |
| 2012/0169554 | A1 | 7/2012 | Behdad et al. | |
| 2013/0002510 | A1* | 1/2013 | Azulay | H01Q 1/243 343/860 |
| 2013/0229318 | A1 | 9/2013 | Ng et al. | |
| 2013/0300624 | A1* | 11/2013 | Fakharzadeh Jahromi | H01Q 9/065 343/793 |
| 2014/0347241 | A1* | 11/2014 | Kim | H01Q 1/243 343/845 |

* cited by examiner

| | 698 | 725 | 746 | 806 | 824 | 850 | 880 | 894 | 960 | 171 | 173 | 175 | 185 | 188 | 191 | 193 | 199 | 211 | 213 | 217 | 231 | 235 | 241 | 250 | 260 | 270 |
|---|---|---|---|---|---|---|---|---|---|---|---|---|---|---|---|---|---|---|---|---|---|---|---|---|---|---|
| - - CMD2Gen Mod-Port1 | 2.80 | 3.55 | 3.76 | 3.92 | 3.79 | 3.81 | 3.44 | 3.32 | 3.52 | 3.61 | 3.99 | 3.82 | 3.13 | 3.22 | 3.02 | 2.98 | 3.24 | 3.15 | 2.90 | 2.56 | 3.47 | 3.23 | 2.43 | 2.11 | 2.39 | 2.75 |
| — CMD2Gen Mod-Port2 | 2.98 | 3.71 | 4.06 | 4.39 | 4.07 | 4.18 | 3.64 | 3.48 | 3.79 | 3.46 | 4.04 | 3.91 | 3.21 | 2.86 | 3.06 | 3.36 | 3.43 | 3.32 | 3.09 | 2.91 | 2.73 | 2.28 | 1.98 | 2.22 | 2.31 | 3.43 |
| | | | | | | | | | | 0 | 0 | 5 | 0 | 0 | 0 | 0 | 0 | 0 | 0 | 0 | 0 | 0 | 2 | 7 | 0 | 0 |

| | 698 | 725 | 746 | 806 | 824 | 850 | 880 | 894 | 960 | 171 | 173 | 175 | 185 | 188 | 191 | 193 | 199 | 211 | 213 | 217 | 231 | 235 | 241 | 250 | 260 | 270 |
|---|---|---|---|---|---|---|---|---|---|---|---|---|---|---|---|---|---|---|---|---|---|---|---|---|---|---|
| - - CMD2Gen Mod-Port1 | -0.6 | -0.2 | -0.2 | -0.6 | -0.8 | -0.8 | -0.7 | -1.0 | -0.3 | -1.7 | -1.7 | -1.6 | -1.4 | -1.2 | -1.3 | -1.2 | -1.4 | -1.6 | -1.5 | -1.4 | -1.3 | -1.3 | -1.5 | -0.9 | -1.0 | -1.4 |
| — CMD2Gen Mod-Port2 | -1.1 | -0.6 | -0.3 | -0.4 | -0.6 | -0.6 | -0.9 | -0.9 | -0.2 | -1.6 | -1.7 | -1.7 | -1.1 | -1.1 | -1.0 | -0.9 | -1.3 | -1.5 | -1.5 | -1.7 | -1.3 | -1.2 | -1.5 | -1.0 | -0.7 | -0.9 |

| | 698 | 725 | 746 | 806 | 824 | 850 | 880 | 894 | 960 | 171 | 173 | 175 | 185 | 188 | 191 | 193 | 199 | 211 | 213 | 217 | 231 | 235 | 241 | 250 | 260 | 270 |
|---|---|---|---|---|---|---|---|---|---|---|---|---|---|---|---|---|---|---|---|---|---|---|---|---|---|---|
| - - CMD2Gen Mod-Port1 | 6.12 | 7.06 | 7.60 | 8.83 | 9.38 | 10.3 | 7.64 | 6.98 | 9.32 | 4.21 | 4.30 | 3.68 | 3.38 | 4.31 | 4.96 | 4.42 | 4.07 | 5.16 | 5.23 | 5.12 | 6.84 | 7.16 | 7.10 | 6.68 | 6.25 | 6.87 |
| — CMD2Gen Mod-Port2 | 7.11 | 8.35 | 9.81 | 11.0 | 10.8 | 9.79 | 8.64 | 8.67 | 11.1 | 4.73 | 3.91 | 3.33 | 4.30 | 4.86 | 6.72 | 5.00 | 4.35 | 6.19 | 5.95 | 5.99 | 5.98 | 6.01 | 5.46 | 5.94 | 6.38 | 6.16 |
| | 0 | 0 | 0 | 0 | 0 | 0 | 0 | 0 | 0 | 0 | 0 | 5 | 0 | 0 | 0 | 0 | 0 | 0 | 0 | 0 | 0 | 0 | 2 | 7 | 0 | 0 |

ANTENNA SYSTEMS WITH LOW PASSIVE INTERMODULATION (PIM)

CROSS-REFERENCE TO RELATED APPLICATION

This application is a continuation of PCT International Application No. PCT/US2015/037930 filed Jun. 26, 2015 (published as WO 2016/018547 on Feb. 4, 2016) which claims priority to Malaysian Patent Application No. PI 2014702124 filed Aug. 1, 2014. The entire disclosures of the above applications are incorporated herein by reference.

FIELD

The present disclosure generally relates to antenna systems with low or good passive intermodulation (PIM).

BACKGROUND

This section provides background information related to the present disclosure which is not necessarily prior art.

Examples of infrastructure antenna systems include customer premises equipment (CPE), terminal stations, central stations, and in-building antenna systems. With fast growing technologies, multi-antenna with large bandwidth has become a great challenge along with the requirement to miniaturize antenna system size in order to maintain a low profile. For multi-antenna systems having more than one antenna within a single radome, there is a need to increase capacity, coverage, and cell throughput.

The conventional use of multiple separate antennas to support multiple input multiple output (MIMO) applications is not aesthetically pleasing at premises ceiling with multiple protruded radomes. With the fast growing need of data streaming for the customer, the number of antennas in the single radome can be more than two. With the current market trend towards economical, small, and compact devices, it is not uncommon to use multiple antennas that are placed in very close proximity to each other within a low profile radome to achieve good omnidirectional radiation patterns to fufill the best performance of the MIMO system.

Moreover, antennas for CPE, terminal stations, central stations, or in-building antenna systems, must usually be low profile, light in weight, and compact in physical volume, which makes conventional planar inverted-F antennas particularly attractive for these types of applications. These conventional planar inverted-F antennas consist of a radiating patch element, a ground plane, a shorting element, and a feeding element.

SUMMARY

This section provides a general summary of the disclosure, and is not a comprehensive disclosure of its full scope or all of its features.

According to various aspects, exemplary embodiments of antennas are disclosed. In an exemplary embodiment, an antenna includes an upper radiating patch element, a ground plane spaced apart from the upper radiating patch element, a feed point positioned adjacent the ground plane, a first feeding element electrically coupling (e.g., via proximity coupling or direct galvanic coupling) the upper radiating patch element to the feed point, a second feeding element electrically coupling (e.g., via proximity coupling or direct galvanic coupling) the upper radiating patch element to the feed point, and a shorting element electrically coupling (e.g., via proximity coupling or direct galvanic coupling) the upper radiating patch element to the ground plane.

According to additional aspects of the present disclosure, exemplary embodiments of antenna systems are disclosed. In an exemplary embodiment, an antenna system includes a ground plane and four antennas. Each antenna includes an upper radiating patch element spaced apart from the ground plane, a first feeding element electrically coupling (e.g., via capacitive coupling or direct galvanic coupling) the upper radiating patch element to a feed point, a second feeding element electrically coupling (e.g., via proximity coupling or direct galvanic coupling) the upper radiating patch element to the feed point, and a shorting element electrically coupling (e.g., via proximity coupling or direct galvanic coupling) the upper radiating patch element to the ground plane.

In another exemplary embodiment, an antenna system includes at least two ground planes and at least two antennas. Each antenna includes an upper radiating patch element spaced apart from one respective ground plane, a first feeding element electrically coupling (e.g., via proximity coupling or direct galvanic coupling) the upper radiating patch element to a feed point, a second feeding element electrically coupling (e.g., via proximity coupling or direct galvanic coupling) the upper radiating patch element to the feed point, and a shorting element electrically coupling (e.g., via proximity coupling or direct galvanic coupling) the upper radiating patch element to its respective ground plane.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 18:
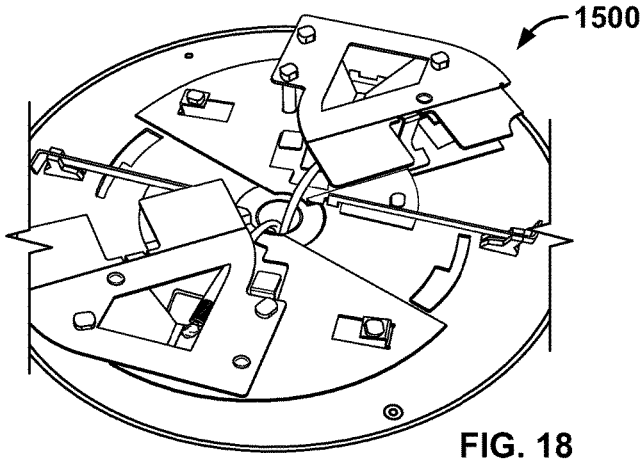
FIG. 18 is a perspective view of an exemplary prototype of the antenna system of FIG. 15.
Figure 22:
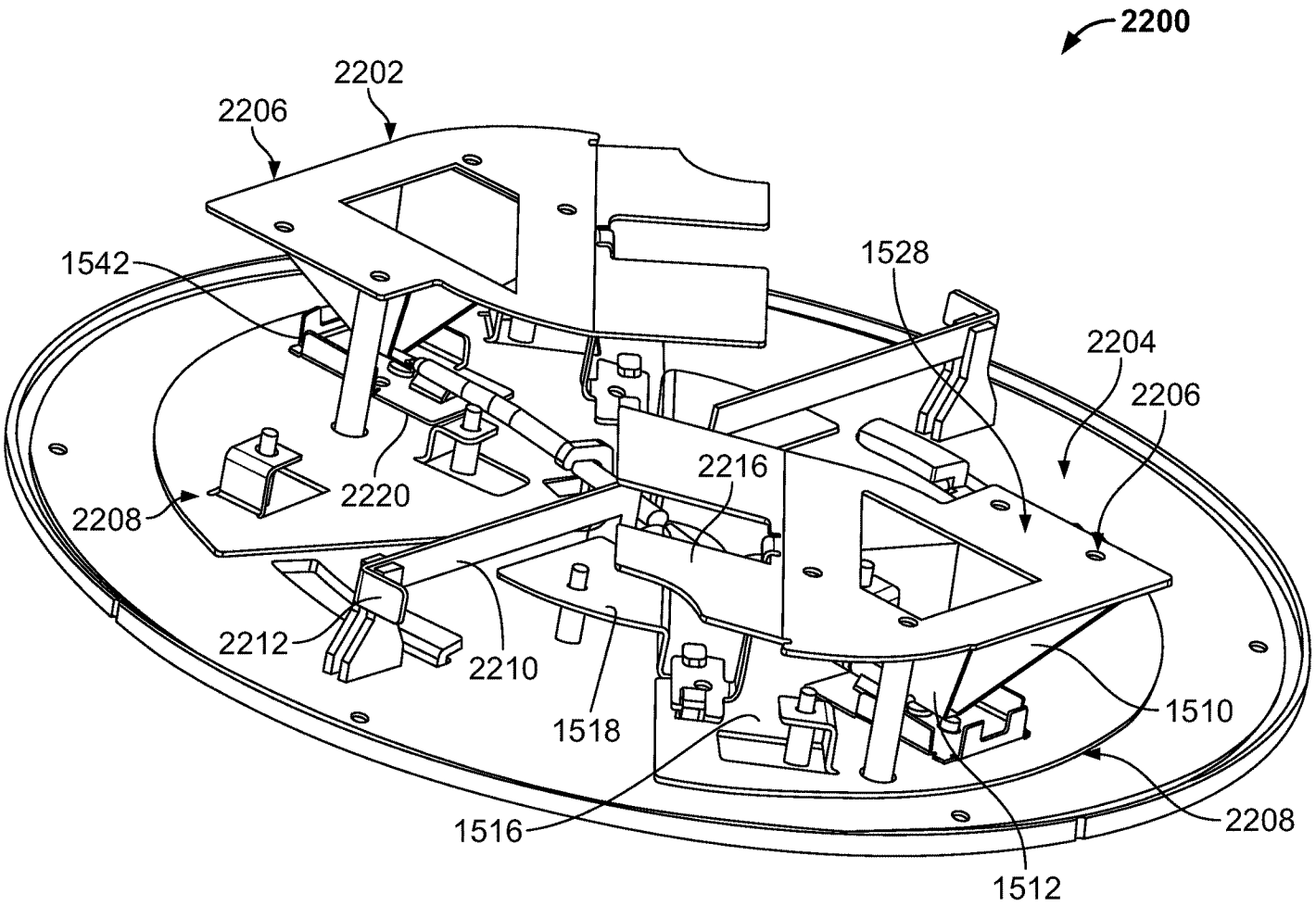
Figure 23:
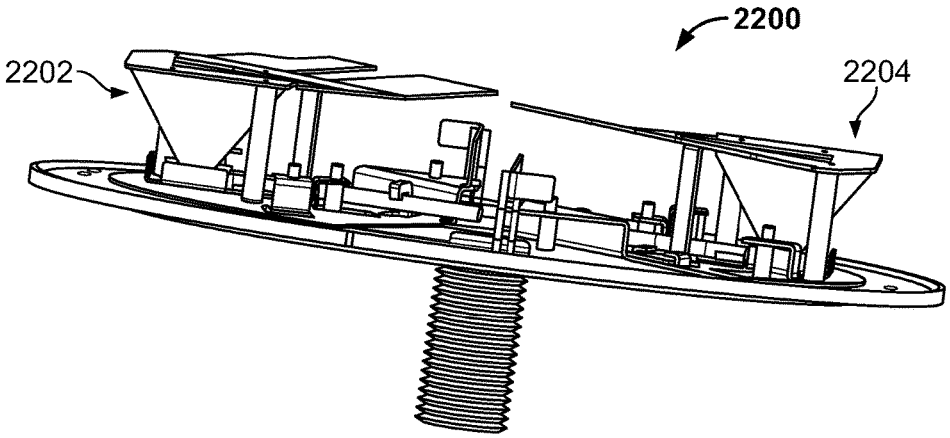
Figure 24:
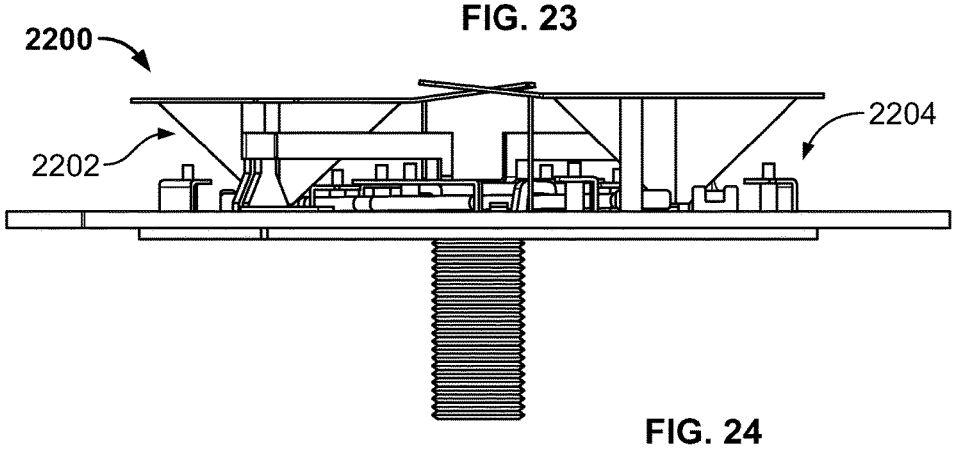
Figure 25:
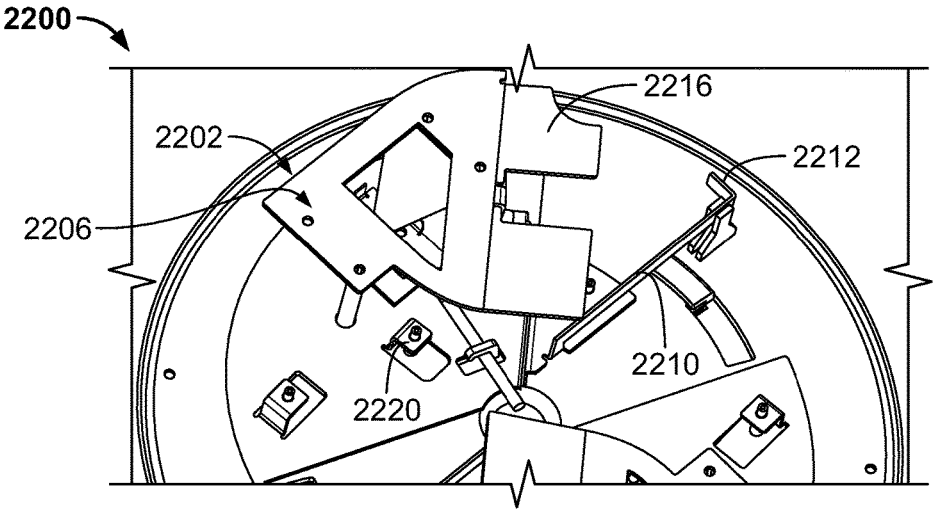
Figure 26:
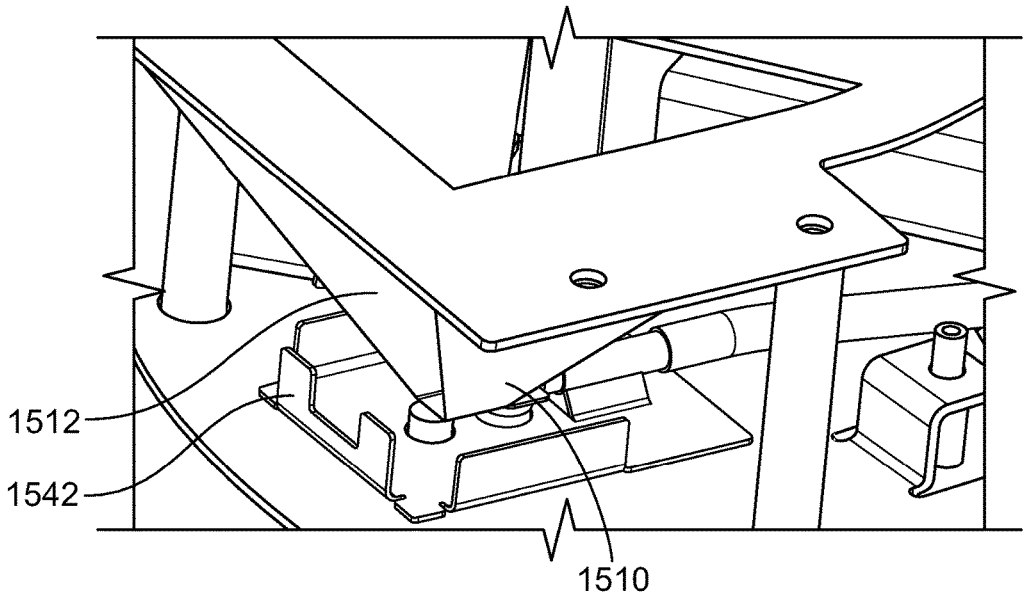
Figure 27:
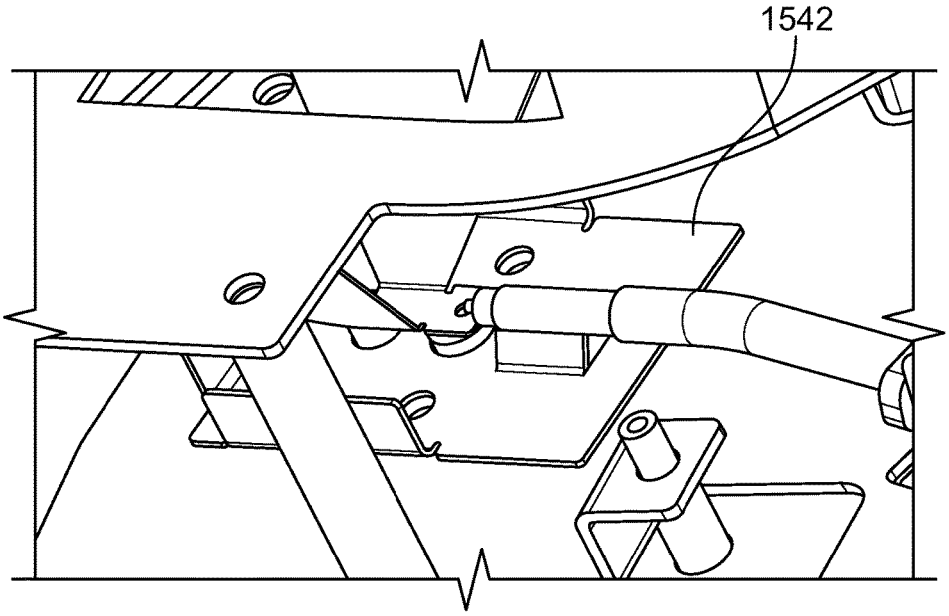
Figure 28:
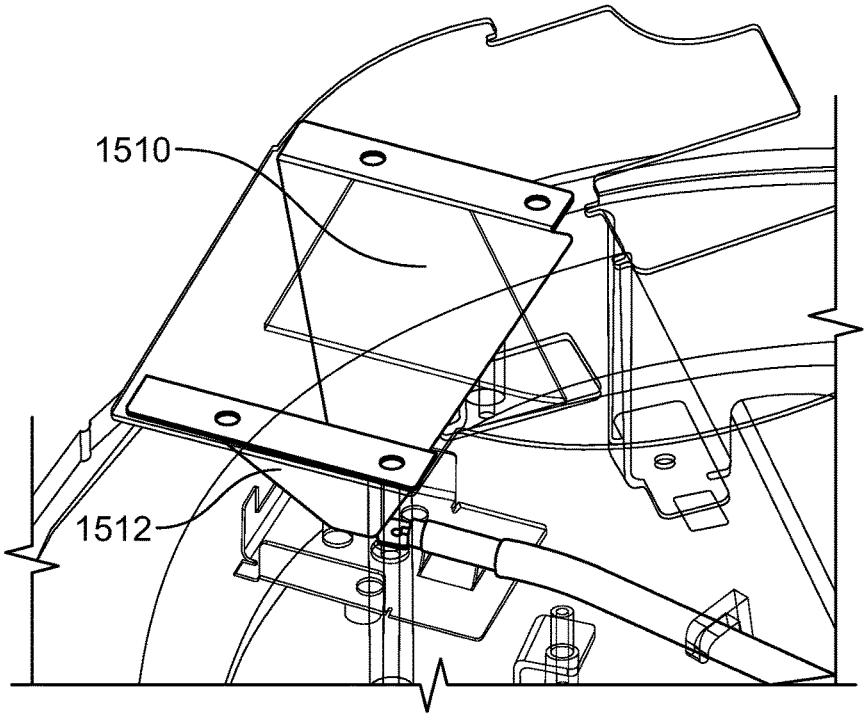
Figure 29:
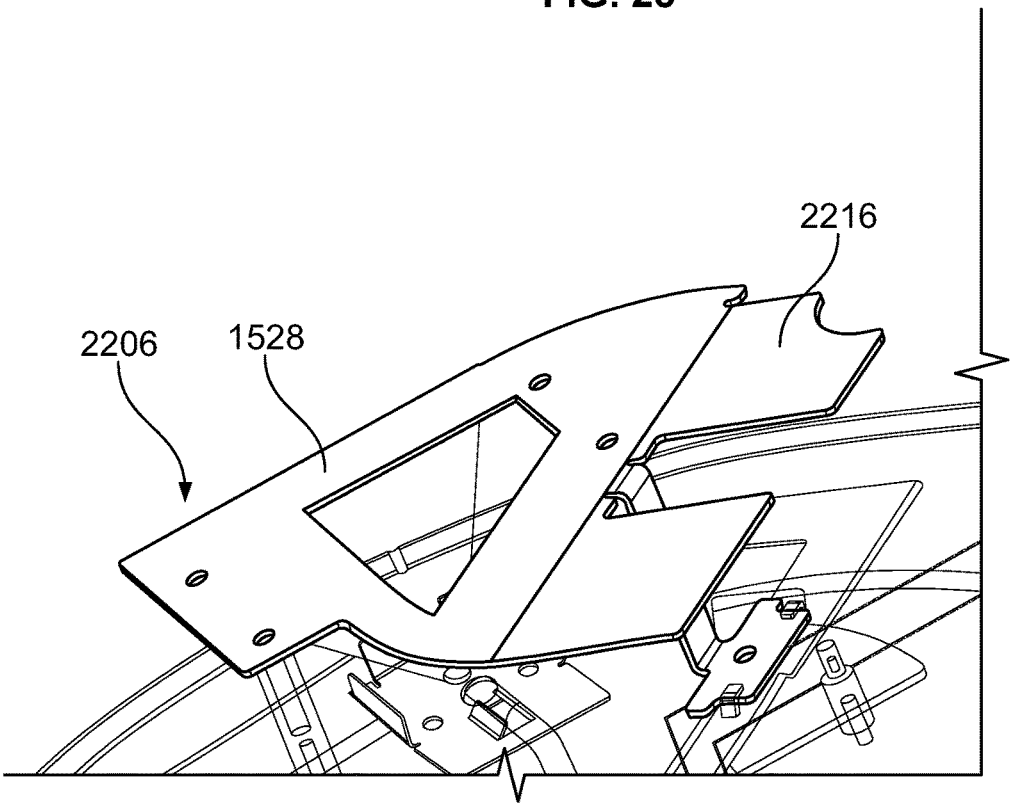
Figure 30:
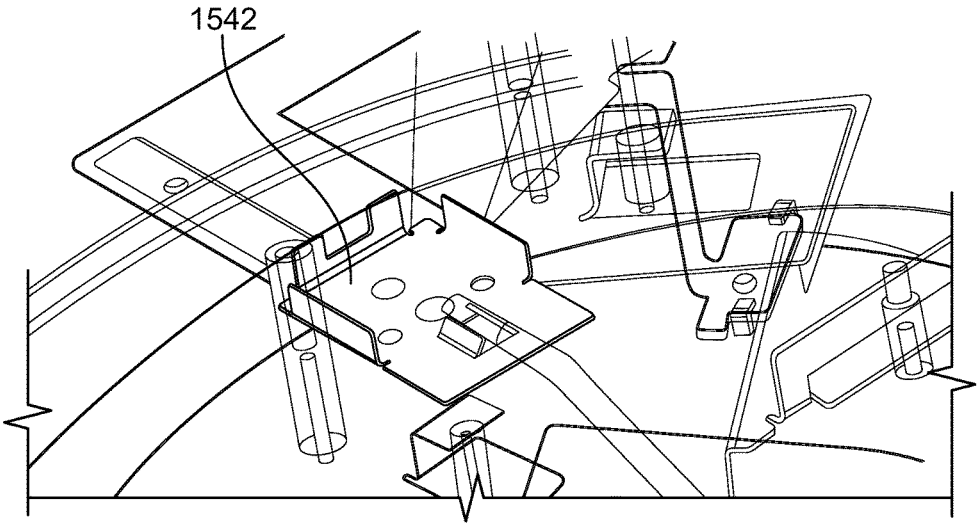
Figure 31:
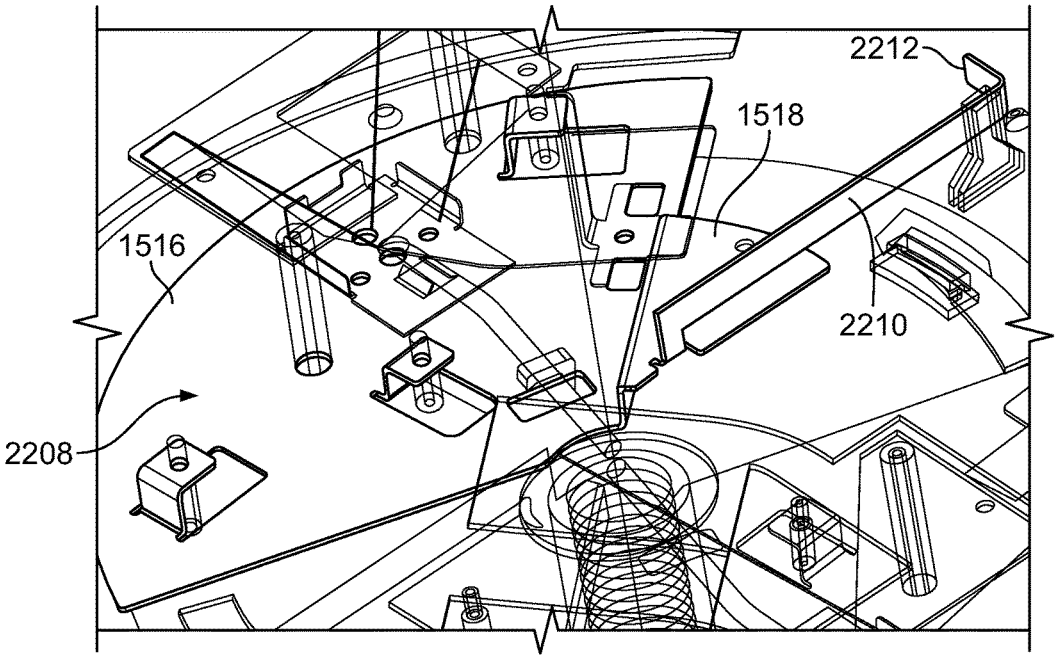
Figure 32:
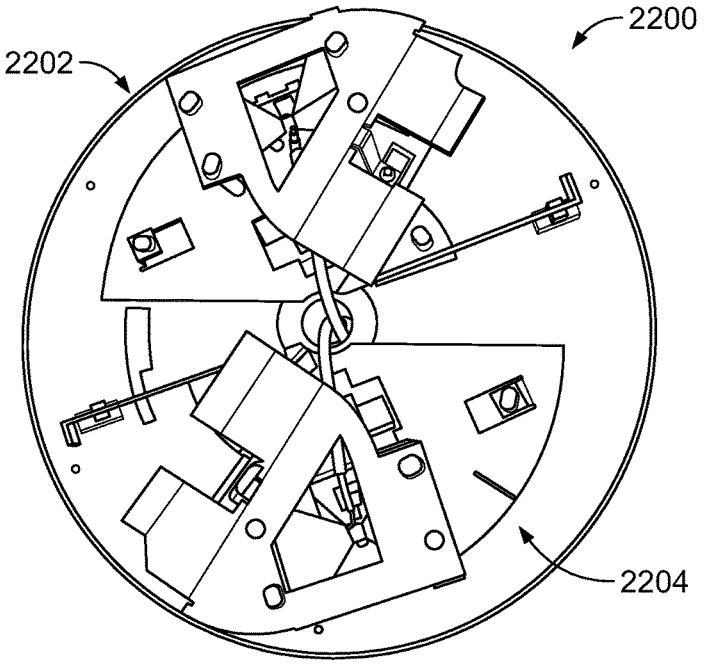
Figure 33:
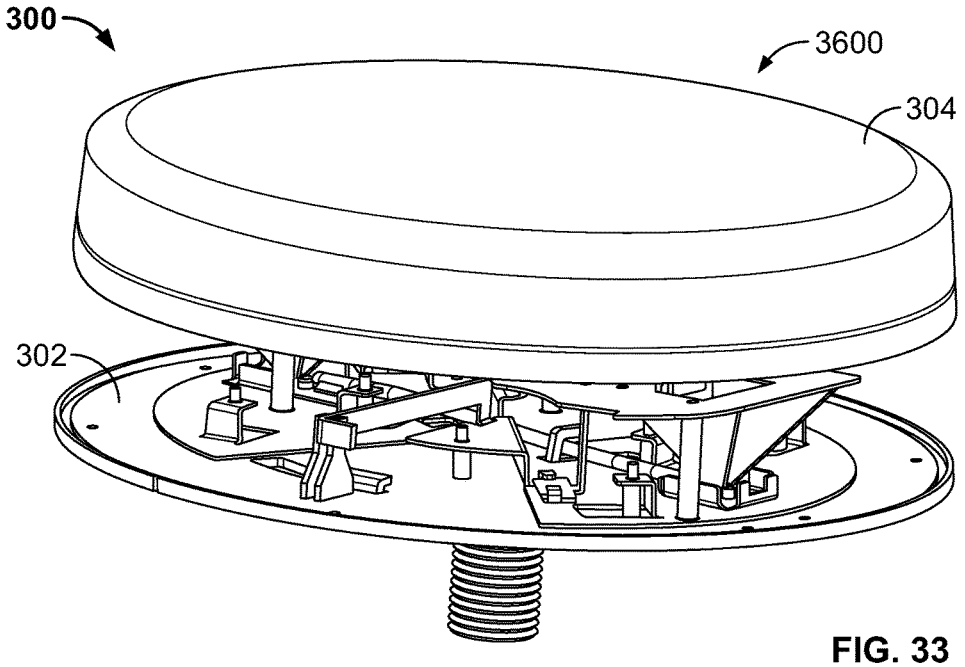
Figure 34:
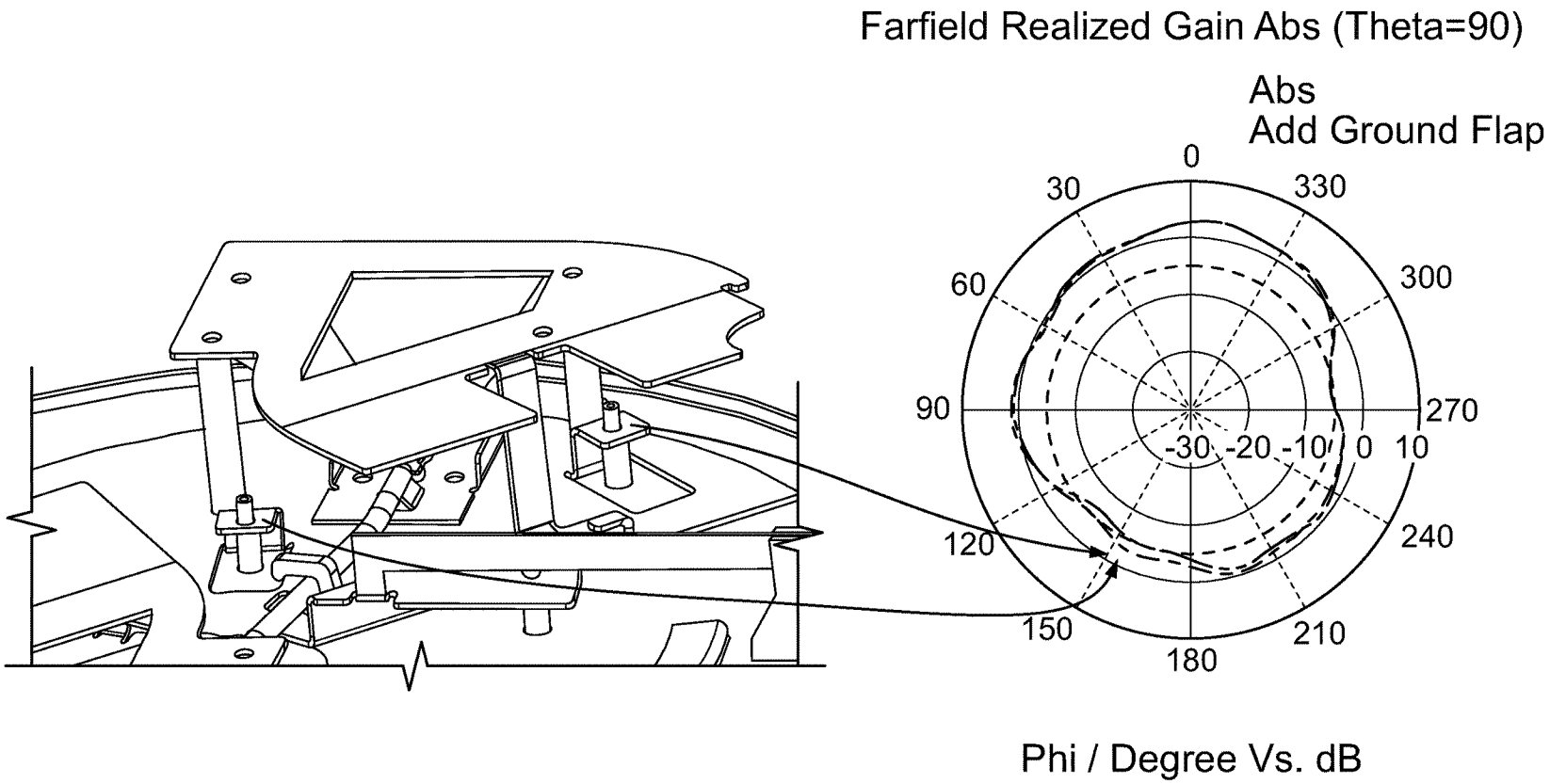
Figure 35:
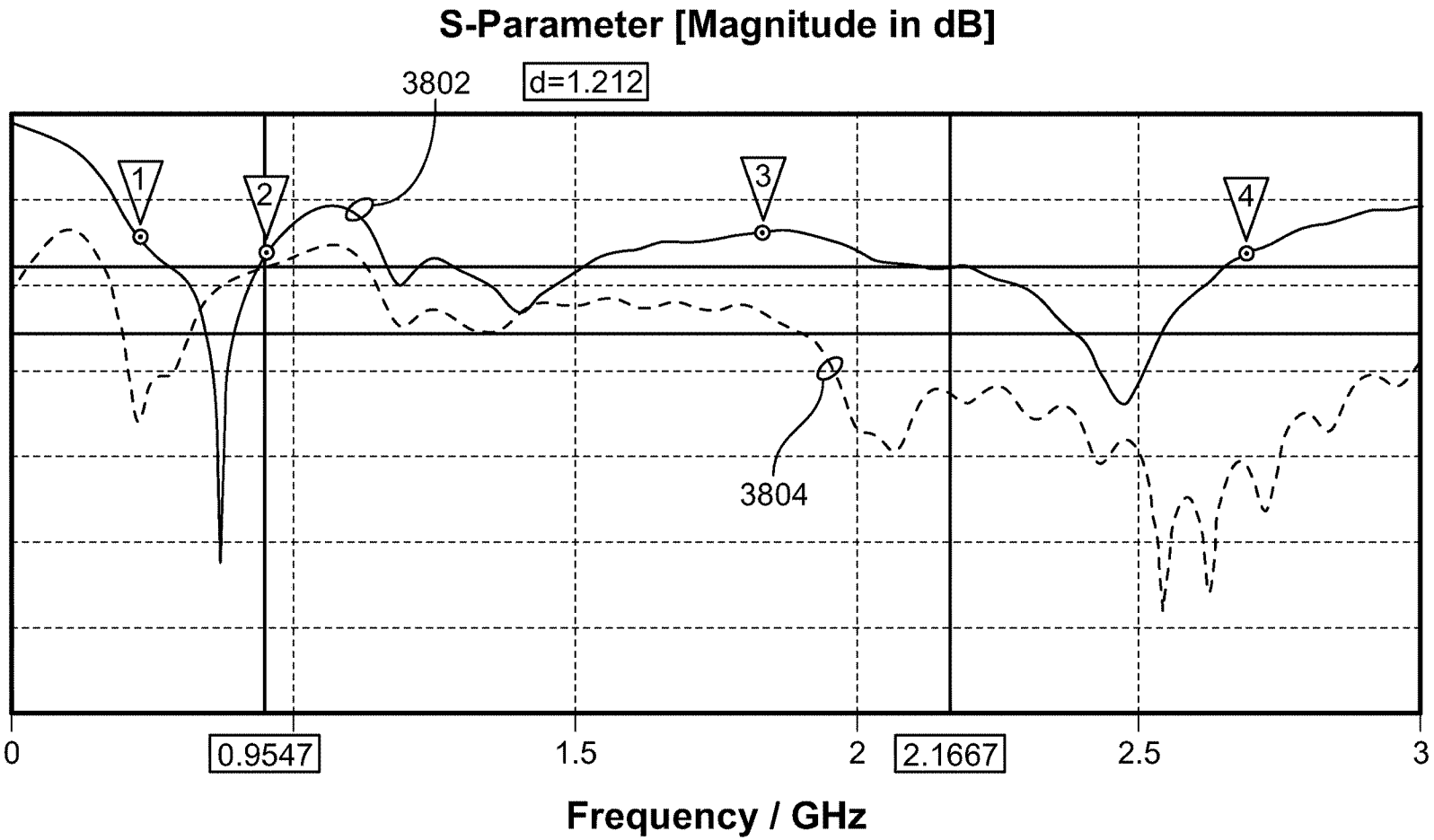
Figure 36:
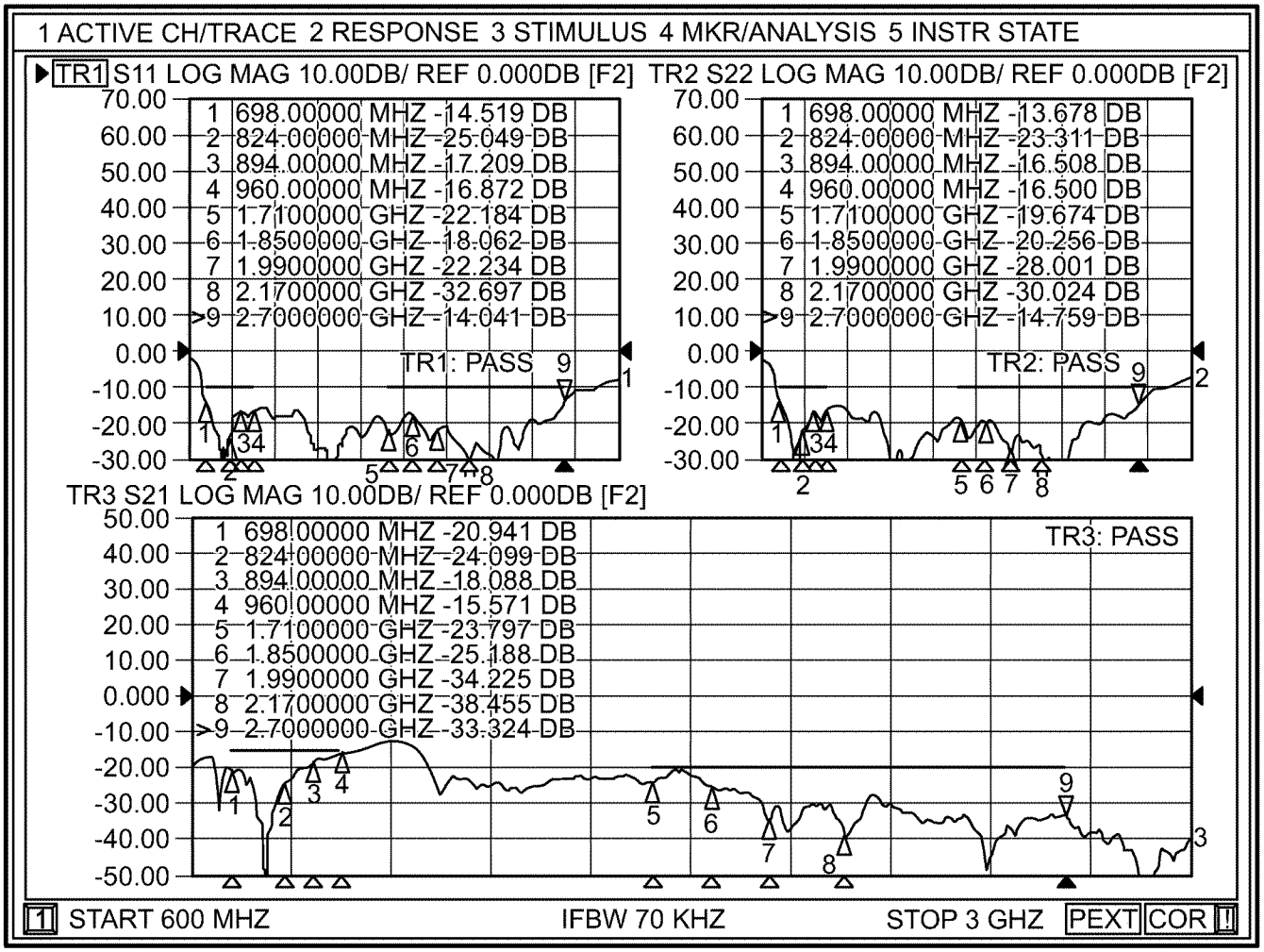
Figure 37:
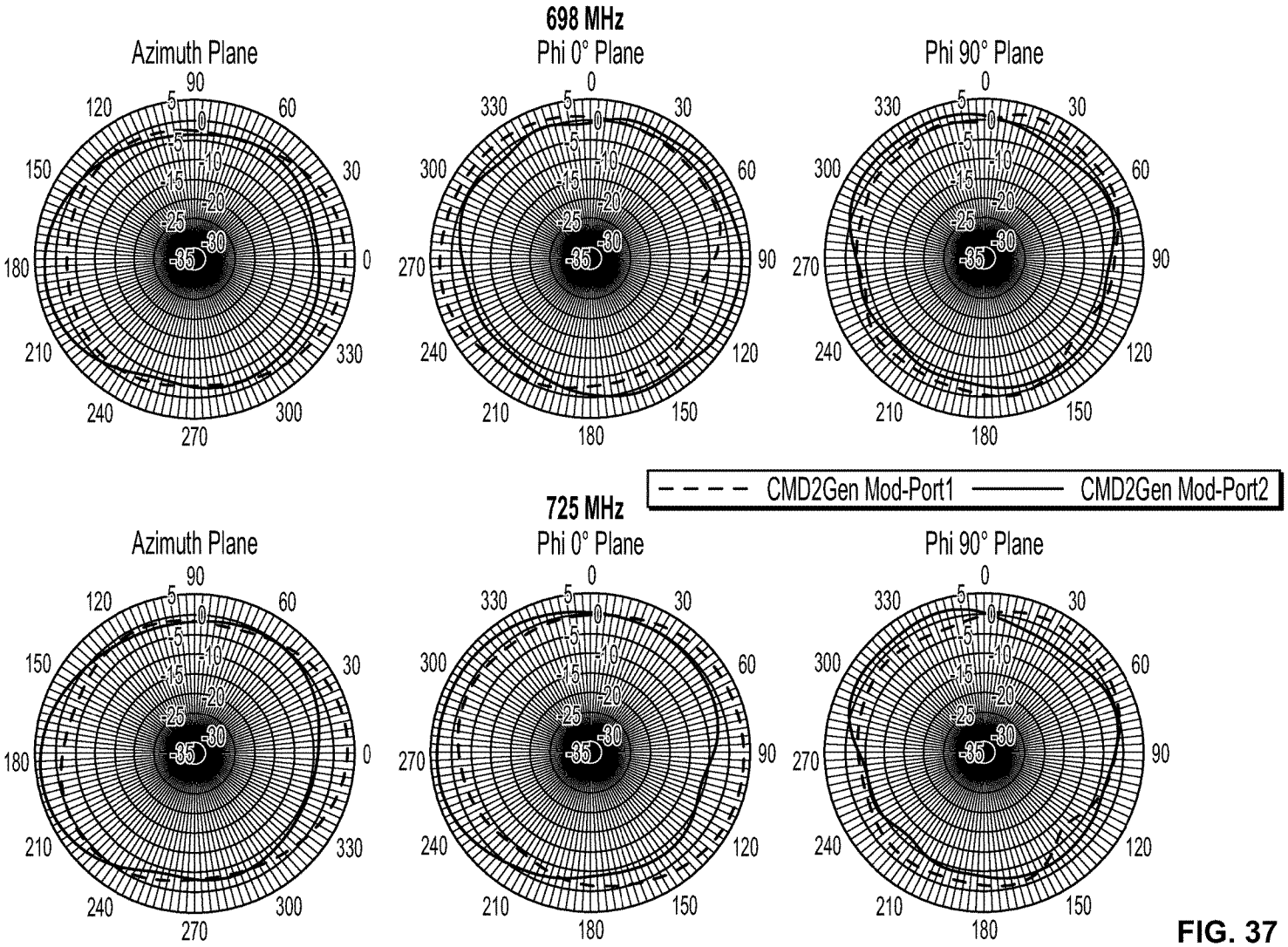
Figure 37:
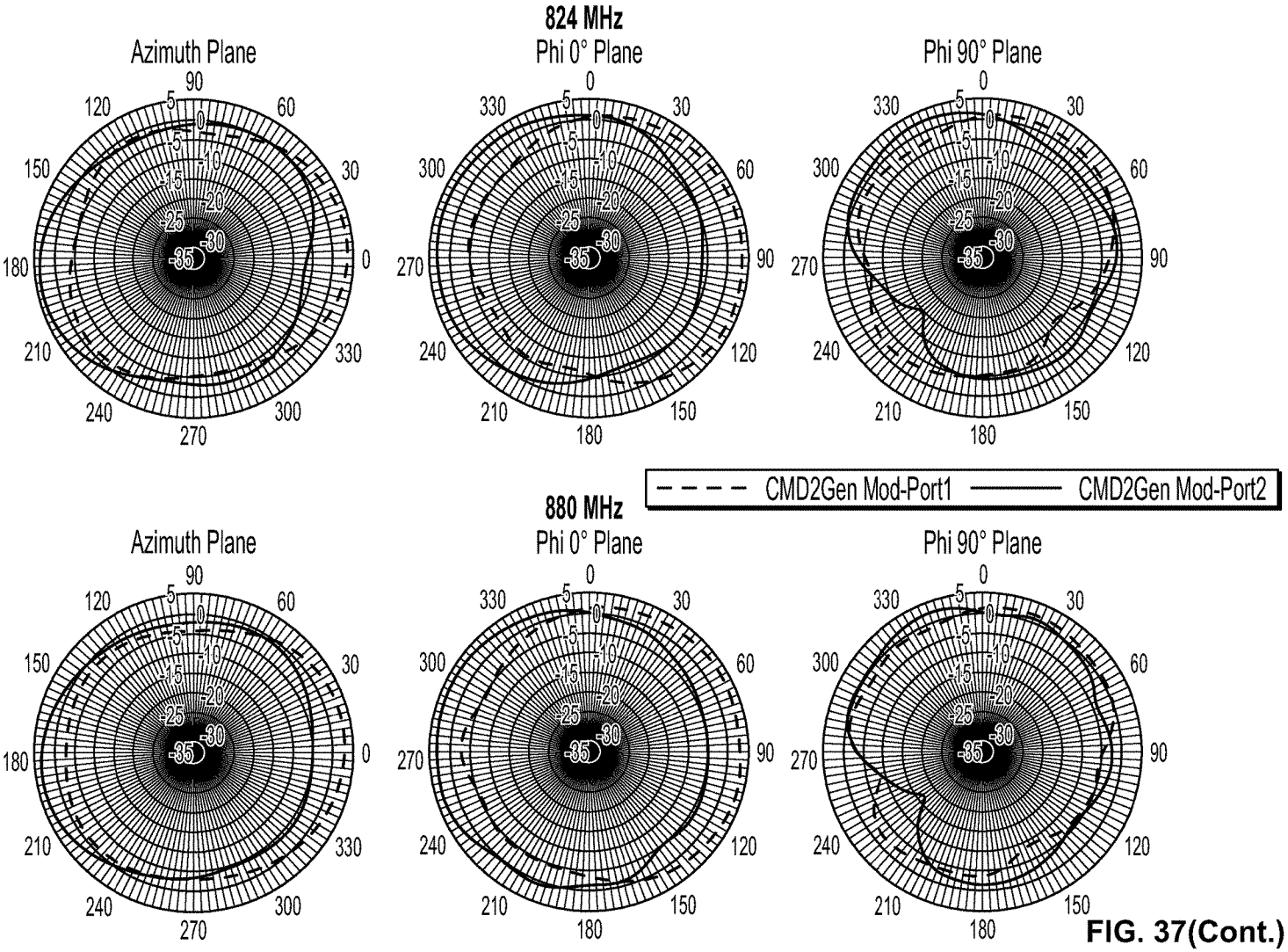
Figure 37:
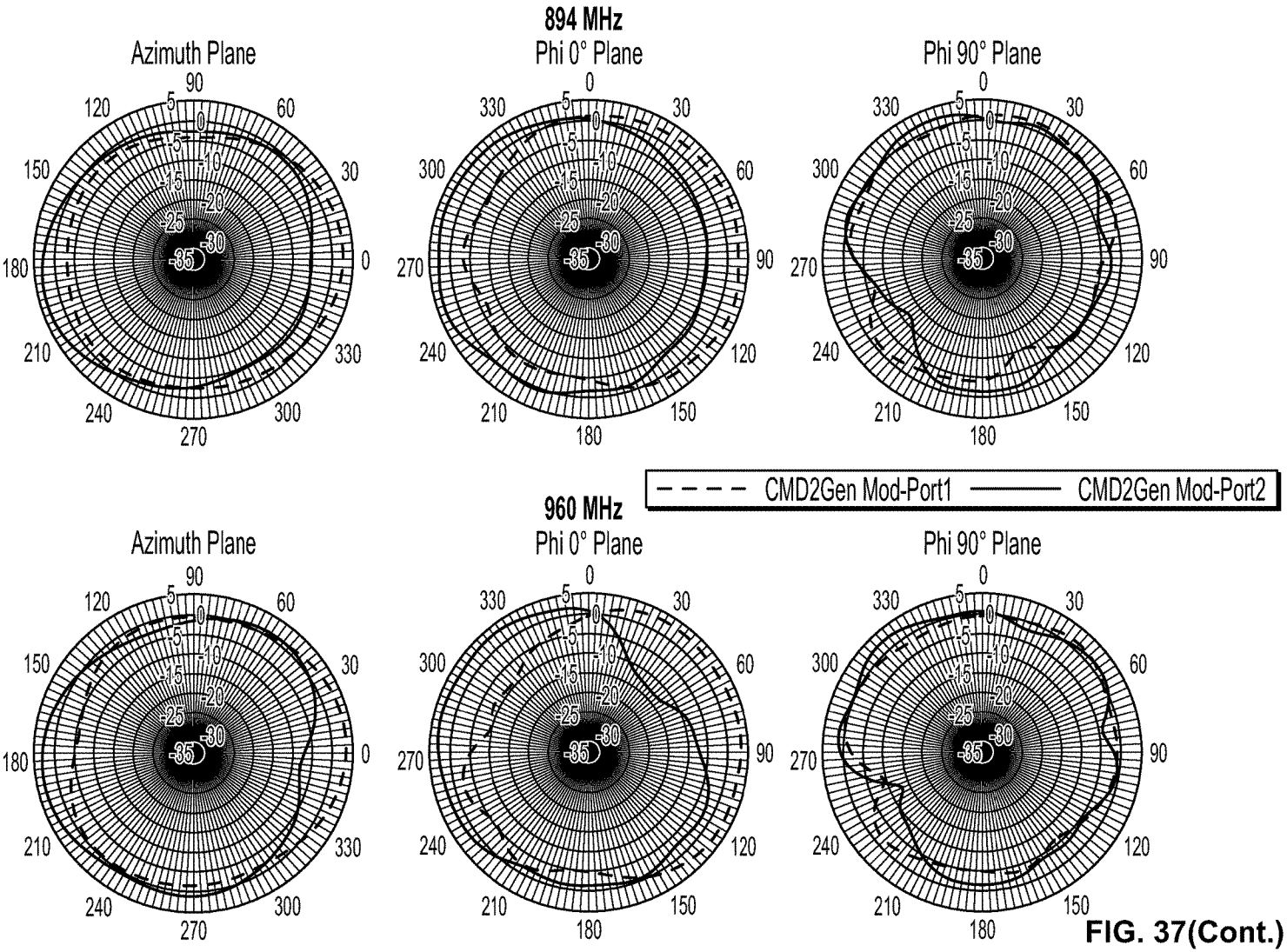
Figure 37:
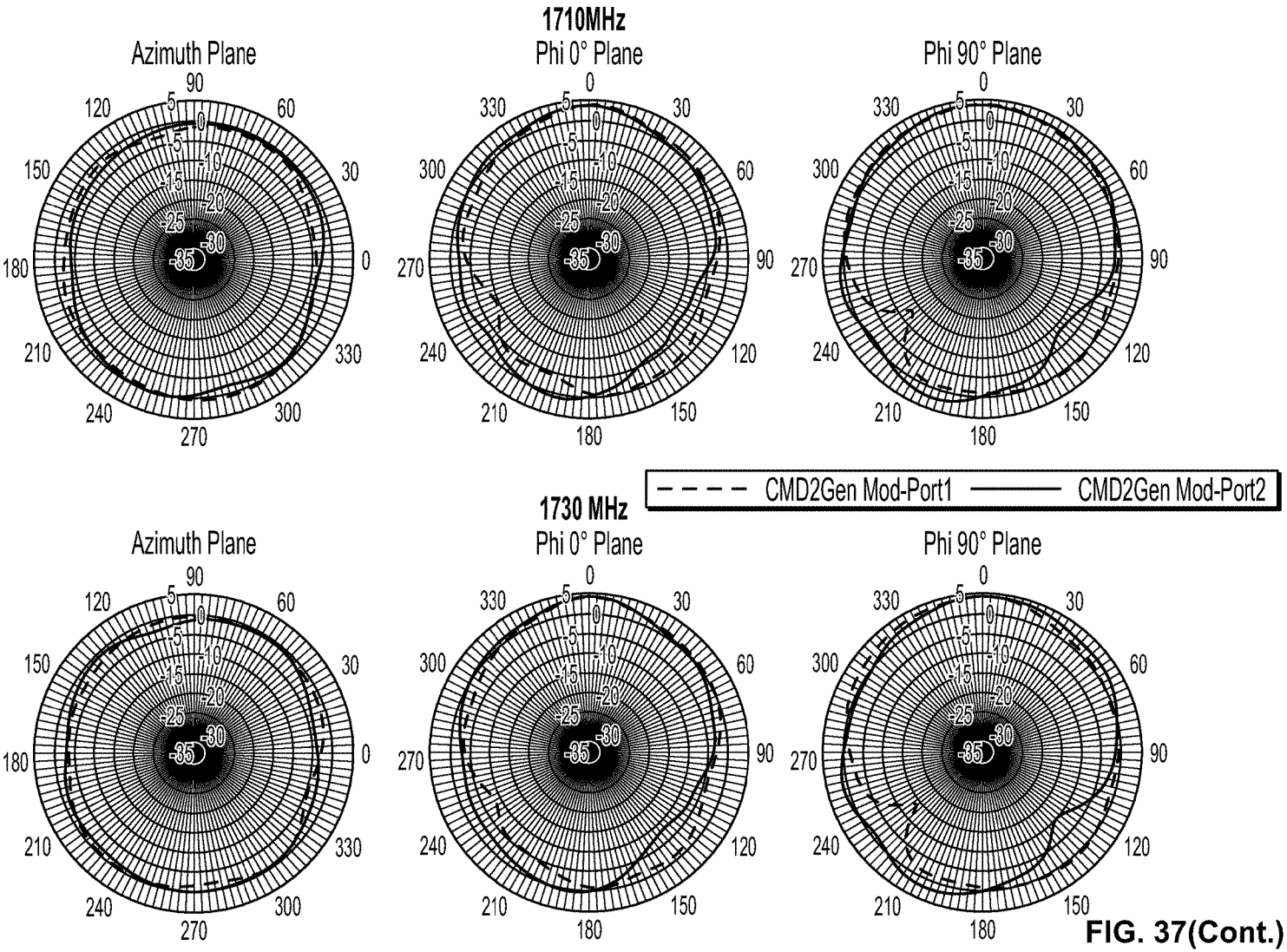
Figure 37:
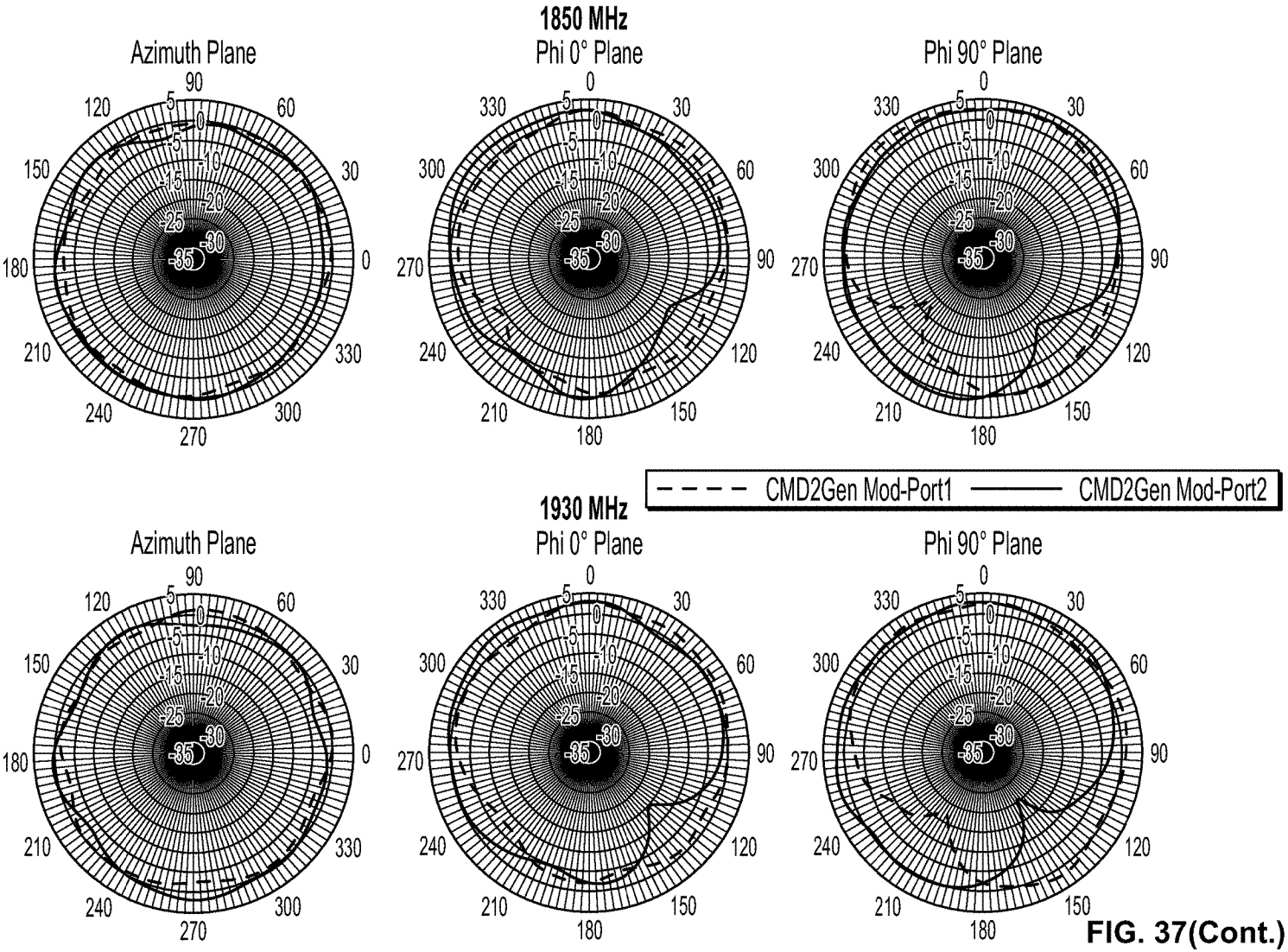
Figure 37:
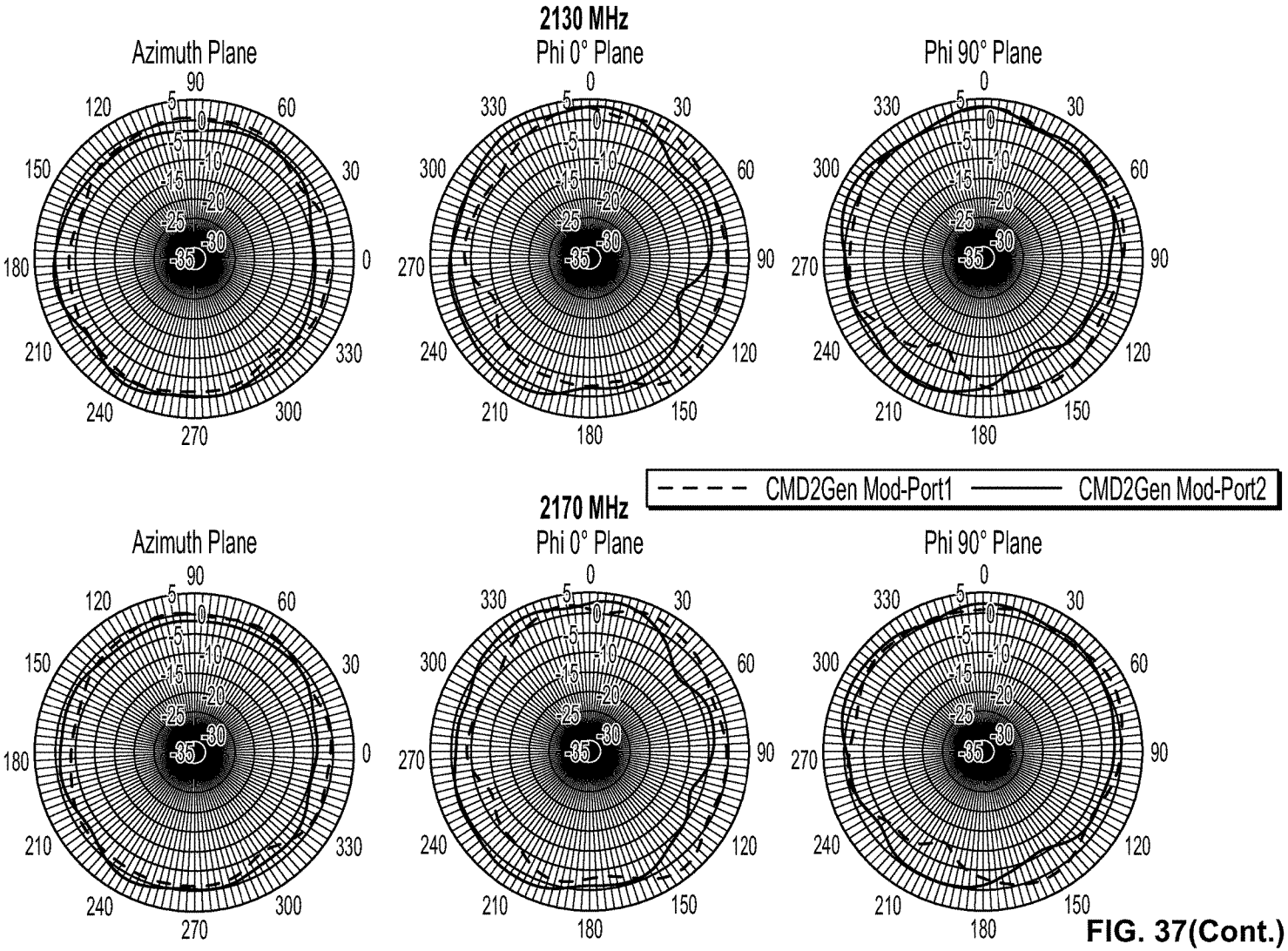
Figure 37:
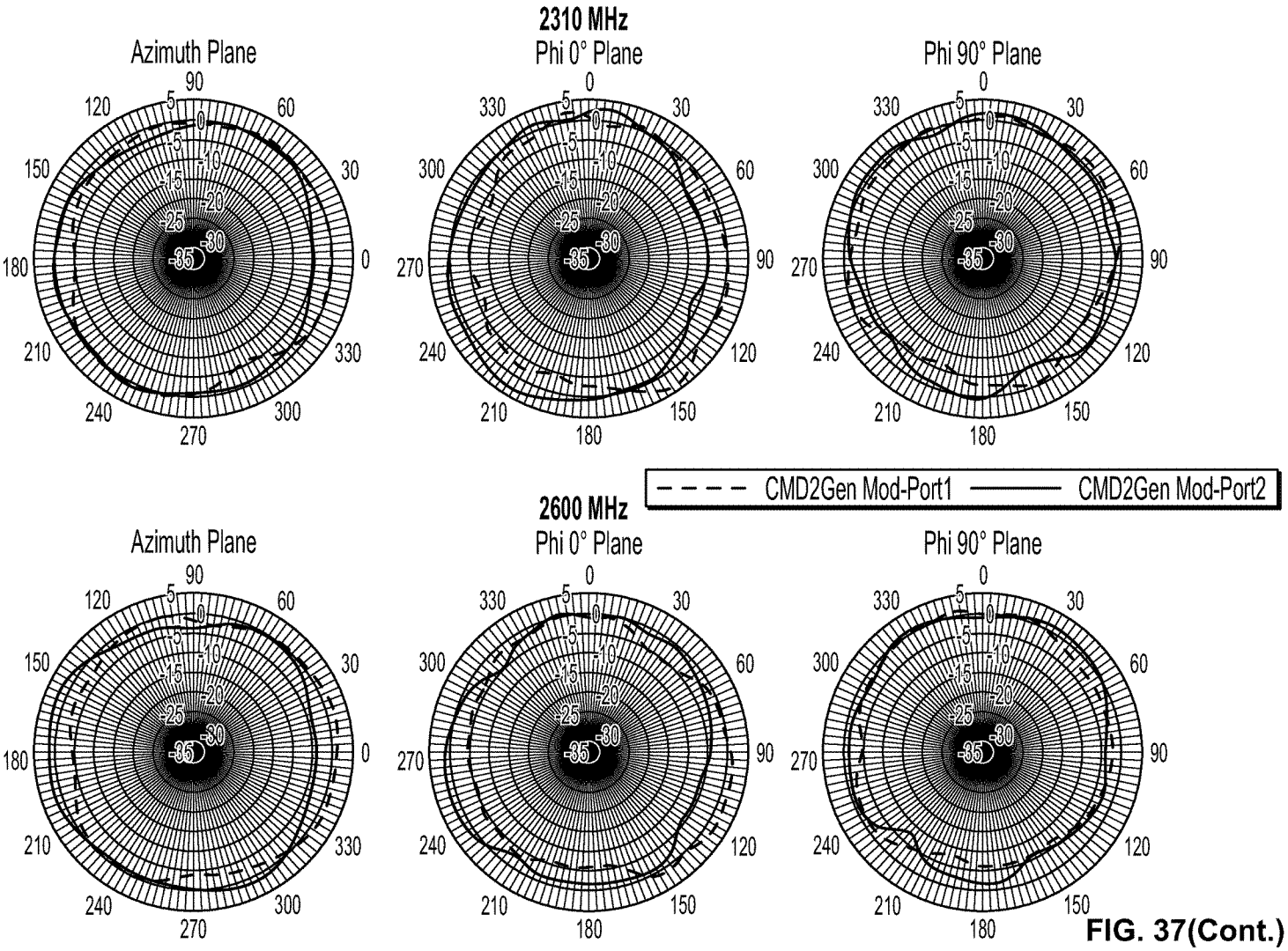
Figure 39:
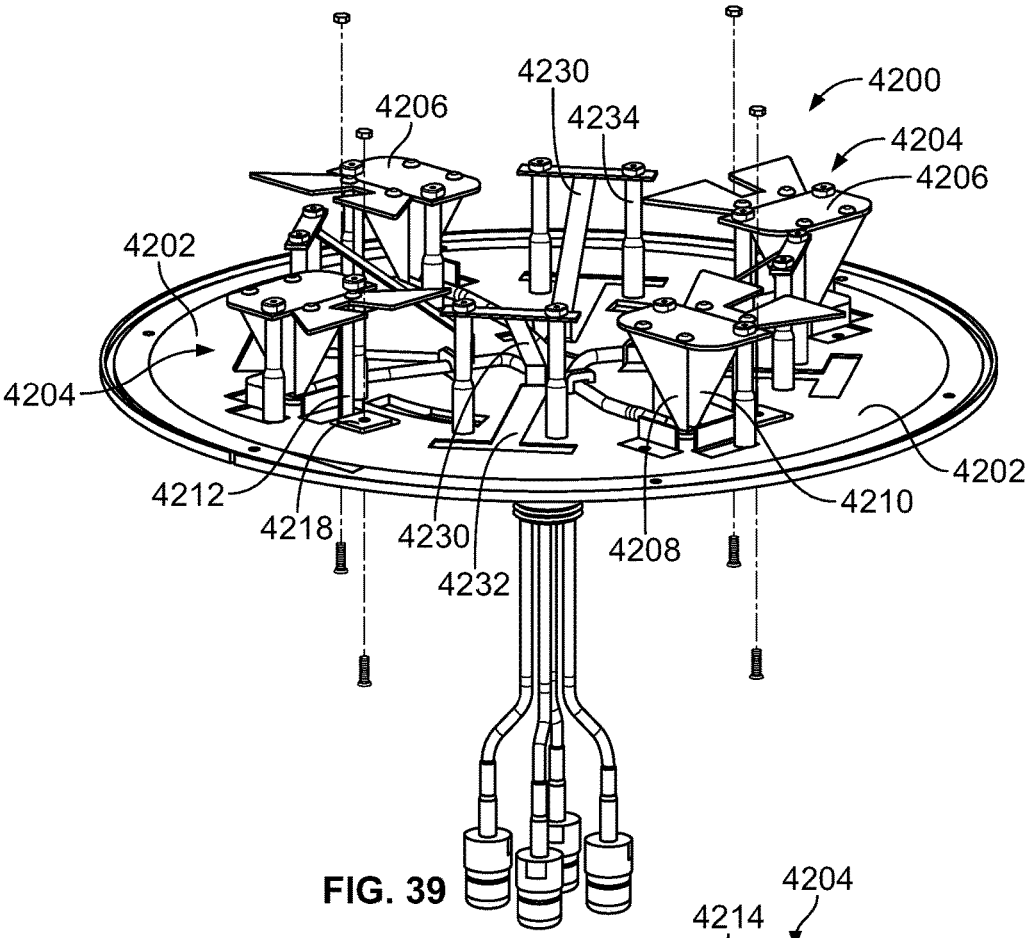
Figure 40:
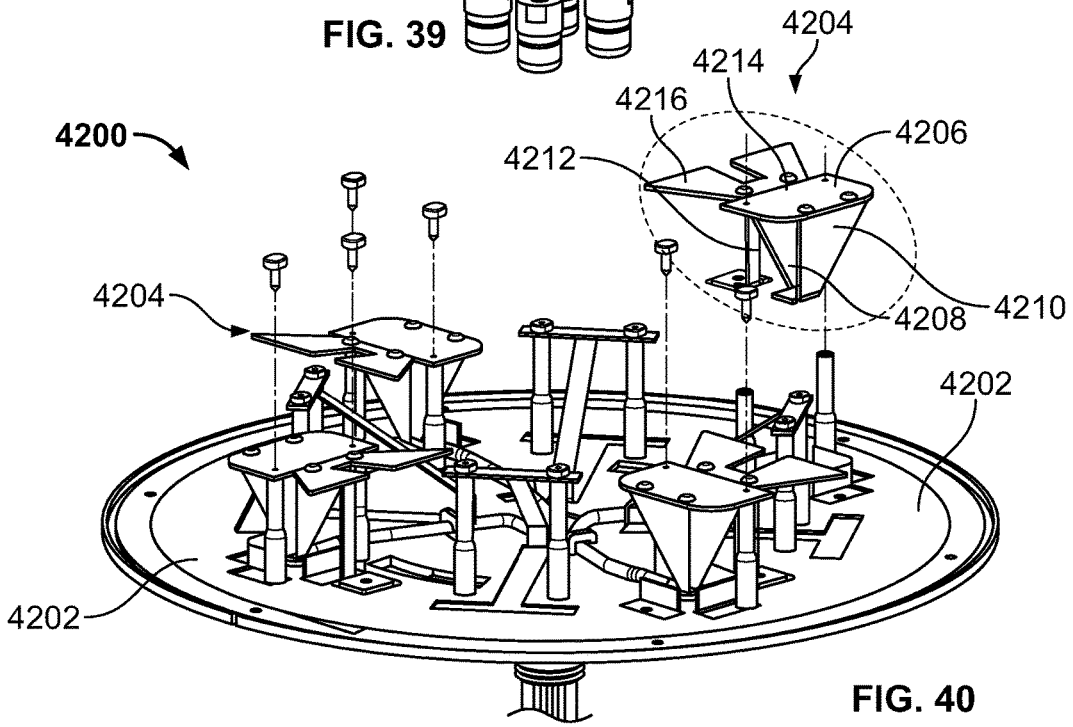
Figure 41:
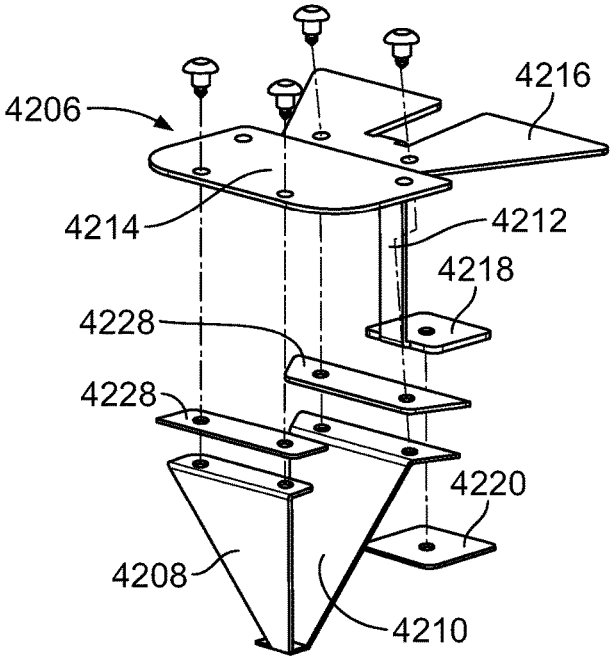
Figure 42:
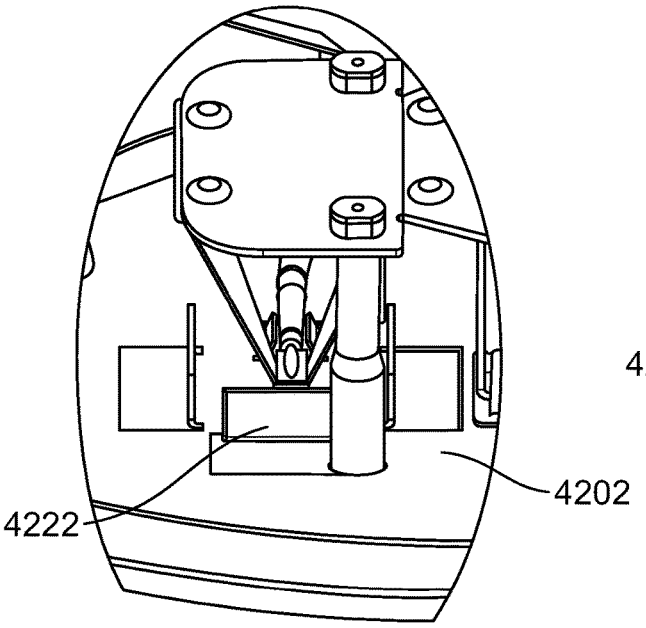
Figure 43:
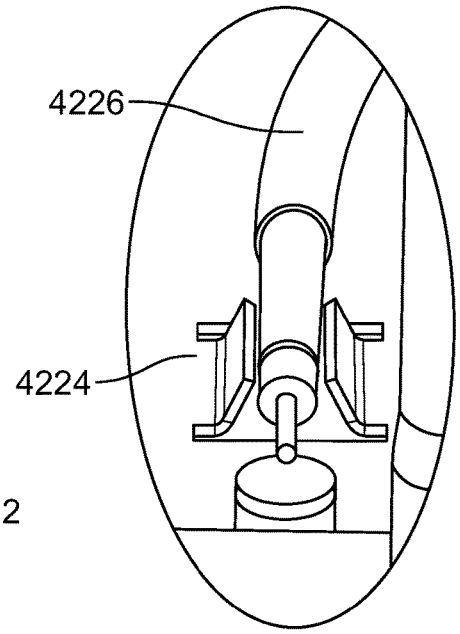
Figure 44:
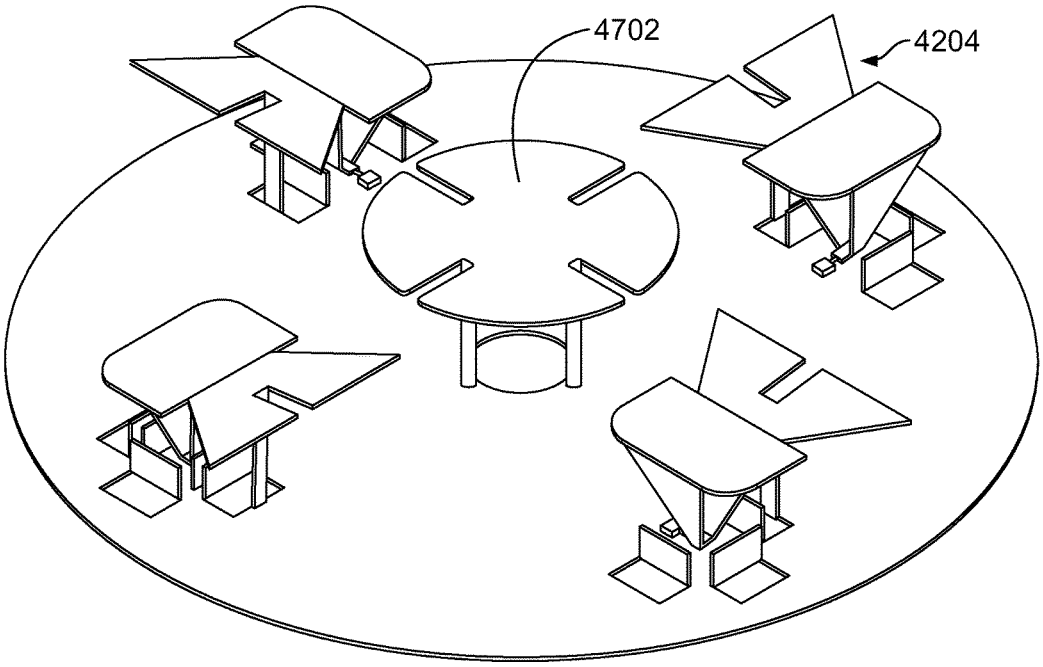
Figure 45:
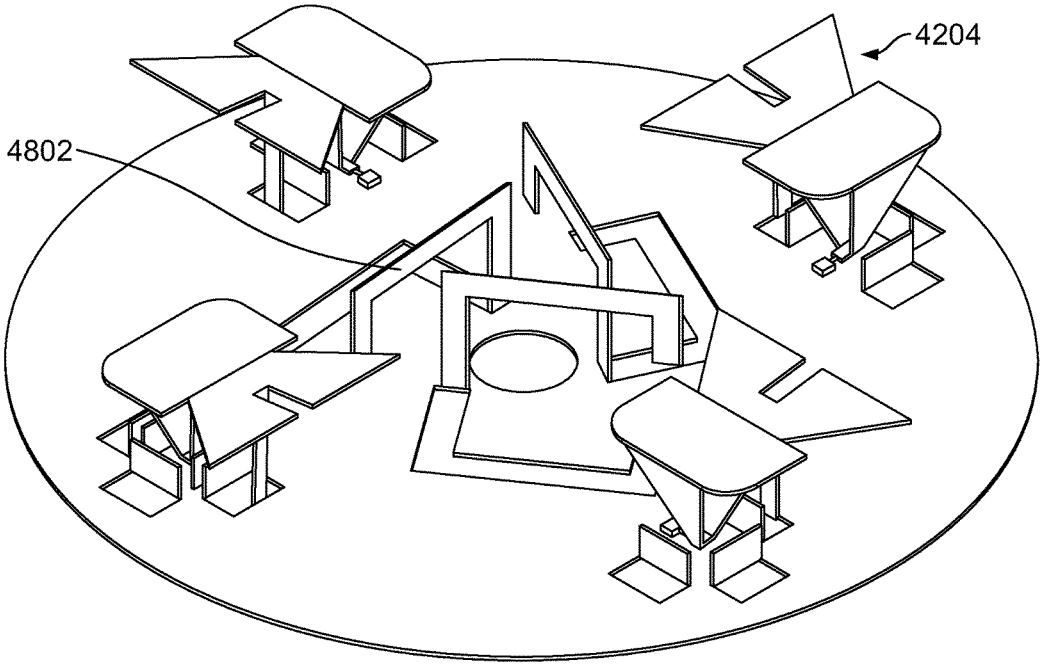
Figure 48A:
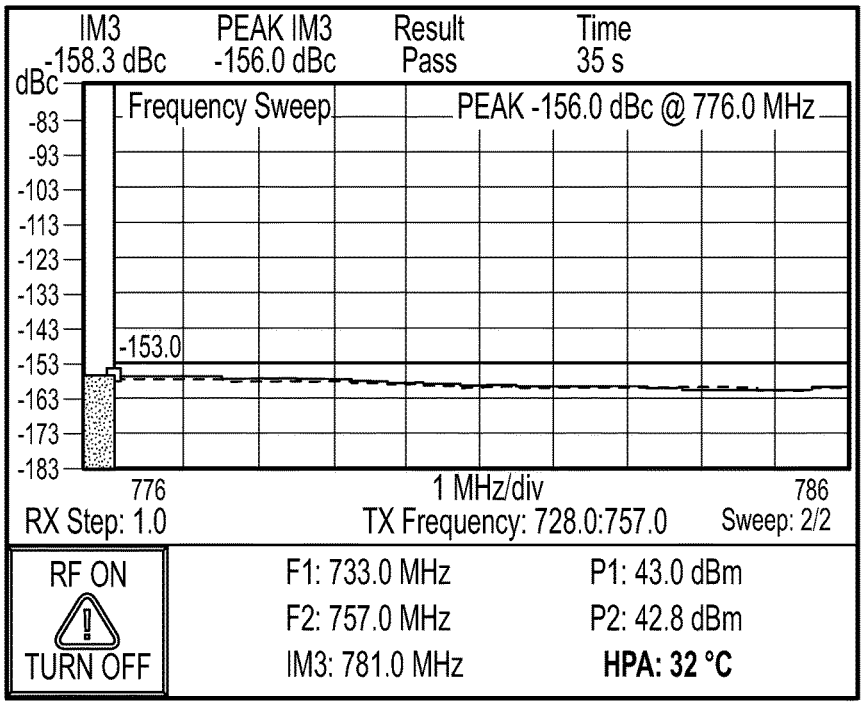
Figure 48B:
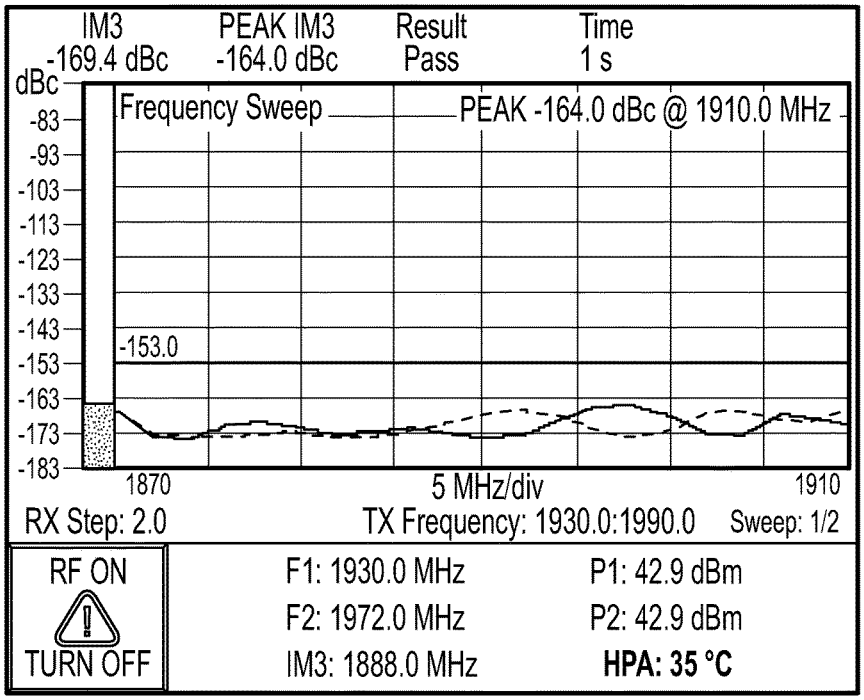
Figure 48C:
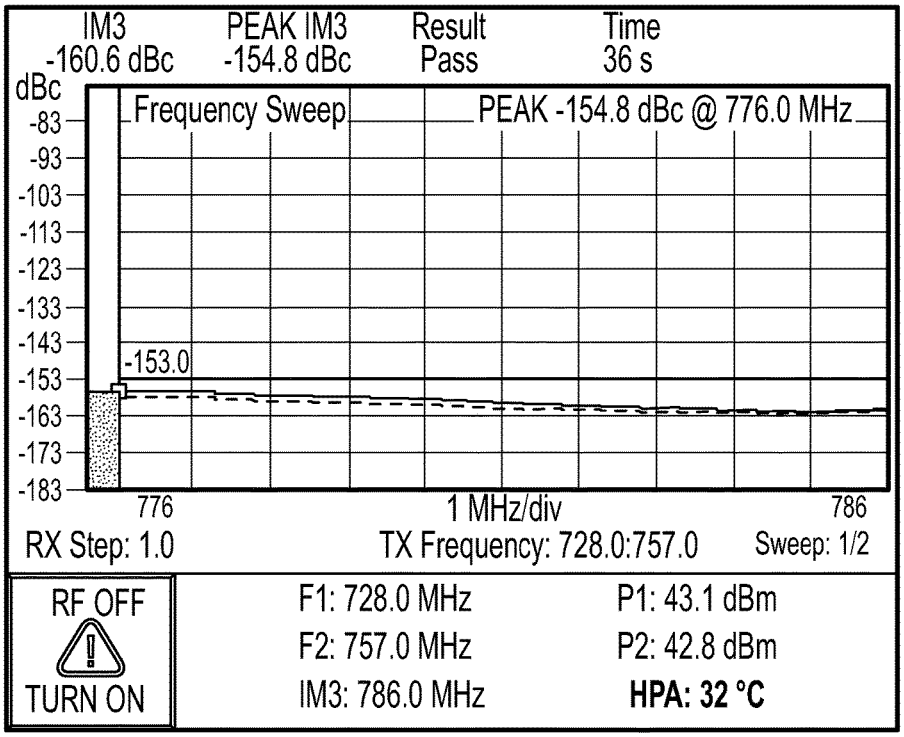
Figure 48D:
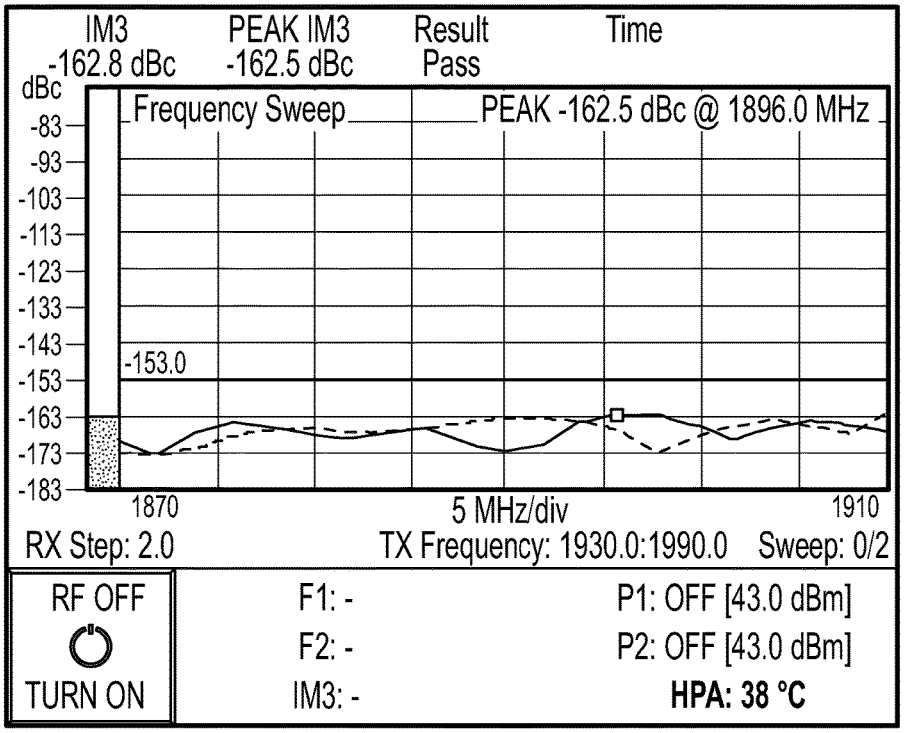
Figure 48E:
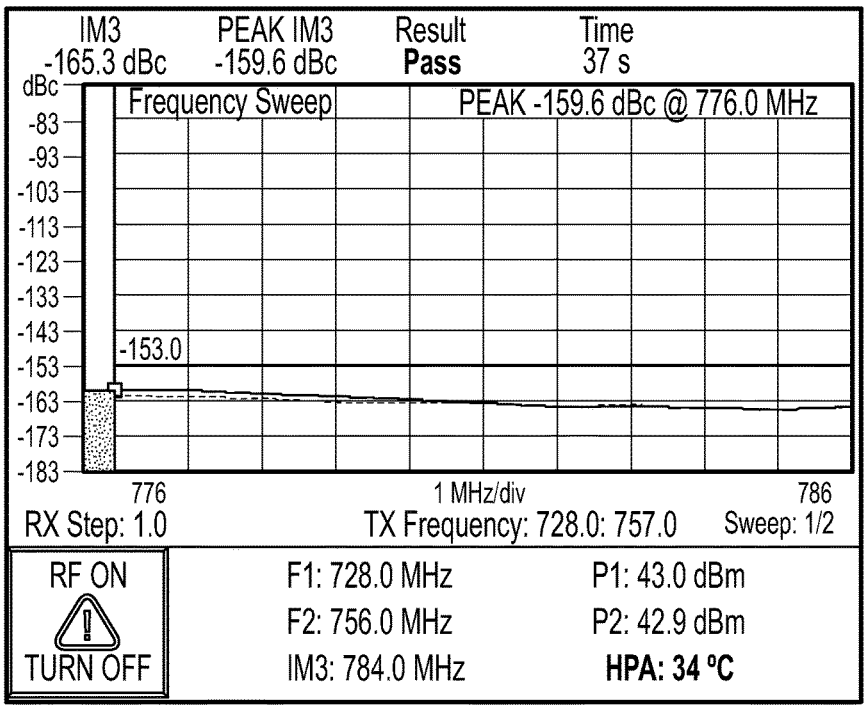
Figure 48F:
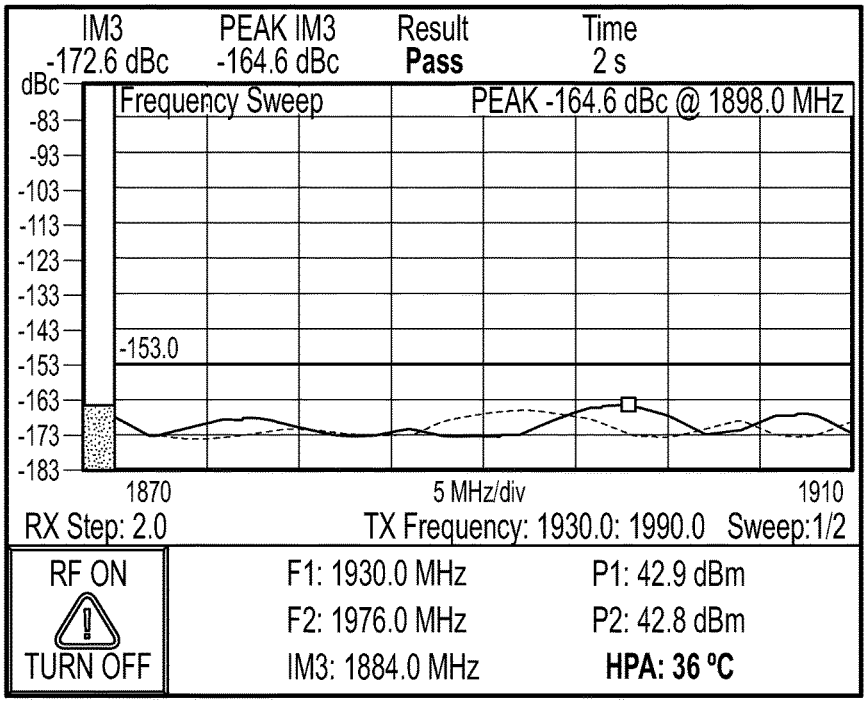
Figure 48G:
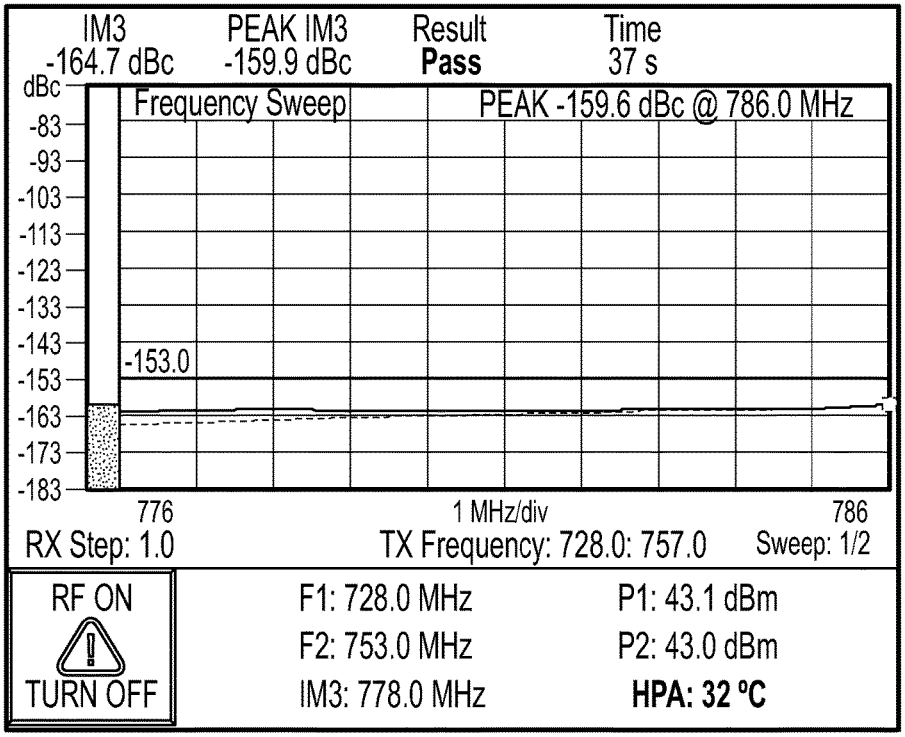
Figure 48H:
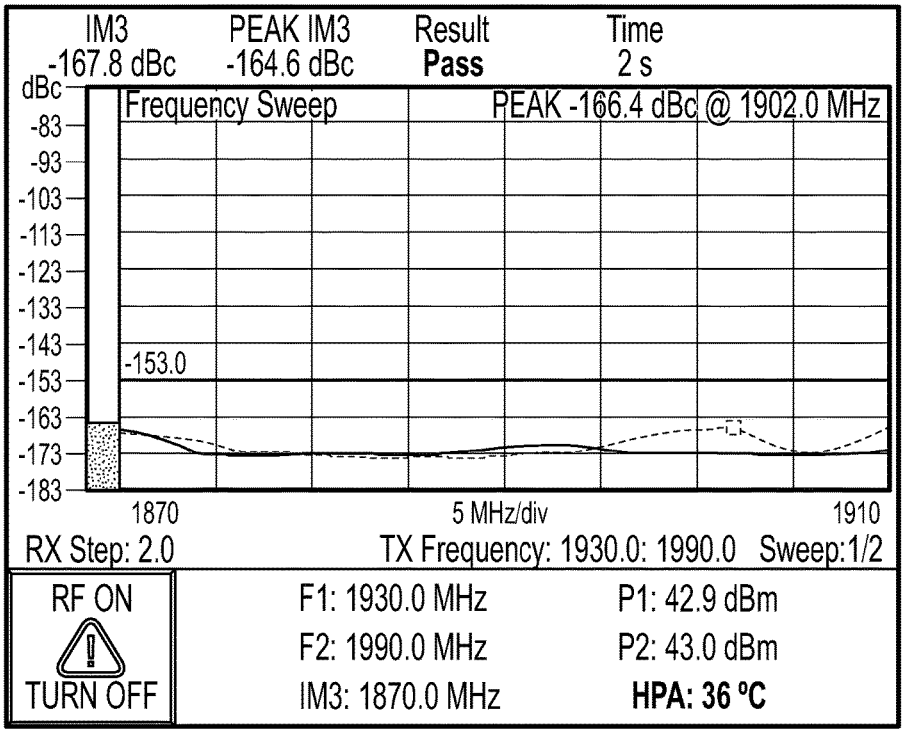
Figure 49:
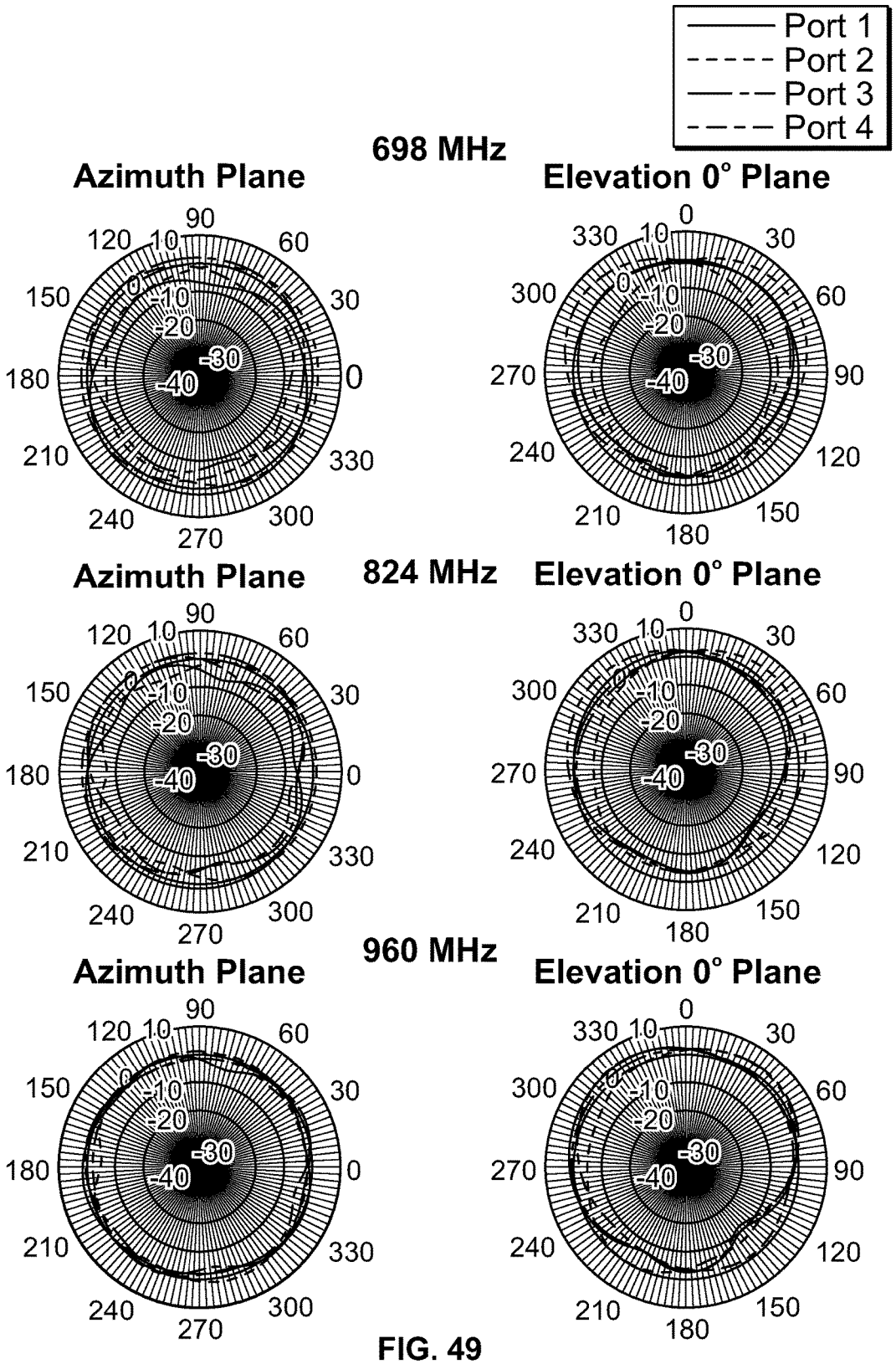
Figure 49:
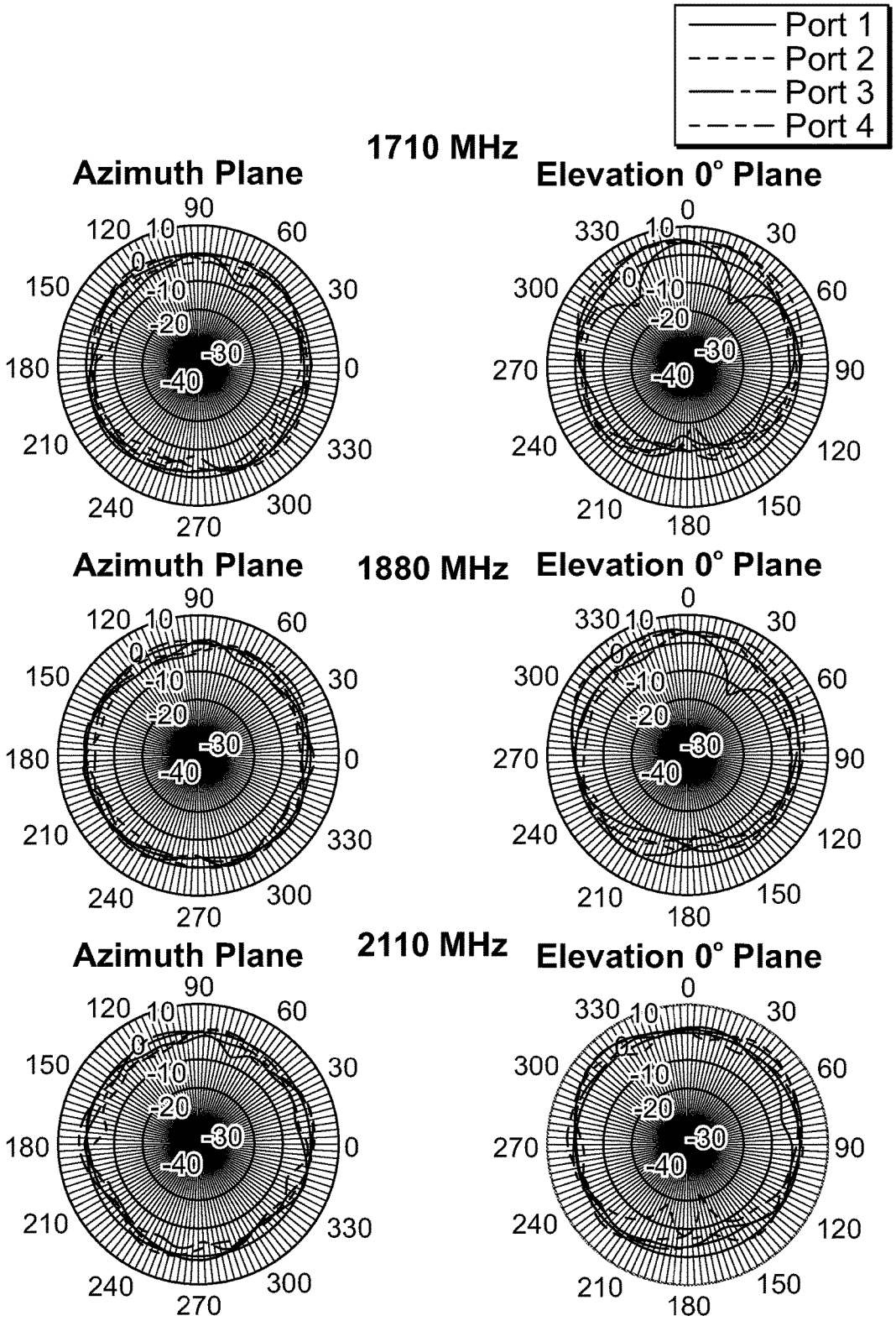
Figure 49:
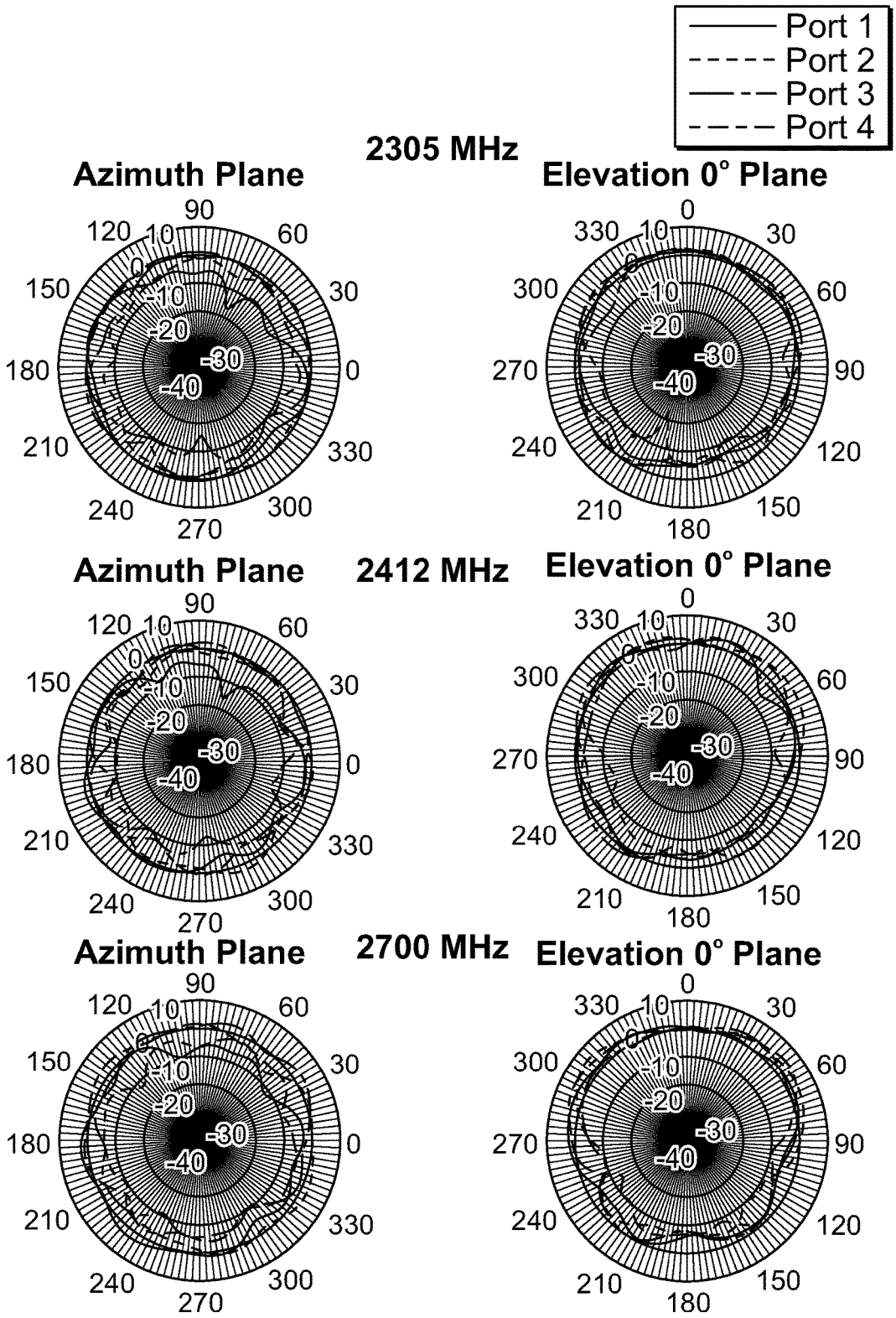

FIGS. 21*a-d* are exemplary line graphs of PIM (in decibels relative to carrier (dBc)) versus frequency (in MHz)) measured for ports 1 and 2 of the exemplary prototype antenna system of FIG. 18;

FIG. 22 is a perspective view of an antenna system or assembly including two antennas and two ground planes according to exemplary embodiments;

FIG. 23 is a perspective view of the exemplary antenna system of FIG. 22;

FIG. 24 is a side view of the exemplary antenna system of FIG. 22;

FIGS. 25-31 are enlarged perspective views of a portion of the exemplary antenna system of FIG. 22;

FIG. 32 is a top view of an exemplary prototype of the antenna system of FIG. 22;

FIG. 33 is a perspective view of an exemplary radome for housing the exemplary antenna system of FIG. 22;

FIG. 34 is an enlarged perspective view of a portion of the exemplary antenna system of FIG. 22 and an example of improvement of the radiation pattern (Farfield Realized Gain Abs (Theta=90)) for the antenna system realized by adding the ground flap;

FIG. 35 is an exemplary line graph illustrating return loss and isolation in decibels (dB) versus frequency in gigahertz (GHz) simulated for the antenna system shown in FIG. 22;

FIG. 36 includes exemplary line graphs illustrating measured return loss (S11, S22, and S21) in decibels versus frequency for the antenna assembly shown in FIG. 22;

FIG. 37 illustrates radiation patterns (azimuth plane, Phi 0° plane, and Phi 90° plane) measured for the antenna system shown in FIG. 22 at frequencies of 698 MHz, 725 MHz, 824 MHz, 880 MHz, 894 MHz, 960 MHz, 1710 MHz, 1730 MHz, 1850 MHz, 1930 MHz, 2130 MHz, 2170 MHz, 2310 MHz, and 2600 MHz;

FIGS. 38*a* through 38*d* are exemplary line graphs illustrating measured gain, efficiency, Azimuth gain, and Azimuth ripple, respectively, for the antenna system shown in FIG. 22;

FIG. 39 is a perspective view of an antenna system including four antennas and one ground plane according to exemplary embodiments;

FIG. 40 is a perspective view of the exemplary antenna system of FIG. 39;

FIGS. 41-43 are enlarged perspective views of a portion of the exemplary antenna system of FIG. 39;

FIG. 44 is a perspective view of the exemplary antenna system of FIG. 39 but including an isolator patch according to exemplary embodiments;

FIG. 45 is a perspective view of the exemplary antenna system of FIG. 39 but including isolator goal posts according to exemplary embodiments;

FIGS. 46*a* through 46*d* are exemplary line graphs illustrating VSWR versus frequency measured for port 1, port 2, port 3, and port 4, respectively, of the exemplary antenna system of FIGS. 39-43;

FIGS. 47*a* through 47*f* are exemplary line graphs illustrating isolation (in decibels) versus frequency measured between the various ports of the exemplary antenna system of FIGS. 39-43;

FIGS. 48*a* through 48*h* are exemplary line graphs of PIM (in decibels relative to carrier (dBc)) versus frequency (in MHz)) measured for the various ports of the exemplary antenna system of FIGS. 39-43; and FIG. 49 illustrates radiation patterns (azimuth plane and elevation plane) measured for the exemplary antenna system of FIGS. 39-43 at frequencies of 698 MHz, 824 MHz, 960 MHz, 1710 MHz, 1880 MHz, 2110 MHz, 2305 MHz, 2412 MHz, and 2700 MHz.

DETAILED DESCRIPTION

Example embodiments will now be described more fully with reference to the accompanying drawings.

The inventors hereof have recognized a need for relatively low profile antenna systems that have low PIM (Passive Intermodulation) (e.g., able to qualify as a low PIM rated design, etc.), good and/or improved bandwidth (e.g., meet the LTE/4G application bandwidth from 698-960 MHz and from 1710-2700 MHz, etc.), good and/or improved isolation, and/or provide good and/or improved voltage standing wave ratio (VSWR) margin at production. Additionally, the low profile antenna systems may have design flexibility including one or more modular concepts, allow for multiple antennas in a smaller footprint, provide good and/or improved omnidirectional characteristics (e.g., compared to the height of the antenna(s), etc.) including good and/or improved vertical polarization radiation patterns. Accordingly, disclosed herein are exemplary embodiments of antennas and antenna systems including the same (e.g., 100 (FIGS. 1 and 2), 600 (FIGS. 6-10), 1300 (FIGS. 13 and 14), 1500 (FIGS. 15-20), 2200 (FIGS. 22-31), 4200 (FIGS. 39-43), etc.) that include one or more of the above mentioned features.

In exemplary embodiments, a low PIM design may be realized by reducing galvanic metal-to-metal contact surface and minimizing (or at least reducing) soldering area, along with good or improved bandwidth and isolation by introducing parasitic elements and a unique isolator configuration. In some exemplary embodiments further explained below, a low PIM design may be realized by employing, for example, one or more plastic rivets, nylon screws/nut, etc., by employing proximity coupling between, for example, a shorting leg, a radiating element, etc. and other portions of the antenna(s), etc. If galvanic contact cannot be achieved by soldering or proximity coupling cannot be achieved, metal screws/nut can be employed but with more care, e.g., with enough torque to provide sufficient compression contact. Proximity coupling may help to minimize or reduce metal-to-metal contact to have good PIM performance level. Direct galvanic coupling may be used when parts are able to be joined by soldering or by having sufficient compression contact to achieve satisfactory PIM level. The low PIM design also has the design flexibility and capability to accommodate both a pigtail connector type and a fixed connector type with good and/or improved performance consistency. Disclosed exemplary embodiments have superior or increased bandwidth, improved isolation without compromising overall bandwidth, and improved or low PIM.

According to aspects of the present disclosure, exemplary embodiments may include one or more (or all) of the following features to realize or achieve low PIM and/or other advantages disclosed herein. In an exemplary embodiment, the antenna system preferably does not include any ferromagnetic material or ferromagnetic components including right plating that could otherwise be a source of PIM. Instead, the radiating elements and ground plane disclosed herein may instead be made of brass, aluminum, or other suitable non-ferromagnetic material. The connectors and cable are preferably PIM rated components. If any ferromagnetic material is used, the ferromagnetic material is preferably used away from or remote from (e.g., not adjacent) to high current areas of the antenna system or assembly.

The radiating element grounding may be based on proximity couple grounding by introducing dielectric adhesive tape (broadly, dielectric member) and/or another suitable insulating material below the radiating elements to avoid direct galvanic contact between the radiating elements and the ground plane. Additionally, one or more insulating materials may be positioned between, e.g., a cable bracket (or the like) and the ground plane. See, for example, FIGS. 15-20 in which an insulating material 1552 is aligned for positioning between the cable bracket 1542 and the ground plane 1508.

Additionally, there may be relatively small areas for soldering the contacts of the connector to the ground plane. Accordingly, the connector may be connected or grounded to the ground plane with a relatively small area soldering contact.

A dielectric member may be positioned between an upper surface of a connector and the ground plane to electrically insulate and minimize (or at least reduce) direct galvanic contact between the connector's upper surface and the ground plane.

Further, the ground plane may include an integrally formed (e.g., stamped, etc.) feature for soldering a cable braid. This feature provides minimum (or at least reduced) direct galvanic contact surface between the cable braid and the ground plane as only the cross section of the integrally formed feature contacts the ground plane. Advantageously, this helps to prevent (or at least reduce) inconsistency in the contact between the cable braid and the ground plane. See, for example, FIG. 2 in which a feature 142 (e.g., a cable holder or the like) has been directly formed (e.g., stamped, etc.) from the ground plane 104. In other exemplary embodiments, a cable bracket that is proximity coupled to the ground plane (e.g., via an insulating material, etc.) may be employed (see, e.g., FIGS. 15-20).

According to further aspects of the present disclosure, exemplary embodiments may include one or more features to realize or achieve good and/or improved isolation. In an exemplary embodiment, an isolator is added between two radiating elements thereby improving isolation at low band by increasing the ground surface electrically. See, for example, FIGS. 39 and 40 in which a T-shaped isolator 4230 extends outwardly from the ground plane 4202 and increases the ground surface electrically. The improved isolation allows more antenna radiating elements to be positioned in the same volume of space or allows a smaller overall antenna assembly to be used for the same number of antenna radiating elements (e.g., for an end use where space is limited or compactness is desired, etc.).

Figure 1:
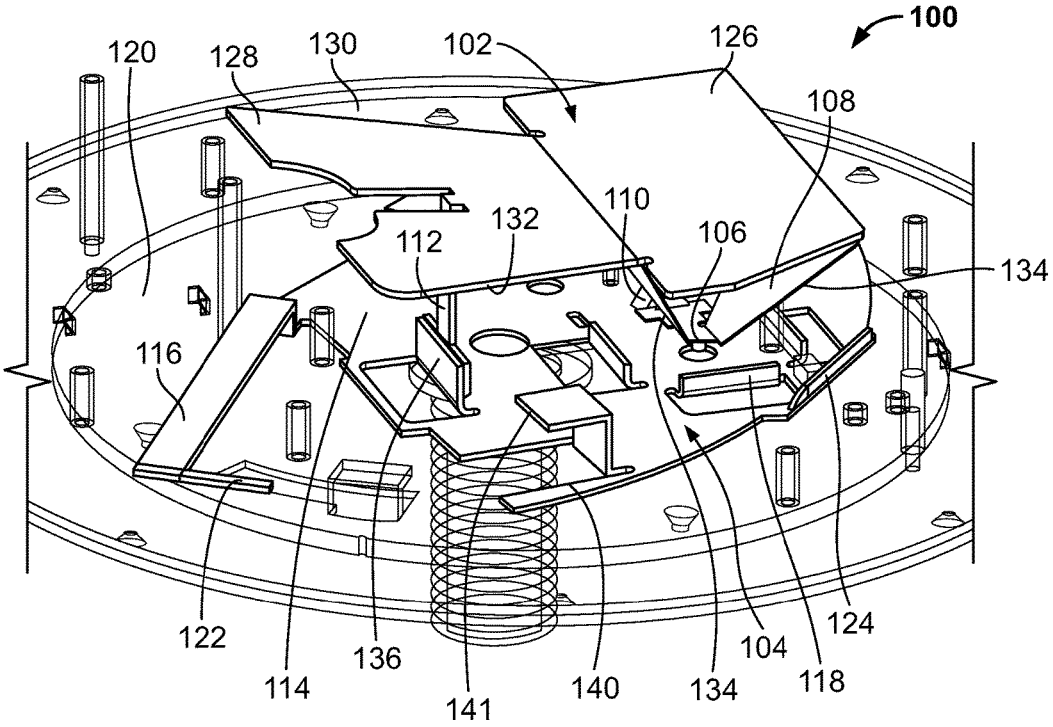
FIG. 1 is a perspective view of an antenna system or assembly according to an exemplary embodiment.
Figure 2:
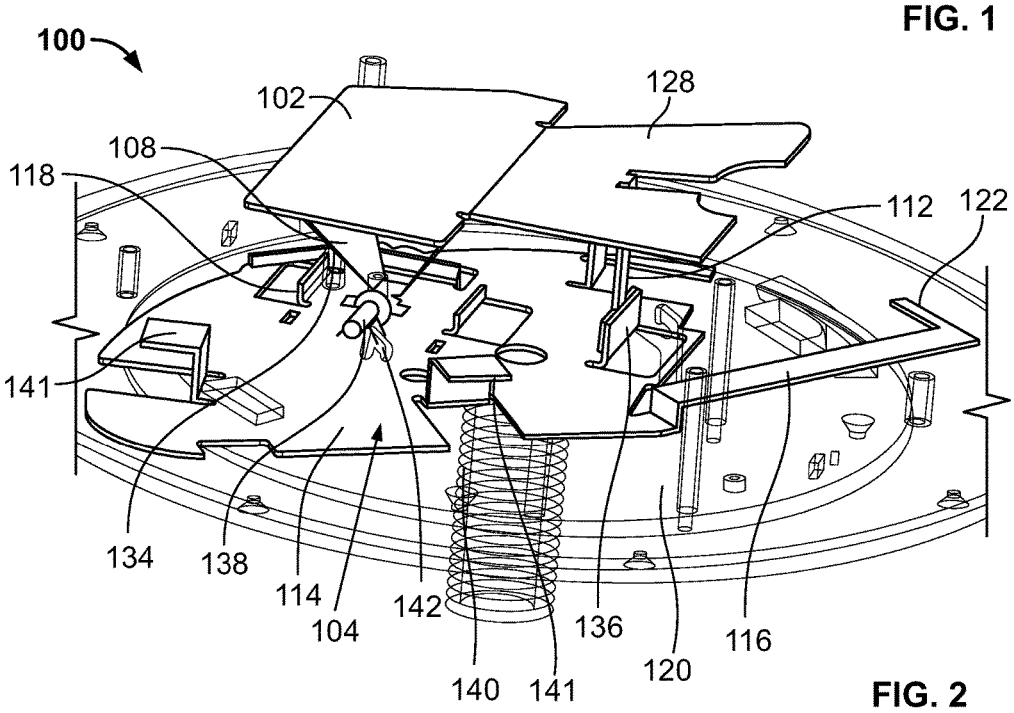
FIG. 2 is a perspective view of the antenna system shown in FIG. 2 rotated approximately 180 degrees about a vertical axis.

FIGS. 1 and 2 illustrate an exemplary embodiment of an antenna system or assembly embodying one or more aspects of the present disclosure. As disclosed herein, the antenna system is configured so as to have low PIM as well as good bandwidth and isolation.

In particular, the antenna system includes an antenna 100 operable over or with frequencies, such as frequencies within the LTE/4G bands (e.g. from about 698 MHz to about 960 MHz and from about 1710 MHz to about 2700 MHz). For example, the antenna 100 may be operable within a first frequency range from about 698 MHz to about 960 MHz and a second frequency range from about 1710 MHz to about 2700 MHz. Or, for example, the antenna 100 may be operable across a single wide frequency range from about 698 MHz to about 2700 MHz.

The antenna 100 includes an upper radiating patch element 102, a ground plane 104 spaced apart from the upper radiating patch element 102, a feed point 106 positioned adjacent the ground plane 104, two feeding elements 108, 110 electrically coupling (e.g., via proximity coupling or direct galvanic coupling) the upper radiating patch element 102 to the feed point 106, and a shorting element 112 electrically coupling (e.g., via proximity coupling or direct galvanic coupling) the upper radiating patch element 102 to the ground plane 104. The antenna system may be referred to as a single port antenna.

In this example, the upper radiating patch element 102 (or more broadly, an upper radiating surface or radiator) is positioned substantially in the center of the ground plane 104. Such configurations may allow the antenna 100 to have desirable radiation patterns for frequencies within one or more bands (e.g., LTE/4G bands from 698 MHz to 960 MHz and from 1710 MHz to 2700 MHz, etc.), provide omnidirectional characteristics, etc. as explained above. Alternatively, the upper radiating patch element 102 may be positioned in another suitable location (e.g., off-center, etc.) relative to the ground plane 104 if desired.

The ground plane 104 includes a main portion 114, a stub 116, stamped recesses 140 and portions 141, and one or more flaps 118 (sometimes referred to as a ground flap). The stub 116, the portions 141, and the flaps 118 extend from the main portion 114. The stamped recesses 140 and portions 141 may allow the ground plane 104 to couple (e.g., via plastic posts, etc.) to a substrate (e.g., a base of a radome, etc.) via a snap pin or the like as further explained below. The flaps 118 may assist in impedance matching, introduce capacitance to the feeding elements 108, 110, etc. The stub 116 may make the ground plane 104 appear electrically larger (e.g., while not substantially physically increasing the overall size of the ground plane 104, etc.), improve impedance matching (e.g., for the low band, etc.), improve radiation pattern(s), etc.

As shown in FIGS. 1 and 2, the main portion 114 of the ground plane 104 and the stub 116 are not co-planar. For example, the stub 116 is in a plane elevated from a plane including the main portion 114. Such elevation may prevent loading (and/or other undesirable effects) from a base plate 120 or the like that is coupled to the ground plane 104. In this exemplary embodiment, the stub 116 may be about five millimeters (mm) above the main portion 114 of the ground plane 104. Alternatively, the stub 116 may be another suitable distance above the main portion 114.

Additionally, the stub 116 may include one or more portions which are not co-planar. For example, and as shown in FIGS. 1 and 2, the stub 116 includes a portion 122 extending substantially perpendicular from a main portion of the stub 116. This feature may allow the size (e.g., the surface area) of the ground plane 104 to be reduced, and thus also allow for a reduction in the size of the antenna 100 and/or the antenna system.

In the exemplary embodiment of FIGS. 1 and 2, the main portion 114 of the ground plane 104 is substantially sector shaped (e.g., 120 degree circular sector, etc.). For example, the main portion 114 may have a geometric figure bounded by two radii (e.g., side edges of the main portion 114) and an arc (e.g., the circular edge extending between the side edges). The sector shaped ground plane 104 may enable the antenna 100 to have desirable omnidirectional radiation patterns for both the low and high bands.

In the some examples, the ground plane 104 may include portions bent, deformed, etc. For example, the ground plane 104 of FIGS. 1 and 2 includes a bent portion 124 adjacent the rounded or circular edge of the ground plane 104. This feature may, for example, improve impedance matching in the high band, improve the radiation pattern in the high band, etc.

The feeding elements 108, 110 of FIGS. 1 and 2 include tapering and/or inwardly slanted side edges 134 along opposite side portions of the feeding elements. Thus, the side edges 134 of each feeding element 108, 110 may be slanted or angled inwardly towards each other. Stated differently, the edges 134 may be slanted or angled inwardly toward each other in a direction from the radiating patch element 102 downward towards the ground plane 104 causing the width of the respective feeding element 108, 110 to decrease due to the tapering features or inwardly angled slanted edges 134. Accordingly, and in such examples, the upper portion of each feeding element 108, 110 adjacent and connected to the radiating patch element 102 has a width larger than a width at a lower portion of each feeding element 108, 110 adjacent to the ground plane 104. In alternative embodiments, the feeding elements 108 and/or 110 may include only one or no tapering and/or slanted features.

Additionally, each feeding element 108, 110 may extend from the radiating patch element 102 at angle such that the distance between the upper portion of each feeding element 108, 110 is larger than the distance between the lower portion of each feeding element 108, 110. In particular, the feeding elements 108, 110 are angled, slanted, etc. such that the lower portion of each feeding element 108, 110 connects to the feed point 106. As such, the feeding element 108, 110 are not co-planar with each other. Thus, the feeding elements 108, 110 with the tapering, slanted, angled, etc. features as explained above may be configured for impedance matching purposes that broaden antenna bandwidth, such that the antenna 100 is operable in the at least two frequency bands as explained above.

Further, each feeding element 108, 110 may be adjacent and connected to an edge of the radiating patch element 102. In particular, the upper portion of each feeding element 108, 110 may be adjacent and connected to an edge of a portion 126 (as further explained below) of the radiating patch element 102. This feature may result in a more desirable omnidirectional radiation pattern for the high band, a more desirable impedance match for the high band (e.g., if part of the radiating patch element 102 is outside the ground plane 104), etc.

In the exemplary embodiment of FIGS. 1 and 2, the upper radiating patch element 102 includes a portion 126 and another portion 128 (sometimes referred to as a wing patch or a top patch) extending from the portion 126. In particular, the portion 128 extends in a slanted relationship (e.g., at an obtuse angle, etc.) relative to the portion 126. As a result, the portions 126, 128 are not co-planar or parallel. These features may assist in providing sufficient length for the radiating patch element 102.

The wing patch 128 includes edges 130, 132 on opposing sides of the patch 128 that defines a width of the patch 128. As shown in FIGS. 1 and 2, the width between the edges 130, 132 tapers or varies (e.g., increases or widens, etc.) as the patch 128 extends away from the portion 126. Thus, the patch 128 may be considered a tapering wing patch.

The wing patch 128 includes shorting leg portions which define a recess. The recess may be formed by stamping, bending, deforming, etc. a portion of the wing patch 128. This particular portion may be utilized as or define the shorting element 112. Such configurations may be more cost effective as compared to employing a separate piece of material for the shorting element 112. Alternatively, the shorting element 112 may be separately formed and positioned between the radiating patch element 102 and the ground plane 104.

The shorting element 112 extends from the portion 128 of the radiating patch element 102 and couples to the ground plane 104 via a shorting tab 136. For example, and as shown in FIGS. 1 and 2, the shorting tab 136 may be integrally formed with the ground plane 104 and then bent upwards away from the ground plane 104 (e.g., stamped and bent tab, etc.). In other exemplary embodiments, the shorting tab 136 may be separately formed from the ground plane 104.

The shorting tab 136 may be coupled to an electrically insulating material such that the shorting element 112 is proximity coupled to the ground plane 104. In some exemplary embodiments, the shorting tab 136 may be coupled to the ground plane 104 and/or the shorting element 112 via adhesive or the like. Alternatively and as further explained below, the shorting tab 136 may be coupled to the ground plane 104 and/or the shorting element 112 via a plastic rivet and/or another suitable dielectric or electrically insulating fastener. Such configurations may enable a low PIM design as explained above.

Because the shorting tab 136 extends from the ground plane 104, the coupling between the shorting tab 136 and the shorting element 112 is in the vertical plane (e.g., perpendicular to the ground plane 104). Put another way, the shorting element 112 and the shorting tab 136 are coupled together above the main portion 114 of the ground plane 104. By doing so, fasteners (e.g., a plastic rivet, etc.) as explained above may be employed to couple the shorting tab 136 and the shorting element 112 without adding height to the antenna 100.

As shown in FIGS. 1 and 2, the ground plane 104 includes an integrally formed feature 142 (e.g., stamped and bent tabs, etc.) for soldering a cable braid 138. This feature provides minimum (or at least reduced) direct galvanic contact surface between the cable braid 138 and the ground plane 104 as only the cross section of the integrally formed feature contacts the ground plane 104. Advantageously, this helps to prevent (or at least reduce) any inconsistency in the contact between the cable braid 138 and the ground plane 104. In this exemplary embodiment, the ground plane 104 includes first and second pairs of stamped and bent tabs that are at an acute angle (e.g., 30 degrees, etc.) relative to the ground plane 104.

Figure 3:
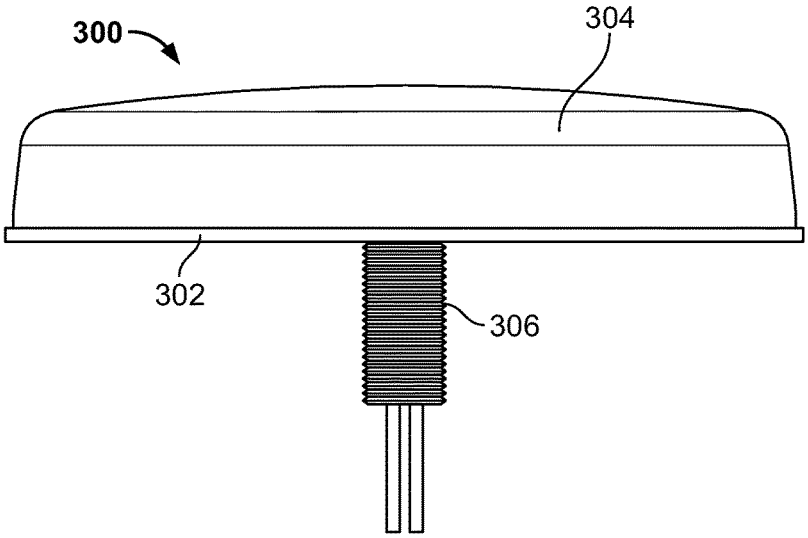
FIG. 3 is a front view of an exemplary radome for housing one or more antennas according to exemplary embodiments.

FIG. 3 illustrates an example radome 300 for housing the antenna 100 of FIGS. 1 and 2 and/or another suitable antenna system (e.g., any one or more of the antenna systems disclosed herein). The radome 300 includes a circular base 302 having a diameter of about 210 millimeters (mm) and a cover 304 extending about 49 mm from the circular base.

As shown in FIG. 3, the radome 300 includes a connector 306 for connecting the radome 300 (e.g., including the antenna 100) to another component. The connector 306 may extend from the base 302 a distance of about 50 mm. As shown in FIG. 3, coaxial cable(s) or the like may pass through the connector 306 and connect (e.g., via solder, etc.) to the antenna 100 as explained above.

Figure 4:
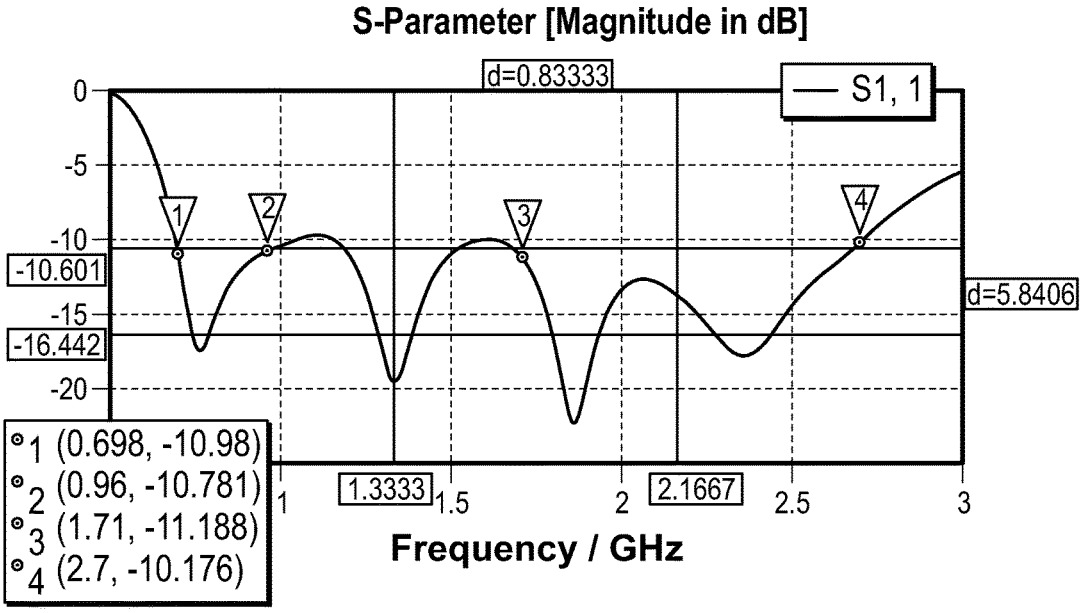
FIG. 4 is an exemplary line graph illustrating return loss in decibels (dB) versus frequency in gigahertz (GHz) simulated for the antenna system shown in FIGS. 1 and 2.
Figure 5:
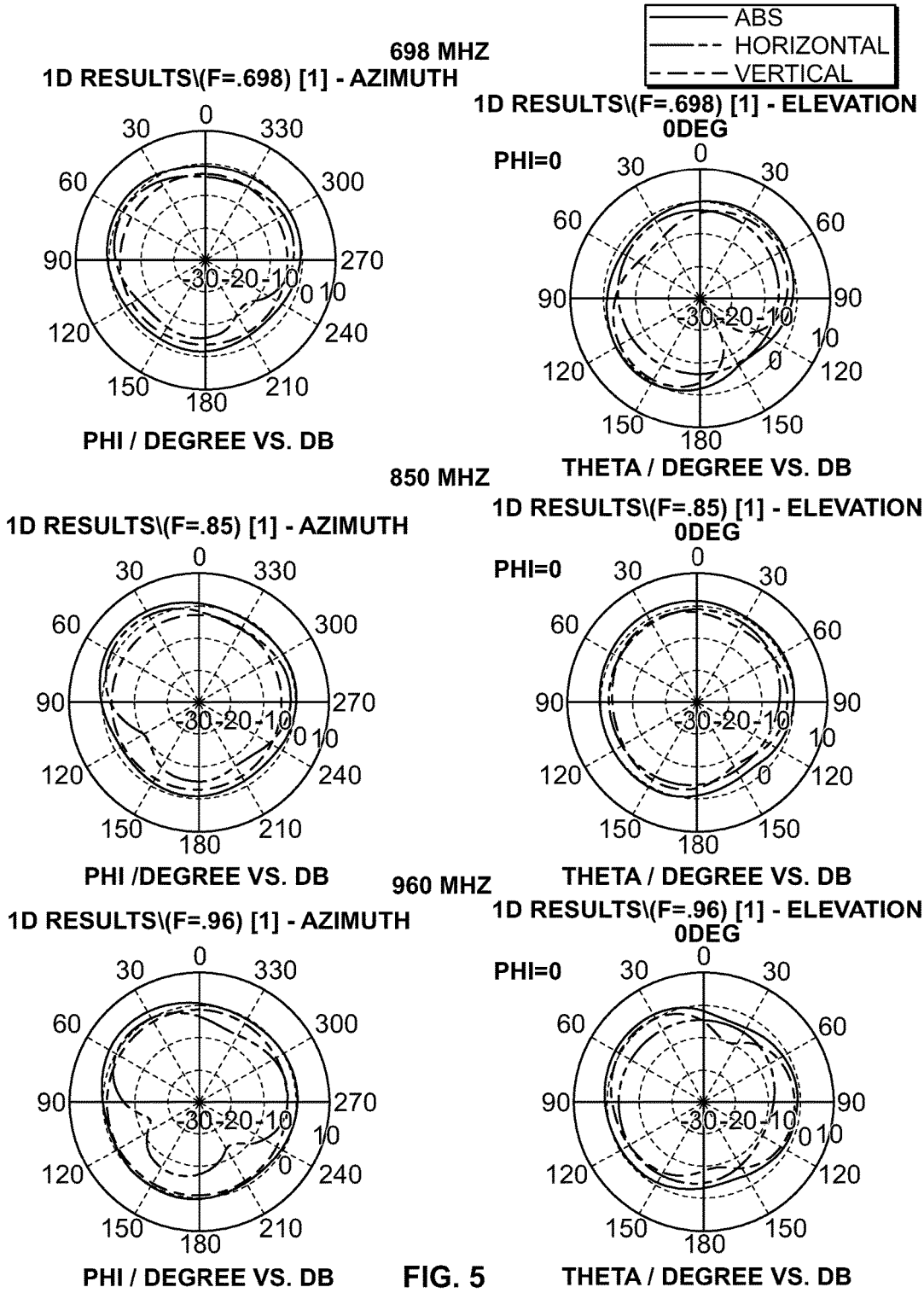
FIG. 5 illustrates radiation patterns (azimuth plane and elevation plane) simulated for the antenna system shown in FIGS. 1 and 2 at frequencies of 698 MHz, 850 MHz, 960 MHz, 1710 MHz, 1850 MHz, and 2700 MHz.
Figure 5:
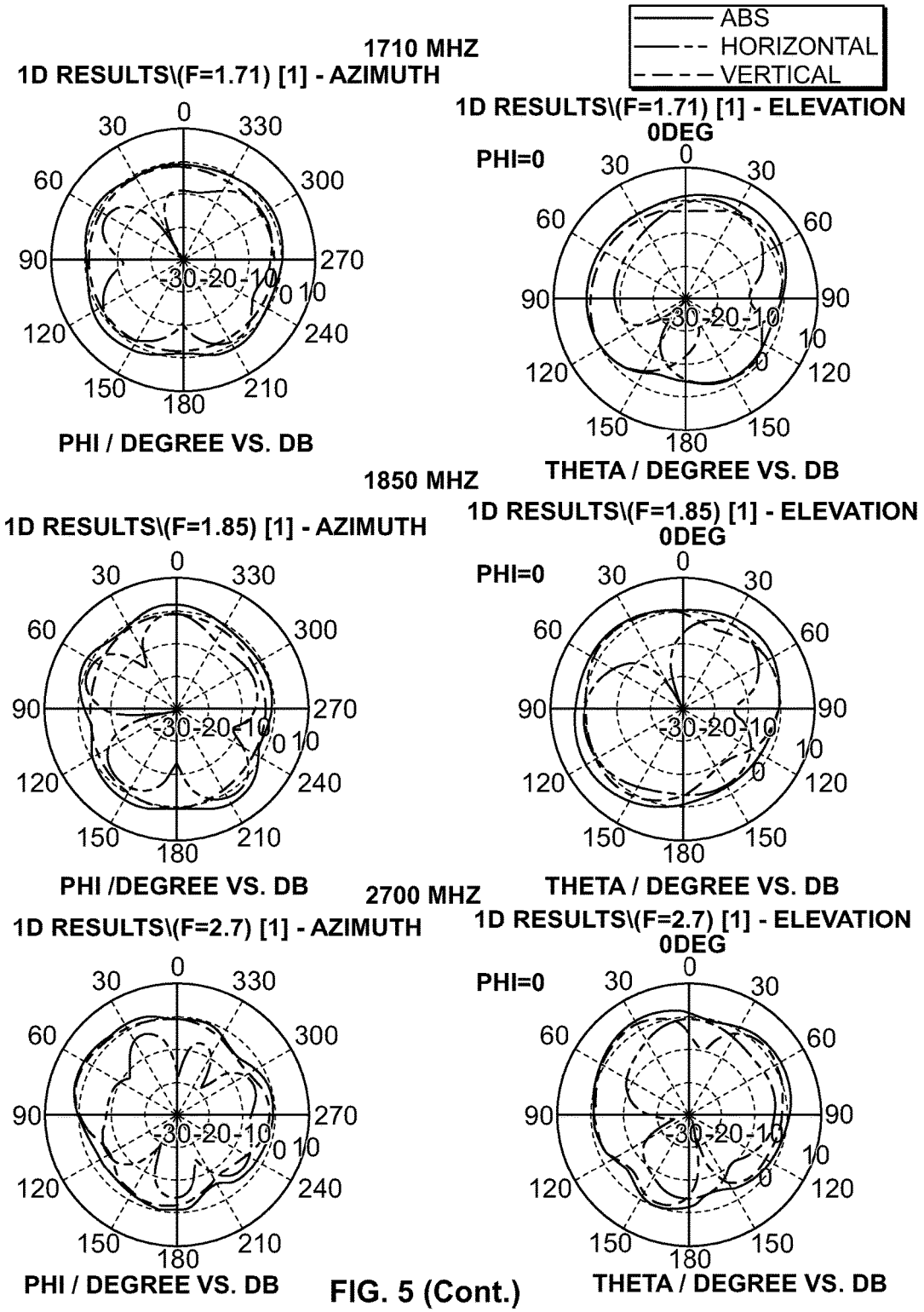
Figure 6:
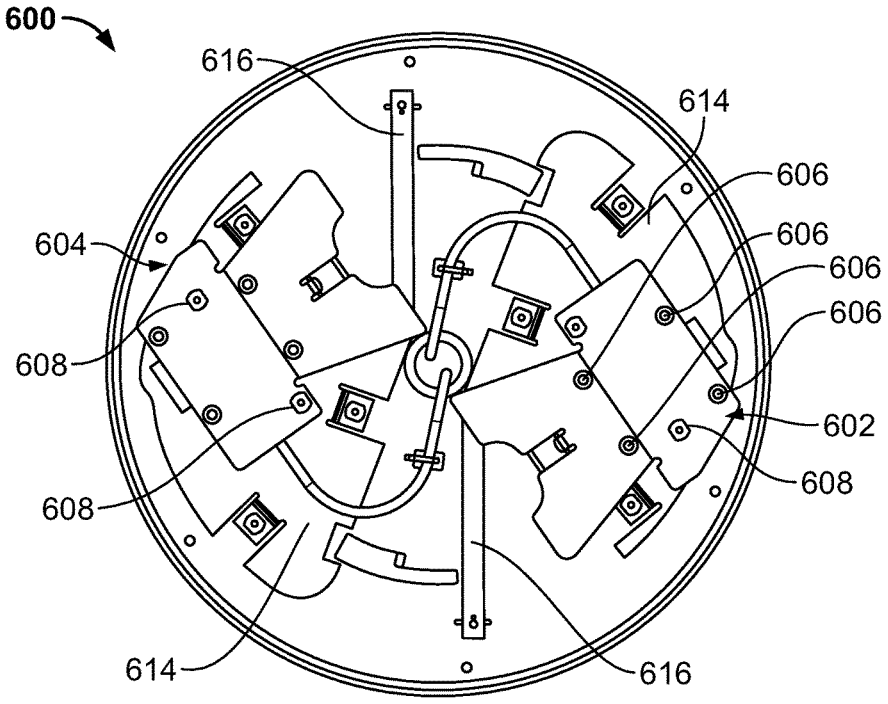
FIG. 6 is top view of an antenna system or assembly including two antennas and two ground planes according to exemplary embodiments.
Figure 7:
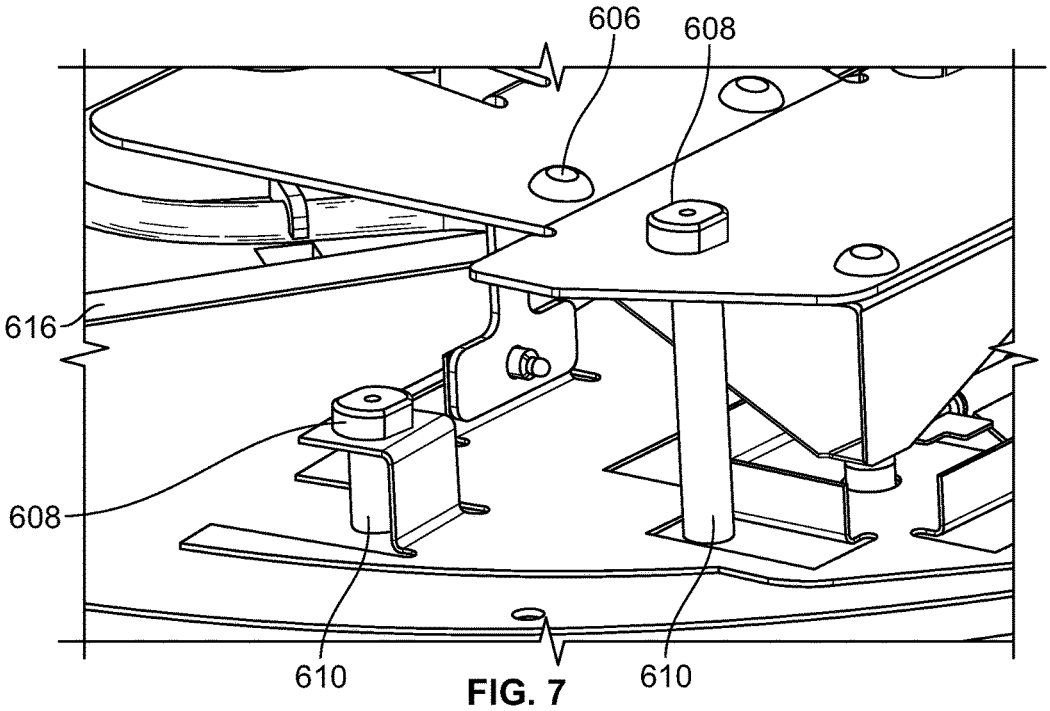
FIGS. 7, 9 and 10 are enlarged perspective views of a portion of the exemplary antenna system of FIG. 6.
Figure 8:
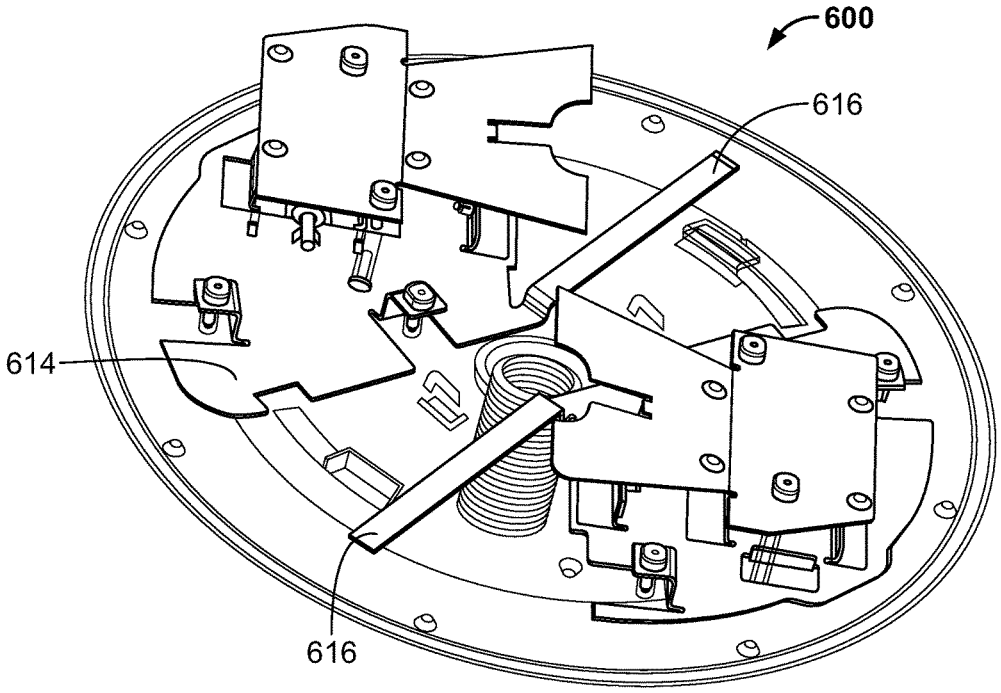
FIG. 8 is a perspective view of the exemplary antenna system of FIG. 6.
Figure 9:
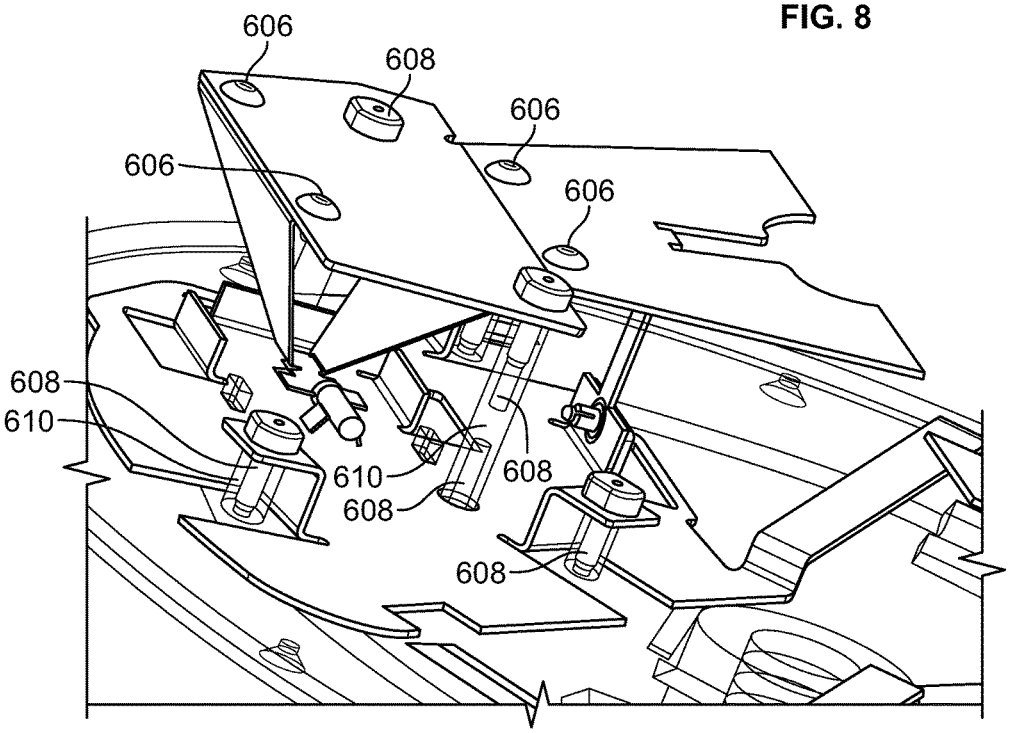
Figure 10:
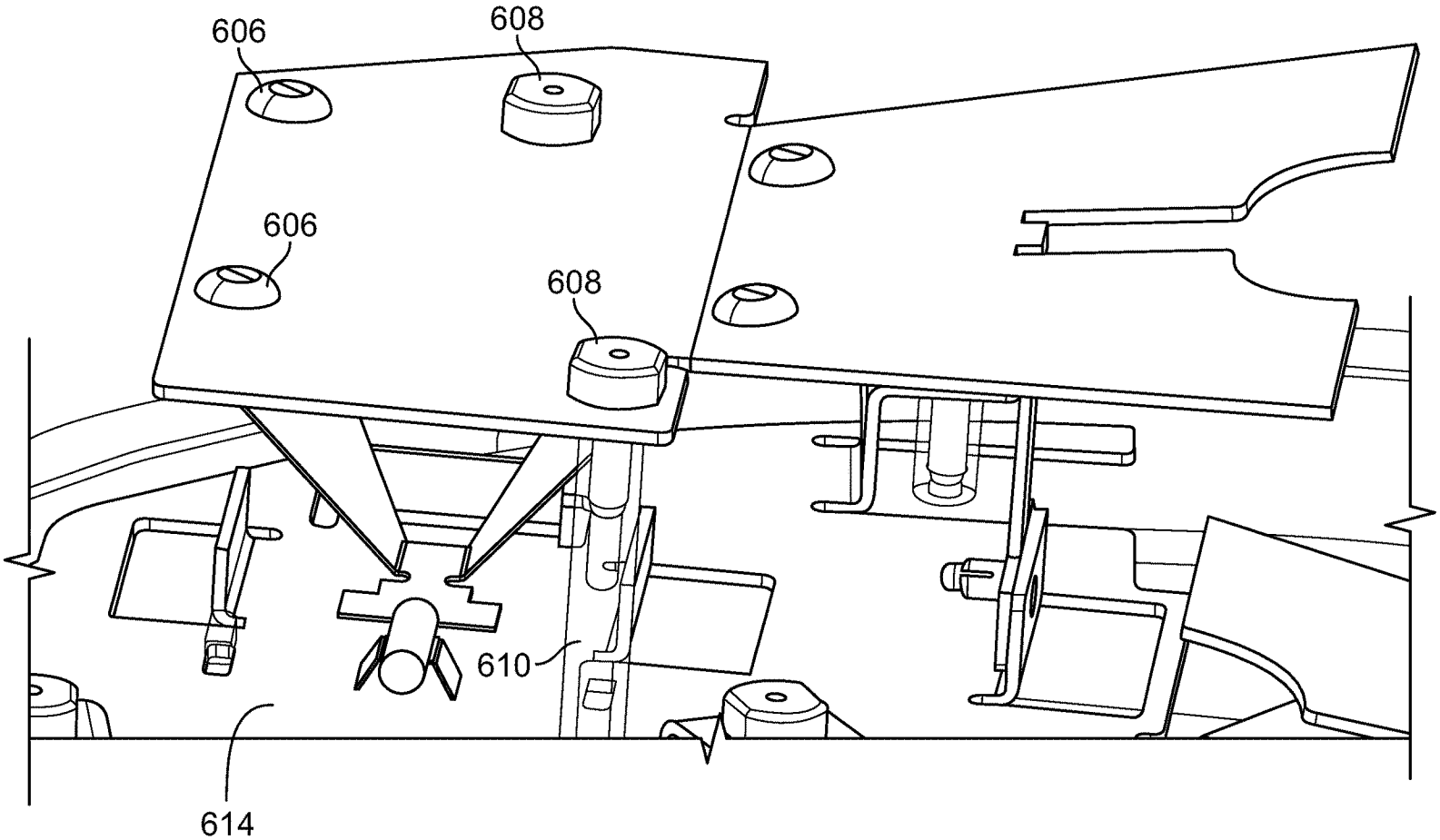

FIGS. 4 and 5 provide analysis results for a simulated design of the antenna 100 shown in FIGS. 1 and 2. These analysis results shown in FIGS. 4 and 5 are provided only for purposes of illustration and not for purposes of limitation.

More specifically, FIG. 4 is an exemplary line graph illustrating S-parameter return loss in decibels (dB) versus frequency in gigahertz (GHz) simulated for the antenna 100. Generally, FIG. 4 shows that the antenna 100 is operable with relatively good/acceptable return loss and bandwidths for LTE/4G bands (e.g. about 698 MHz to about 960 MHz and about 1710 MHz to about 2700 MHz).

FIG. 5 illustrates various radiation patterns for the simulated design of the antenna 100. More specifically, FIG. 5 illustrates absolute (abs), horizontal, and vertical radiation patterns for the azimuth plane (on the left) and elevation plane (zero degree) (on the right) at frequencies of 698 MHz, 850 MHz, 960 MHz, 1710 MHz, 1850 MHz, and 2700 MHz.

FIGS. 6-10 illustrate an exemplary embodiment of an antenna system or assembly 600 embodying one or more aspects of the present disclosure. As disclosed herein, the antenna system 600 is configured so as to have low PIM as well as good bandwidth and isolation. The antenna system 600 is operable within a first frequency range from about 698 MHz to about 960 MHz and a second frequency range from about 1710 MHz to about 2700 MHz. Or, for example, the antenna system 600 may be operable within a wide frequency range from about 698 MHz to about 2700 MHz. The antenna system 600 may be referred to as a dual port antenna.

The antenna system 600 includes two antennas 602, 604 substantially similar to the antenna 100 described above and shown in FIGS. 1 and 2. For example, each antenna 602, 604 includes substantially the same feeding elements, radiating patch elements, ground plane (except the stub as further explained below), etc. as the antenna 100. The antennas 602, 604, however, include various plastic rivets, pins, etc. for connecting various components (e.g., feeding elements, a radiating patch element, etc.) together. For example, each antenna 602, 604 includes multiple plastic rivets 606 for coupling feeding elements to a radiating patch element and multiple snap pins 608 for bracing, supporting, coupling etc. the radiating patch element, a ground plane, etc. to a substrate (e.g., a base of the radome 300, another suitable radome or the like, etc.). In particular, one or more snap pins 608 may be secured in one or more spacers 610 extending from the substrate to the radiating patch element, the ground plane, etc. In some exemplary embodiments, the spacers 610 may be direct molded from the substrate. By employing such rivets, pins, etc., a low PIM design may be realized by reducing the galvanic metal-to-metal contact surface and minimizing (or at least reducing) soldering area as explained above.

Additionally, each antenna 602, 604 includes a ground plane having a main portion 614 and a stub 616 extending from the main portion 614. The main portion 614 and the stub 616 of the ground planes of FIGS. 6-10 are substantially similar to the main portion 114 and the stub 116 of antenna 100 described above and shown in FIGS. 1 and 2. The stub 616, however, does not include an additional portion extending perpendicular from its end portion as the stub 116 does.

In this exemplary embodiment, the antennas 602, 604 are identical. For example, each antenna 602, 604 includes similar feeding elements, radiating patch elements, ground planes, etc. As shown best in FIG. 6, one of the antennas (e.g., 602) is rotated 180 degrees relative to other antenna (e.g., 604). Such configuration allows the antennas 602, 604 to be positioned adjacent the edge of, e.g., a radome and therefore may provide sufficient isolation therebetween.

Figure 11:
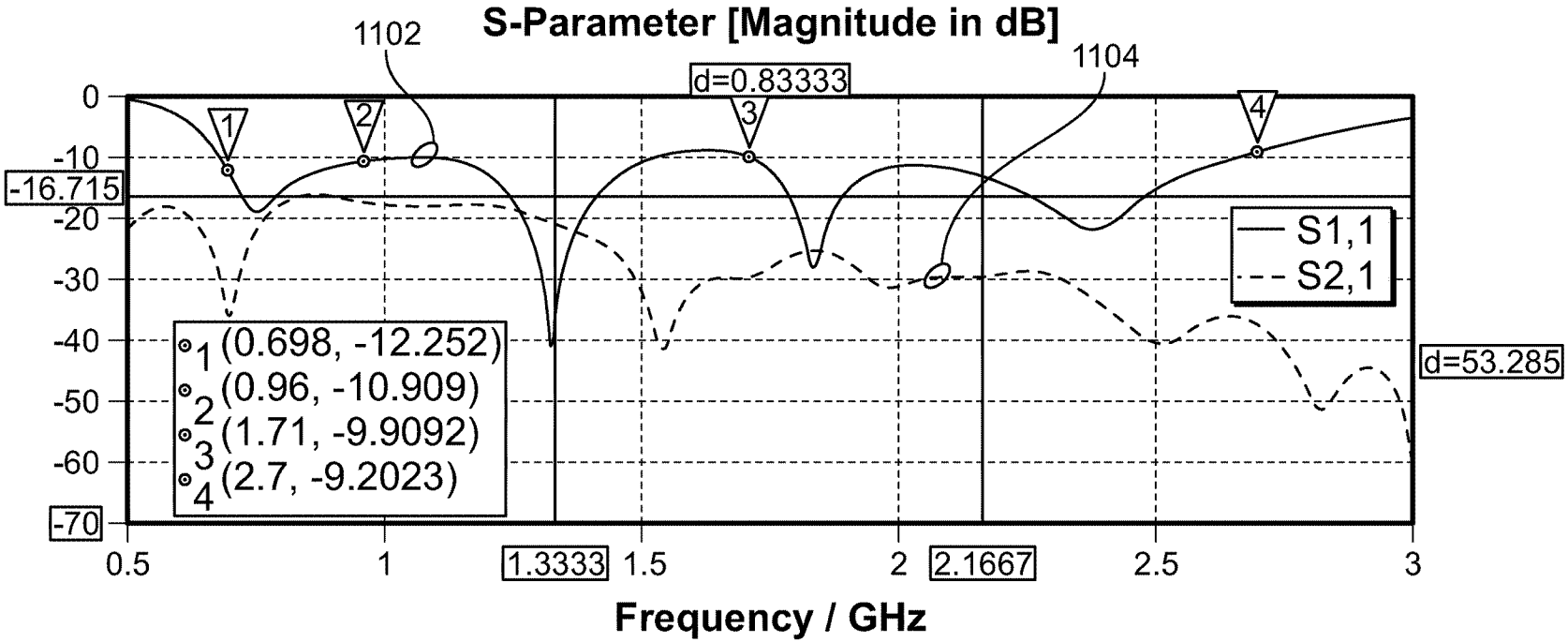
FIG. 11 is an exemplary line graph illustrating return loss and isolation in decibels (dB) versus frequency in gigahertz (GHz) simulated for the antenna system shown in FIGS. 6-10.
Figure 12:
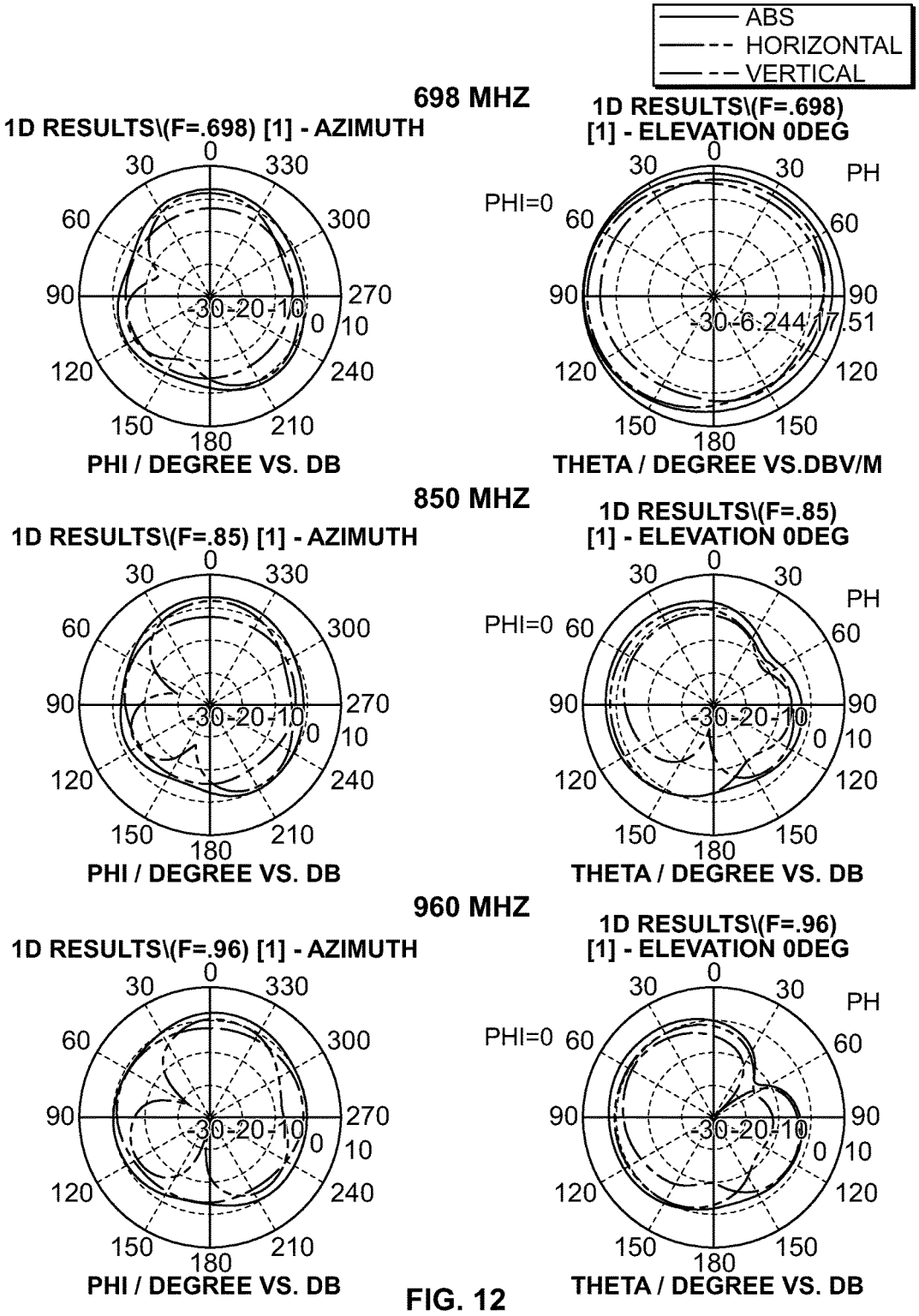
FIG. 12 illustrates radiation patterns (azimuth plane and elevation plane) simulated for the antenna assembly shown in FIGS. 6-10 at frequencies of 698 MHz, 850 MHz, 960 MHz, 1710 MHz, 1850 MHz, and 2700 MHz.
Figure 12:
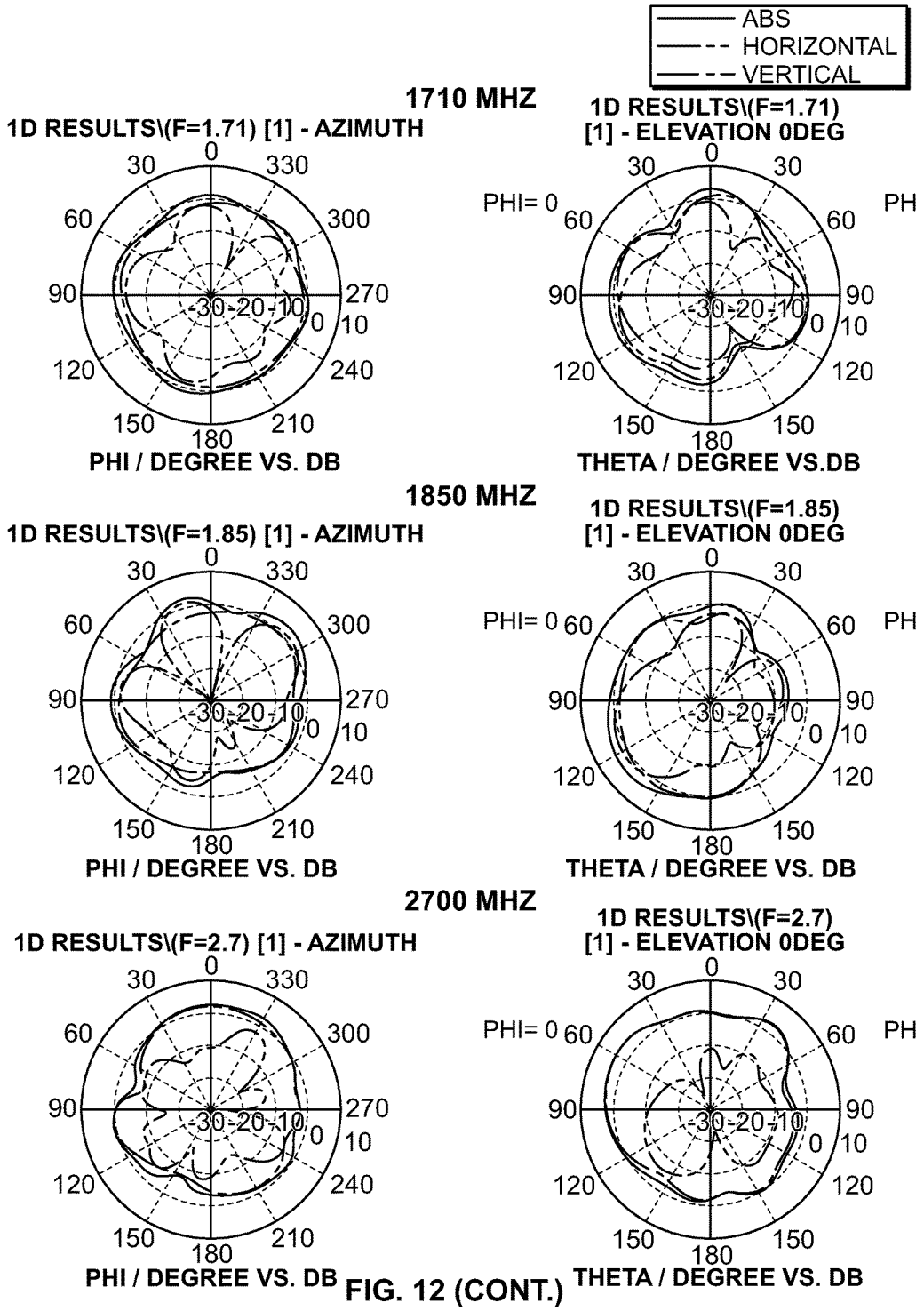

FIGS. 11 and 12 provide analysis results for a simulated design of the antenna assembly 600 shown in FIGS. 6-10. These analysis results shown in FIGS. 11 and 12 are provided only for purposes of illustration and not for purposes of limitation.

More specifically, FIG. 11 is an exemplary line graph illustrating S-parameter return loss (represented by line 1102) and isolation (represented by line 1104) between the antennas 602, 604 in decibels (dB) versus frequency in gigahertz (GHz) simulated for the antenna assembly 600. As shown, the antenna assembly 600 is operable with relatively good/acceptable return loss and bandwidths as well as relatively acceptable isolation between the antennas 602, 604 for LTE/4G bands (e.g. about 698 MHz to about 960 MHz and about 1710 MHz to about 2700 MHz). FIG. 12 illustrates various radiation patterns for the same simulated design of the antenna assembly 600. More specifically, FIG. 12 illustrates absolute (abs), horizontal, and vertical radiation patterns for the azimuth plane (on the left) and elevation plane (zero degree) (on the right) at frequencies of 698 MHz, 850 MHz, 960 MHz, 1710 MHz, 1850 MHz, and 2700 MHz.

Figure 13:
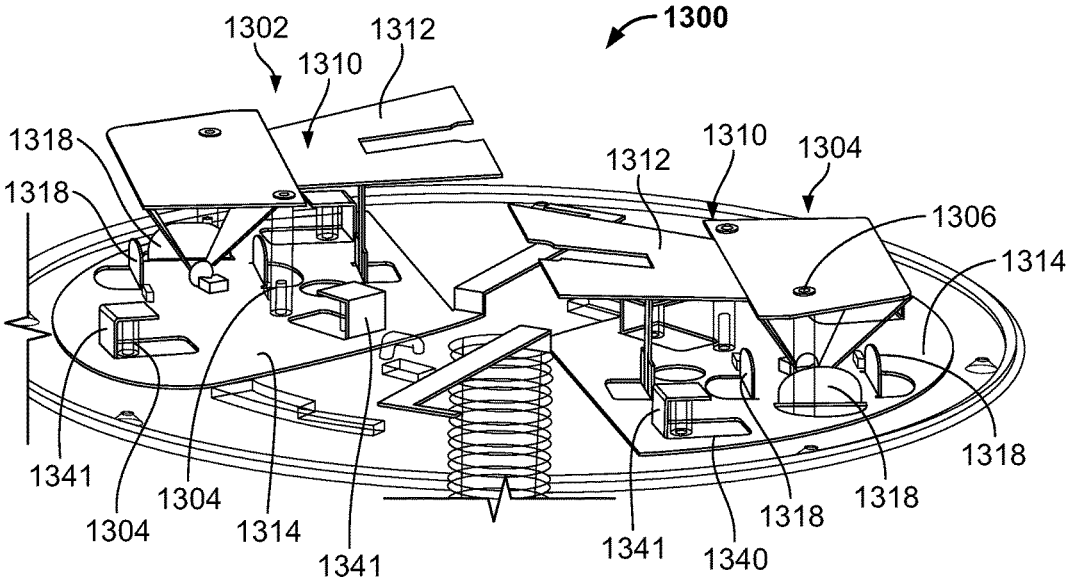
FIG. 13 is a perspective view of an antenna system or assembly including two antennas and two ground planes according to exemplary embodiments.
Figure 14:
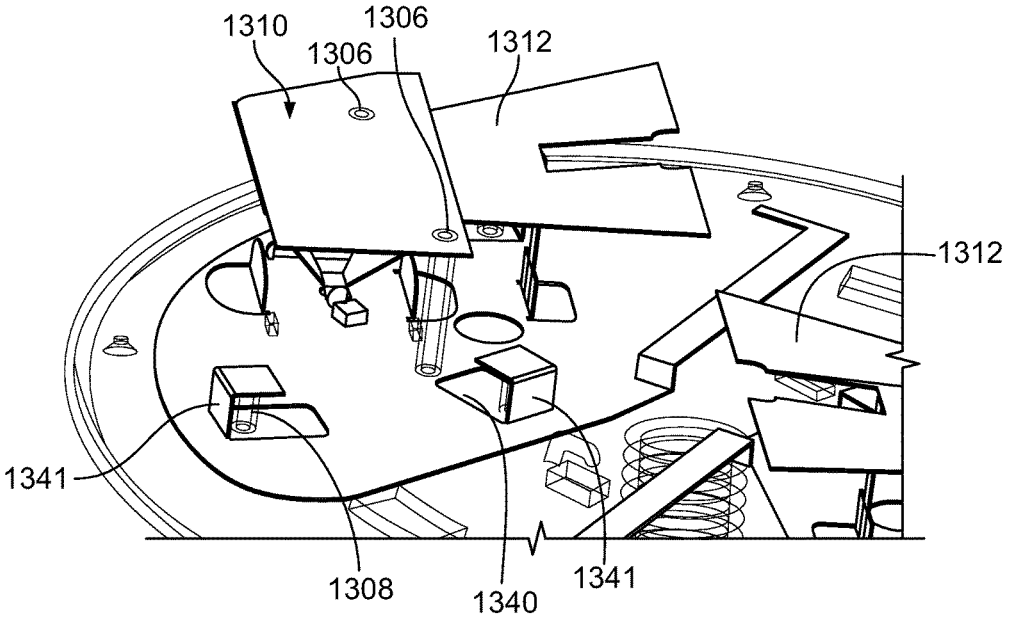
FIG. 14 is an enlarged perspective view of a portion of the exemplary antenna system of FIG. 13.

FIGS. 13 and 14 illustrate another exemplary embodiment of an antenna system or assembly 1300 embodying one or more aspects of the present disclosure. As disclosed herein, the antenna system 1300 is configured to have low PIM, good bandwidth and isolation. The antenna system 1300 may be operable within a first frequency range of about 698 MHz to about 960 MHz and a second frequency range of about 1710 MHz to about 2700 MHz. Or, for example, the antenna system 1300 may be operable within a wide frequency range from about 698 MHz to about 2700 MHz. The antenna system 1300 may be referred to as a dual port antenna.

The antenna system 1300 includes two antennas 1302, 1304 substantially similar to the antenna 100 described above and shown in FIGS. 1 and 2. But as shown in FIGS. 13 and 14, the antennas 1302, 1304 are supported by one or more snap pins 1306 and spacers 1308, coupled to a substrate (e.g., a base of the radome 300, another suitable radome or the like, etc.) via the snap pins 1306 and spacers 1308, etc. The snap pins 1306 and spacers 1308 are substantially similar to the snap pins 608 and spacers 610 described above and shown in FIGS. 6-10.

Additionally, each antenna 1302, 1304 includes a radiating patch element 1310 having a wing patch 1312. Each wing patch 1312 includes shorting leg portions defining a recess similar to the recess of the wing patch 128 of FIGS. 1 and 2. But as shown in FIGS. 13 and 14, the recess of the wing patch 1312 is smaller in area than the recess of the wing patch 128 of FIGS. 1 and 2.

Further, in this exemplary embodiment, each antenna 1302, 1304 includes a ground plane 1314 having ground flaps 1318 and stamped recesses and portions 1340, 1341 similar to the ground plane 104, ground flaps 118, and stamped recesses and portions 140, 141 of FIGS. 1 and 2. But the ground flaps 1318 of FIGS. 13 and 14 are shaped differently than the ground flaps 118 of FIGS. 1 and 2. In particular, the ground flaps 1318 are semicircular shaped as opposed to the rectangular shaped ground flaps 118 of FIGS. 1 and 2. Additionally, the stamped recesses and portions 1340, 1341 of FIGS. 13 and 14 are positioned in different locations and/or are oriented different than the stamped recesses and portions 140, 141 of FIGS. 1 and 2.

Similar to the antennas 602, 604 of FIGS. 6-10, the antennas 1302, 1304 of FIGS. 13 and 14 are identical. Additionally, one of the antennas (e.g., 1302) is rotated 180 degrees relative to other antenna (e.g., 1304) so that the antennas 1302, 1304 can be positioned adjacent the edge of a radome (or the like). This may maximize the space between the antennas 1302, 1304 and thus provide sufficient isolation therebetween as explained above.

Figure 15:
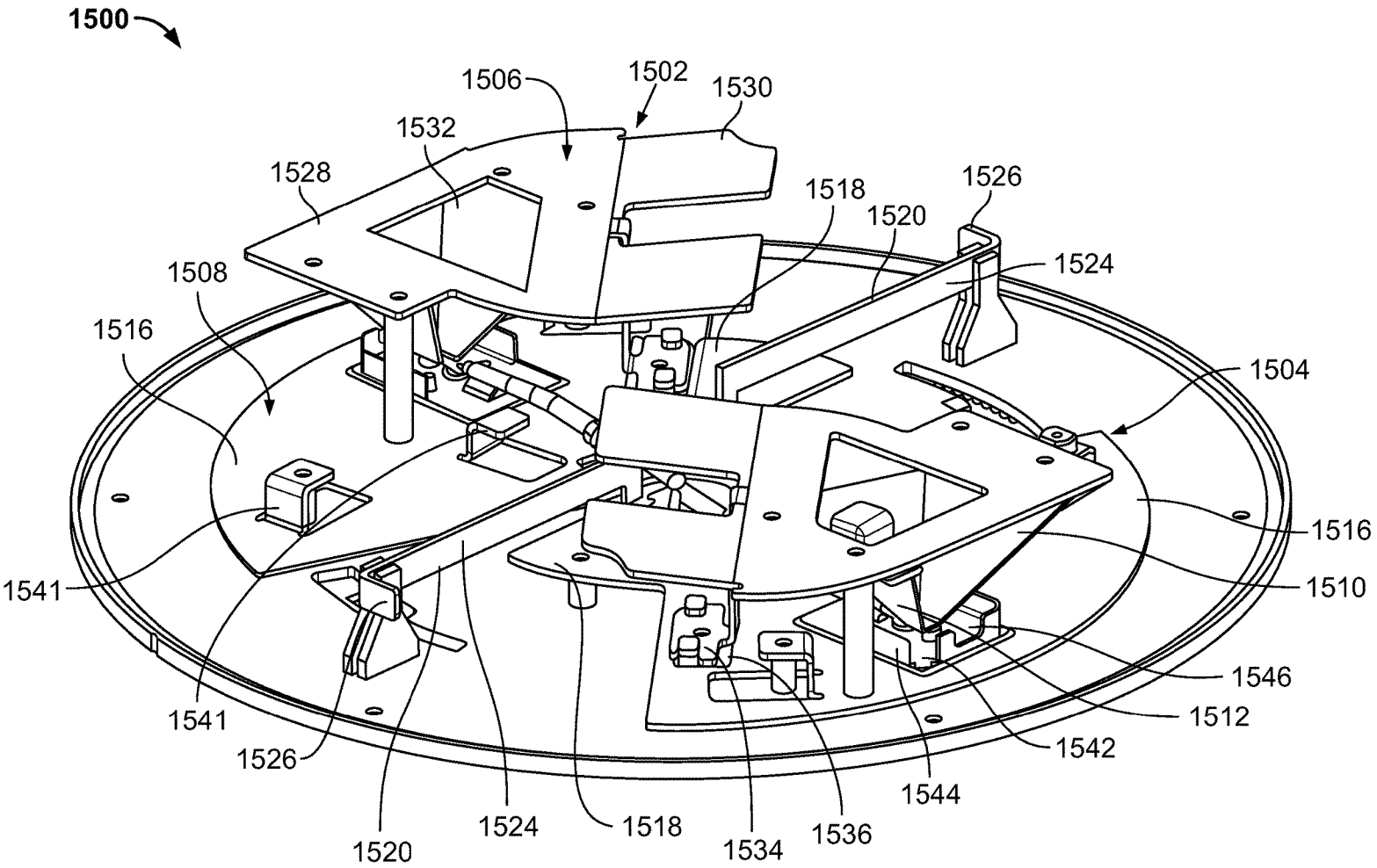
FIG. 15 is a perspective view of an antenna system or assembly including two antennas and two ground planes according to exemplary embodiments.
Figure 16:
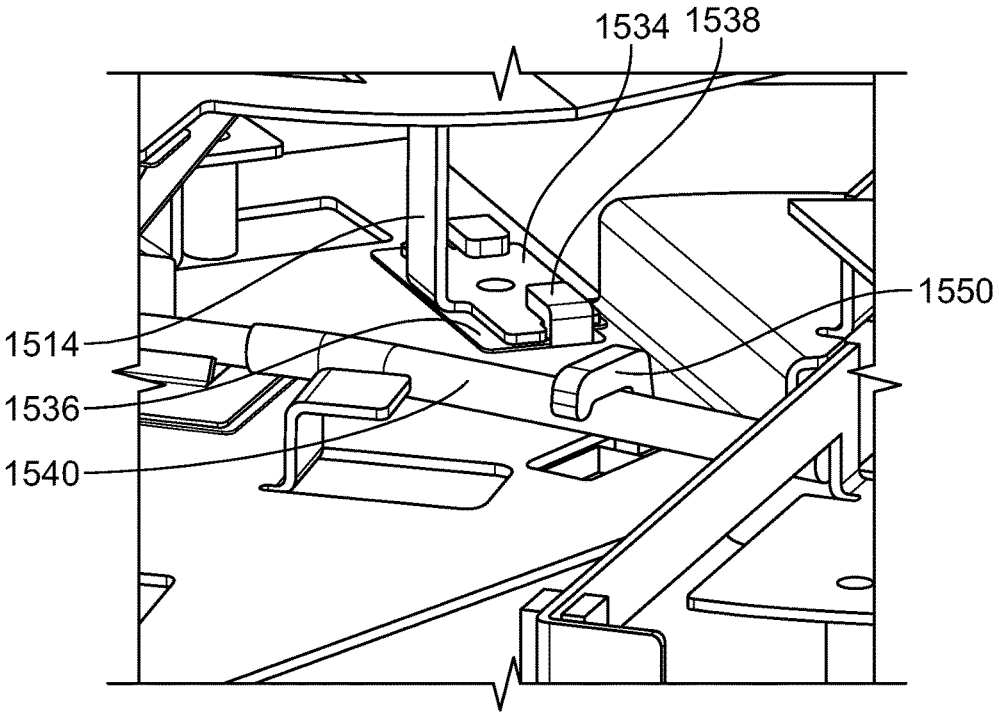
FIGS. 16 and 17 are enlarged perspective views of a portion of the exemplary antenna system of FIG. 15.
Figure 17:
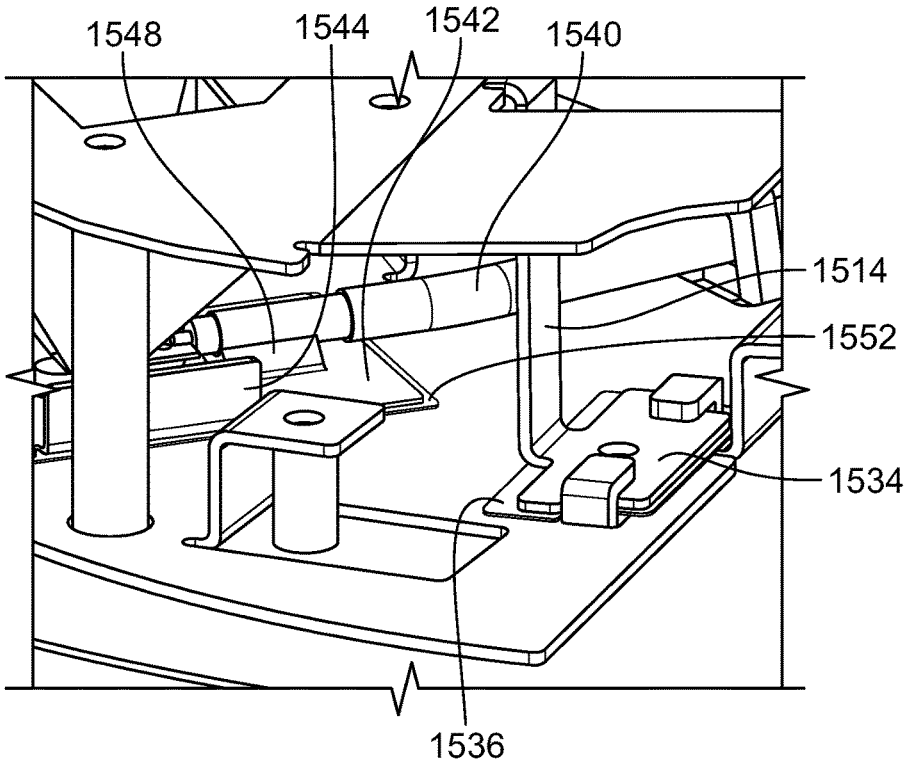
Figure 19:
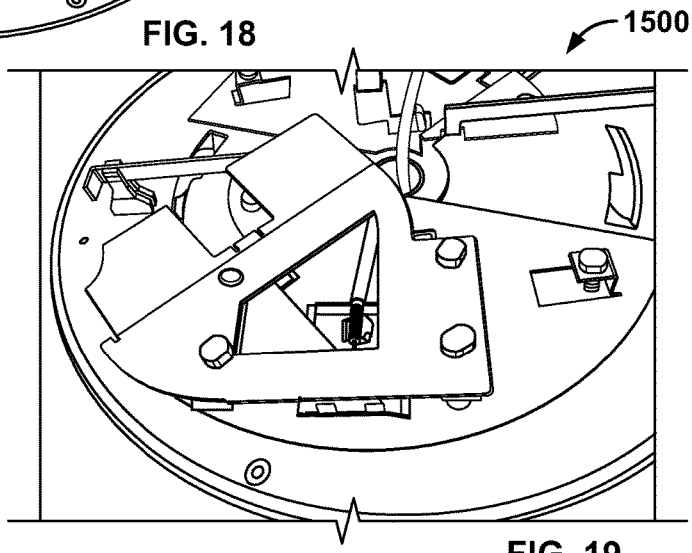
FIGS. 19 and 20 are enlarged perspective views of a portion of the exemplary prototype antenna system of FIG. 18.
Figure 20:
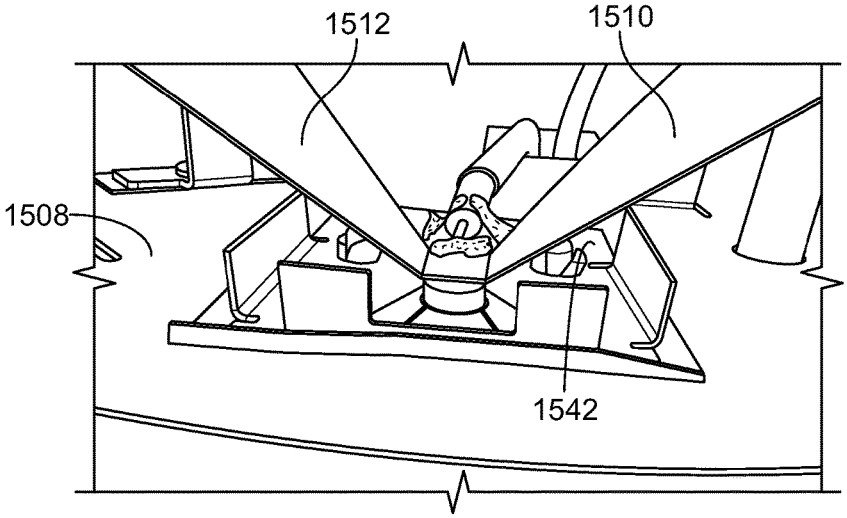

FIGS. 15-17 illustrate another exemplary embodiment of an antenna system or assembly 1500 embodying one or more aspects of the present disclosure. FIGS. 18-20 illustrate an example prototype of the antenna system 1500. As disclosed herein, the antenna system 1500 is configured to have low PIM, good bandwidth and isolation. The antenna system 1500 may be operable within a first frequency range of about 698 MHz to about 960 MHz and a second frequency range of about 1710 MHz to about 2700 MHz. Or, for example, the antenna system 1500 may be operable within a wide frequency range from about 698 MHz to about 2700 MHz. The antenna system 1500 may be referred to as a dual port antenna.

The antenna system 1500 includes two identical antennas 1502, 1504. Each antenna 1502, 1504 includes an upper radiating patch element 1506, a ground plane 1508 spaced apart from the upper radiating patch element 1506, dual feeding elements 1510, 1512 electrically coupling (e.g., via proximity coupling or direct galvanic coupling) the upper radiating patch element 102 to a feed point, and a shorting element 1514 electrically coupling (e.g., via proximity coupling or direct galvanic coupling) the radiating patch element 1506 to the ground plane 1508. The dual feeding elements 1510, 1512 of each antenna 1502, 1504 are substantially similar to the feeding elements 108, 110 of FIGS. 1 and 2. Additionally, each radiating patch element 1506 is positioned substantially in the center of its respective ground plane 1508 as explained above. Alternatively, each radiating patch element 1506 may be positioned in another suitable location (e.g., off-center, etc.) relative to its the respective ground plane 1508 if desired.

The ground plane 1508 includes a main portion 1516, an ancillary portion 1518 adjacent the main portion 1516, a stub 1520 extending from the ancillary portion 1518, and stamped recesses and portions 1541 extending from the main portion 1516. The main portion 1516 and the ancillary portion 1518 are both substantially sector shaped as explained above with reference to FIGS. 1 and 2. The added ancillary portion 1518 may improve the PIM performance of each antenna 1502, 1504 by increasing the area in which current may be distributed. The stamped recesses and portions 1541 may allow the ground plane 1508 to couple to a substrate (e.g., a base of a radome) via a snap pin or the like as explained above. The stub 1520 includes the same characteristics and features as explained above with reference with reference to FIGS. 1 and 2.

As shown in FIG. 15, the main portion 1516, the ancillary portion 1518, and the stub 1520 of the each ground plane 1508 are not co-planar. For example, the ancillary portion 1518 and the stub 1520 are in a plane elevated from a plane including the main portion 1516. Such elevation may prevent loading (and/or other undesirable effects) from a base plate or the like that is coupled to the ground plane 1508 as explained above. Additionally, the stub 1520 extends from the ancillary portion 1518 such that its main surface 1524 is in a plane perpendicular to the main portion 1516 and the ancillary portion 1518 of the ground plane 1508.

Additionally, the stub 1520 may include one or more portions which are not co-planar. For example, and as shown in FIGS. 15 and 16, the stub 1520 includes a portion 1526 extending substantially perpendicular from a main surface 1524 of the stub 1520. This feature may reduce the size (e.g., the surface area) of the ground plane 1508 and thus the size of the antennas as explained above.

In the exemplary embodiment of FIGS. 15-17, the radiating patch element 1506 includes a portion 1528 and another portion 1530 (sometimes referred to as a wing patch or a top patch) similar to the portions 126, 128 of radiating patch element 102 of FIGS. 1 and 2. For example, each wing patch 1530 extends in a slanted relationship relative to the portion 1528. But each wing patch 1530 does not widen, increase in width, or taper similar to the portion 128 explained above with reference to FIGS. 1 and 2. Additionally, the radiating patch element 1506 has an increased surface area as compared to the radiating patch element 102 of FIGS. 1 and 2. This increased surface area may improve the radiation patterns of the antennas 1502, 1504.

Each portion 1528 of the radiating patch element 1506 may be configured for forming multiple frequencies (e.g., frequencies from 698 MHz to 960 MHz and from 1710 MHz to 2700 MHz, frequencies from 698 MHz to 2700 MHz, etc.), for frequency tuning at the high band, etc. A slot 1532 may be configured such that its respective antenna 1502, 1504 has visual to the feed to ease soldering to the feed. Each slot 1532 is an absence of electrically-conductive material in the radiating patch element 1506. For example, the radiating patch element 1506 may be initially formed with the slot 1532, or the slot 1532 may be formed by removing electrically-conductive material from the radiating patch element 1506, such as etching, cutting, stamping, etc. In still yet other embodiments, the slot 1532 may be formed by an electrically nonconductive or dielectric material, which is added to the upper radiating patch element 1506 such as by printing, etc.

In this illustrated exemplary embodiment, the slot 1532 is generally trapezoidal and divides the radiating patch element 1506. Alternatively, the slot 1532 may have any other suitable shape, for example, round, a square, and/or a non-linear shape, etc., without departing from the scope of this disclosure.

The wing patch 1530 includes shorting leg portions which define one or more recesses. For example, and as explained above, one of the recesses may be formed by bending, deforming, etc. a portion of the wing patch 1530. This particular portion may be utilized as or define the shorting element 1514 as explained above. Another recess may be adjacent a corner of one of the leg portions. This recess may be formed by stamping and then removing a portion of the wing patch 1530.

The shorting element 1514 extends from the radiating patch element 1506 and couples to the ground plane 1508 via a tab 1534 and a dielectric member 1536 or the like (e.g., adhesive tape, etc.). As explained above, and as shown in FIGS. 15-17, the tab 1534 may be integrally formed with the shorting element 1514. In other exemplary embodiments, the tab 1534 may be separately formed.

The tab 1534 is coupled to, in contact with, etc. the dielectric member 1536 such that the shorting element 1514 is proximity coupled to the ground plane 1508. For example, each tab 1534 of FIGS. 15-17 is secured to its respective dielectric member 1536 via plastic clips 1538 (sometimes referred to as a plastic catch).

As shown in FIGS. 15 and 17, each antenna 1502, 1504 includes a cable bracket 1542 for assisting in coupling (e.g., soldering, etc.) a cable feed 1540 to the dual feeding elements 1510, 1512 and the ground plane 1508. The cable bracket 1542 may be formed of brass (e.g., if the ground plane 1508 is formed of aluminum, etc.) or another suitable material including, for example, a non-ferromagnetic material.

The cable bracket 1542 may be coupled to the ground plane 1508 via fasteners. For example, one or more plastic rivets, etc. may be employed to couple the cable bracket 1542 to the ground plane 1508.

The cable bracket 1542 may be electrically insulated from the ground plane 1508 as explained above. For example, a dielectric member 1552 or the like may be positioned between the cable bracket 1542 and the ground plane 1508. Thus, the cable bracket 1542 and the ground plane 1508 are separate components. Alternatively, the cable bracket 1542 can be integrally formed, incorporated into, etc. the ground plane 1508 (e.g., similar to the feature 142 of FIGS. 1 and 2).

In this exemplary embodiment, the cable bracket 1542 includes multiple integrally formed (e.g., stamped and bent tabs, etc.) features. For example, the cable bracket 1542 includes feature 1548 for soldering a cable braid of the cable feed 1540 as explained above with reference to FIGS. 1 and 2. As such, two soldering points are needed for this example and therefore a low PIM design may be realized. Additionally, the cable bracket 1542 includes multiple parasitic tabs 1544 for impedance matching (e.g., for the high band). One of the parasitic tabs 1544 may define a slot or a recess 1546 to provide access for tools (e.g., a solder iron, etc.). Although the cable bracket 1542 of FIGS. 15-17 includes three parasitic tabs 1544, more or less parasitic tabs may be employed.

Additionally, and as generally shown in FIGS. 15-17, the cable feed 1540 traversing from, e.g., a base of a radome to the cable bracket 1542 is substantially straight. Such a feature may be accomplished by the orientation and alignment of the cable bracket 1542 and one or more clips 1550. The cable straightness to the center helps to ensure low PIM performance. For example, if the cable is bent and routed more than a certain angle, the PIM level will increase substantially.

One or more components of each antenna 1502, 1504 may be integrally formed from a single piece of material. For example, and as shown in FIGS. 15-17, portions of the ground plane 1508 may be stamped and bent in a desirable direction to form the above described features (e.g., the of the ancillary portion 1518, the stub 1520, and the stamped recesses and portions 1541, etc.) of the ground plane 1508. Alternatively, such features and/or other features of the ground plane 1508 may be formed separately.

FIGS. 21*a-d* provide analysis results measured for the prototype of the antenna system 1500 shown in FIGS. 18-20. These analysis results shown in FIG. 21 are provided only for purposes of illustration and not for purposes of limitation.

Figure 21A:
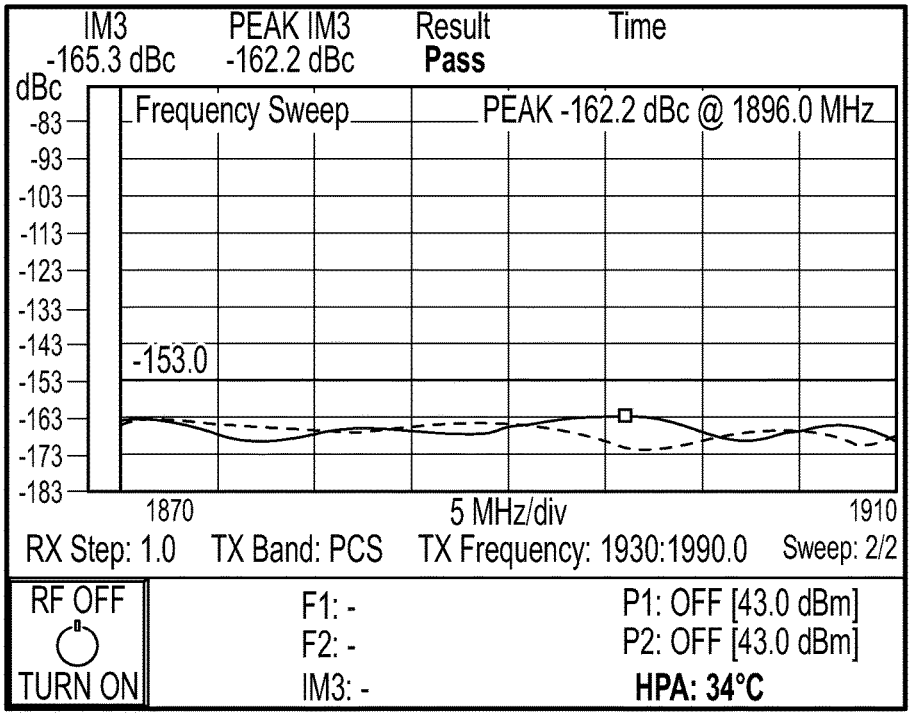
Figure 21B:
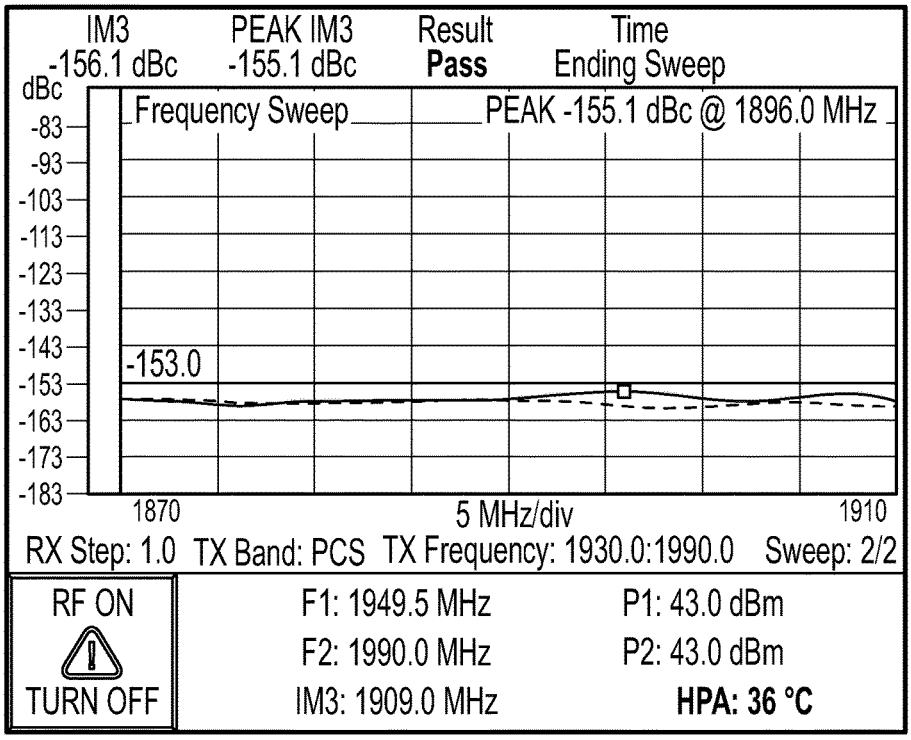
Figure 21C:
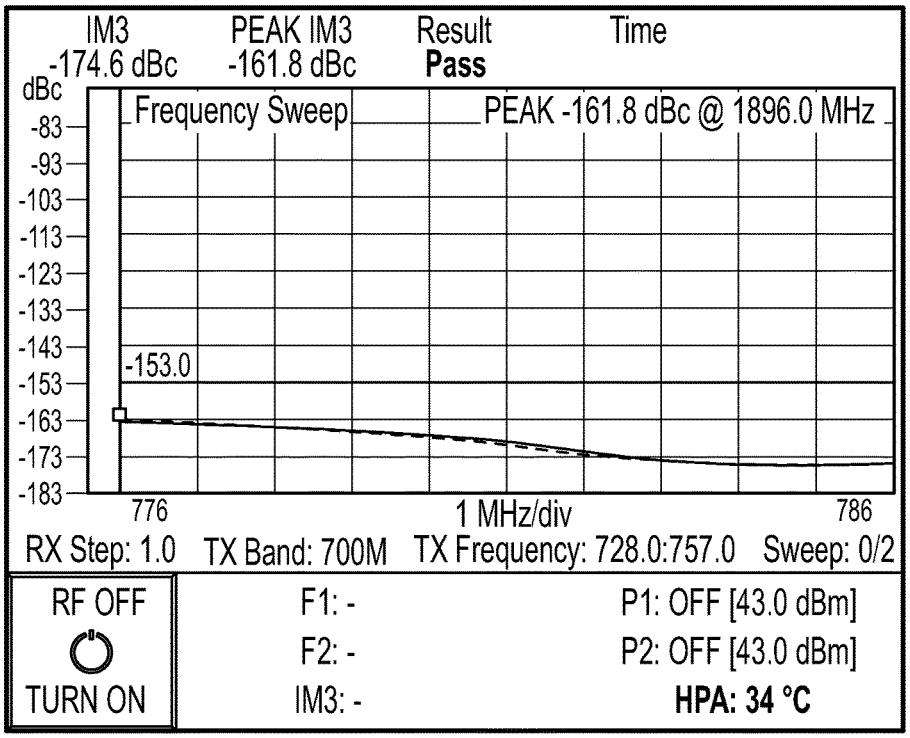
Figure 21D:
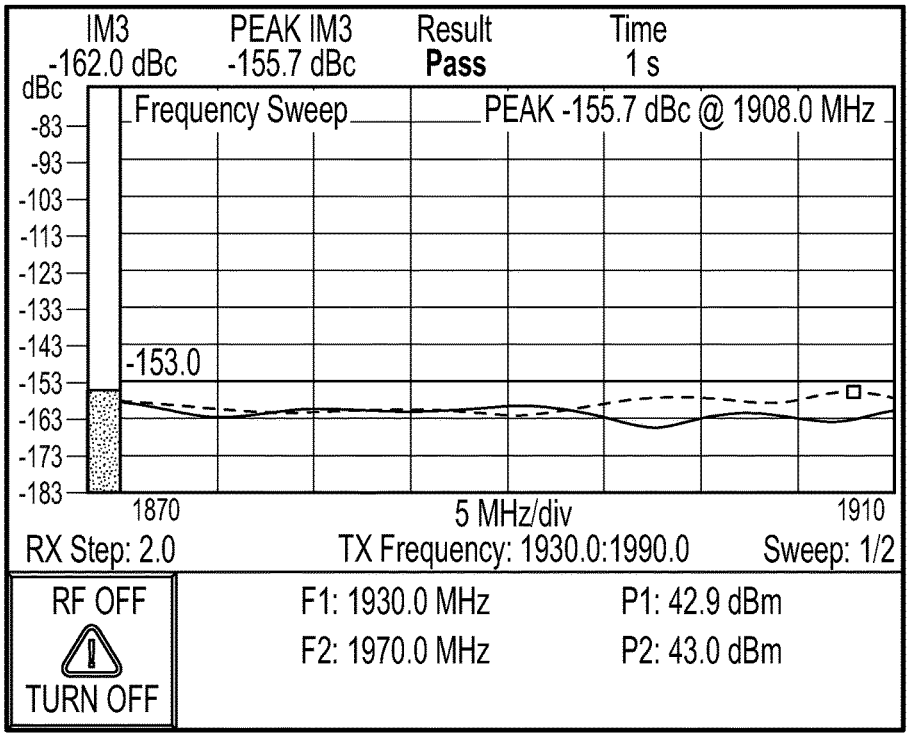

More specifically, FIGS. 21*a* and 21*b* are exemplary line graphs of passive intermodulation (PIM) versus frequency in MHz measured for port 1. Similarly, FIGS. 21*c* and 21*d* are exemplary line graphs of PIM versus frequency in MHz measured for port 2. As shown, the antenna system 1500 has low PIM performance (e.g., less than −153 dBc, etc.) at both a low band (FIGS. 21*a* and 21*c*) and a high band (FIGS. 21*b* and 21*d*). For example, the antenna system 1500 may preferably have a low PIM of −153 dBc or less at low and high bands.

FIGS. 22-31 illustrate yet another exemplary embodiment of an antenna system or assembly 2200 embodying one or more aspects of the present disclosure. FIG. 32 illustrates an example prototype of the antenna system 2200. As disclosed herein, the antenna system 2200 is configured to have low PIM, good bandwidth and isolation, and be operable within one or more frequency ranges. For example, the antenna system 2200 may be operable within a first frequency range of about 698 MHz to about 960 MHz and a second frequency range of about 1710 MHz to about 2700 MHz. Or, for example, the antenna system 2200 may be operable within a wide frequency range from about 698 MHz to about 2700 MHz. The antenna system 2200 may be referred to as a dual port antenna.

The antenna system 2200 includes two identical antennas 2202, 2204 similar to the antennas 1502, 1504 of the antenna system 1500 of FIGS. 15-20. For example, and shown in FIG. 22, each antenna 2202, 2204 includes a ground plane 2208 having the main portion 1516 and the ancillary portion 1518 (as also shown in FIG. 15) as well as a stub 2210 extending the ancillary portion 1518. Similar to the stub 1520 of FIG. 15, the stub 2210 of FIG. 22 includes a portion 2212 extending substantially perpendicular from a main surface of the stub 2210.

Additionally, and as shown in FIG. 22, each antenna 2202, 2204 includes a radiating patch element 2206 having the portion 1528 (as also shown in FIG. 15) and another portion 2216 (sometimes referred to as a wing patch or a top patch). The portion 2216 is similar to the wing patch 1530 of FIG. 15.

Further, each ground plane 2208 also includes stamped recesses and portions (e.g., stamped recesses and portions 2220) similar to the stamped recesses and portions 1541 of FIG. 15. As shown in FIG. 22, the portion 2220 extends upwardly away from the main portion 1516 (e.g., perpendicular to the main portion 1516) and then is angled to extend in a plane parallel to the main portion 1516.

FIG. 33 illustrate another exemplary embodiment of an antenna system or assembly 3600 embodying one or more aspects of the present disclosure. The antenna system 3600 includes the radome 300 of FIG. 3 for housing the antenna system 2200 of FIGS. 22-31.

FIG. 34 illustrates the antenna system 1500 or 2200 and an example radiation pattern (Farfield Realized Gain Abs (Theta=90)) for the antenna system 2200. As shown in the example radiation pattern, the stamped recesses and portions (also referred to as ground flaps) improve the radiation pattern. In particular, the stamped recesses and portions improve the radiation pattern from about 150 degrees to about 180 degrees.

FIGS. 35-38 provide analysis results for a simulated design of the antenna assembly 2200 shown in FIGS. 22-31. These analysis results shown in FIGS. 35-38 are provided only for purposes of illustration and not for purposes of limitation.

More specifically, FIG. 35 is an exemplary line graph illustrating simulated return loss (represented by line 3802) and isolation (represented by line 3804) between the antennas 2202, 2204 in decibels (dB) versus frequency in gigahertz (GHz) for the antenna assembly 2200. As shown, the antenna assembly 2200 is operable with relatively good/acceptable return loss and bandwidths as well as good/acceptable isolation between the antennas 2202, 2204 for LTE/4G bands (e.g. from about 698 MHz to about 2700

MHz). For example, isolation of the antenna system 2200 meets a 15 dB spec with the low band edge having isolation of better than 20 dB.

FIG. 36 is an exemplary line graph illustrating measured return loss for two ports and isolation between the antennas 2202, 2204 in decibels (dB) versus frequency in gigahertz (GHz) for the antenna assembly 2200.

FIG. 37 illustrates various measured radiation patterns for the antenna assembly 2200. More specifically, FIG. 37 illustrates radiation patterns (port 1, port 2) for the azimuth plane (on the left), the Phi 0° plane (in the middle), and the Phi 90° plane (on the right) at frequencies of 698 MHz, 725 MHz, 824 MHz, 880 MHz, 894 MHz, 960 MHz, 1710 MHz, 1730 MHz, 1850 MHz, 1930 MHz, 2130 MHz, 2170 MHz, 2310 MHz, and 2600 MHz.

Figure 38A:
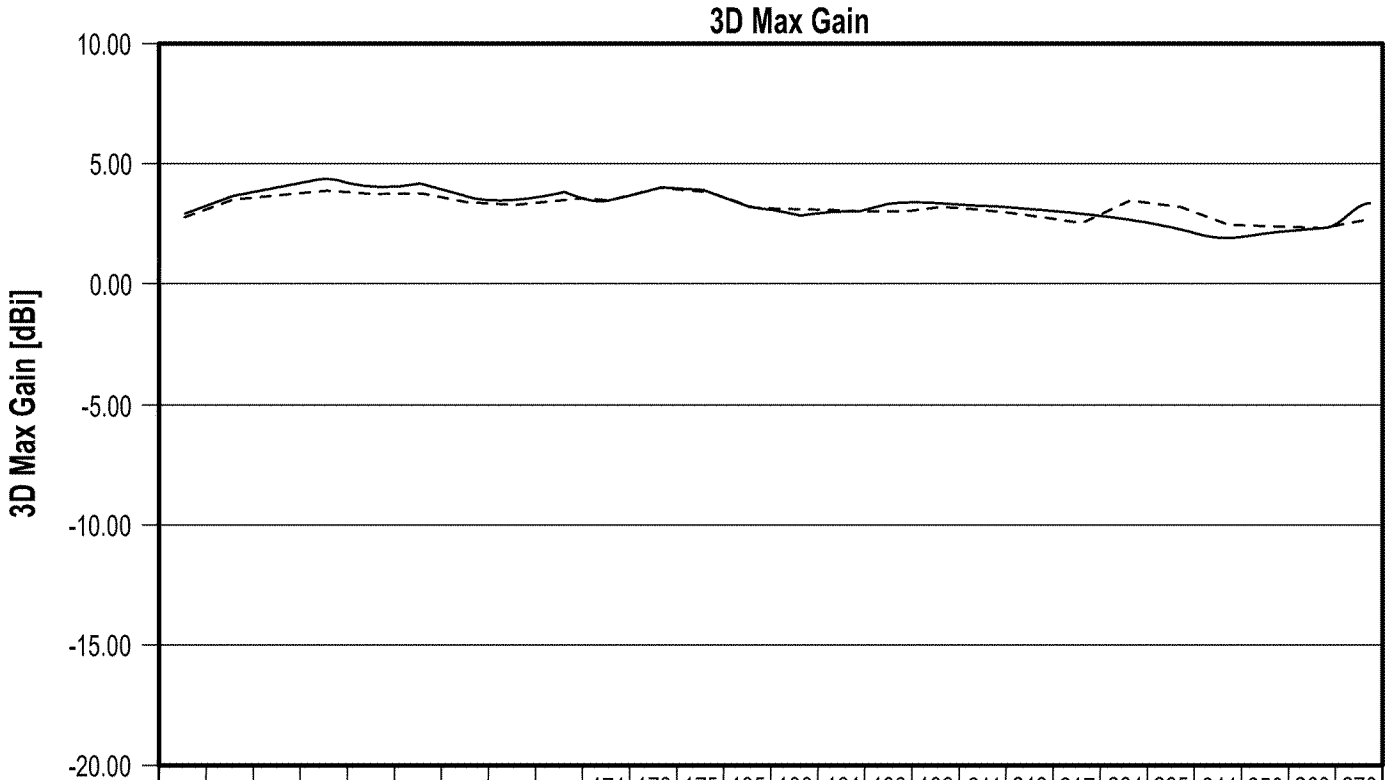
Figure 38B:
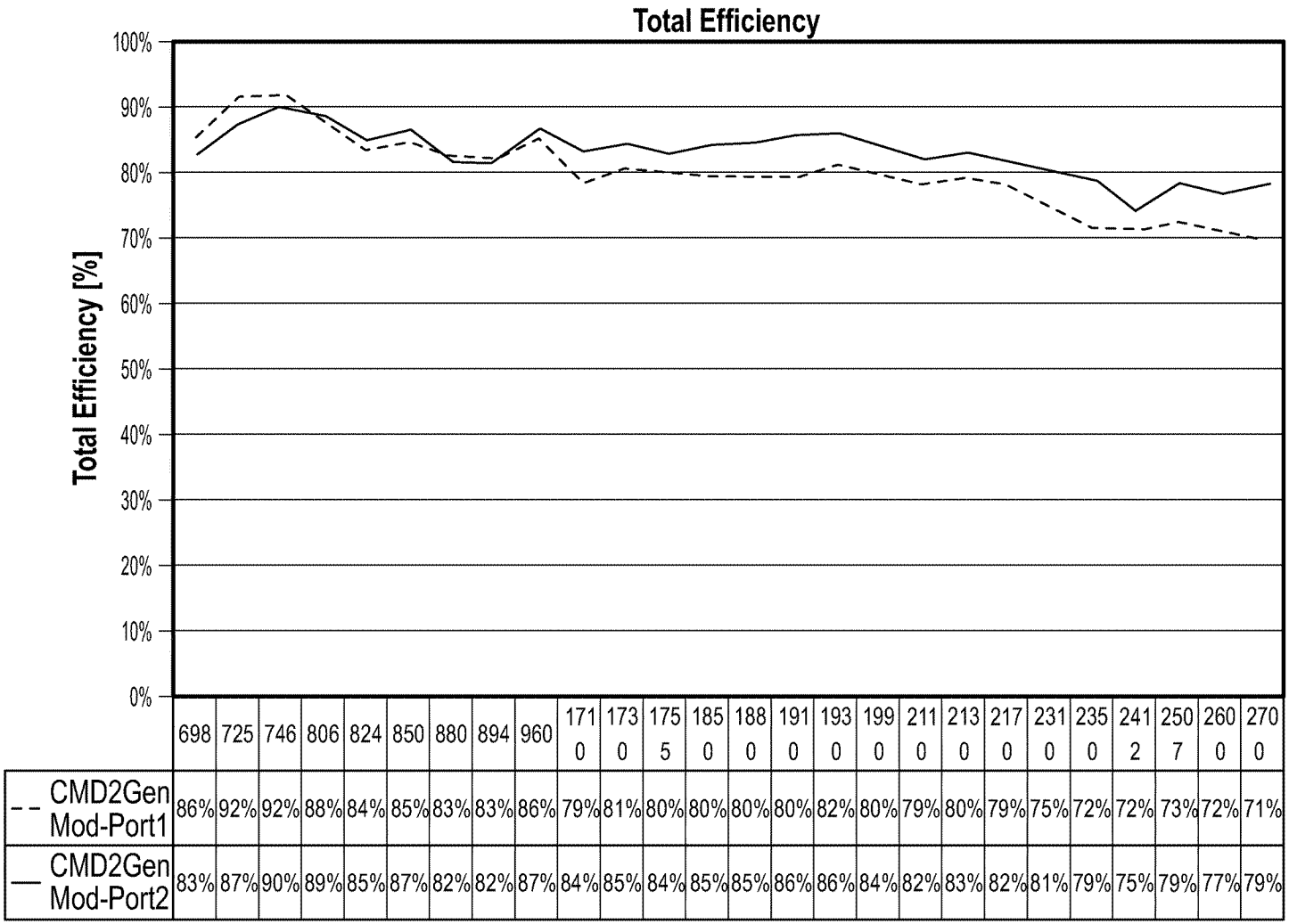
Figure 38C:
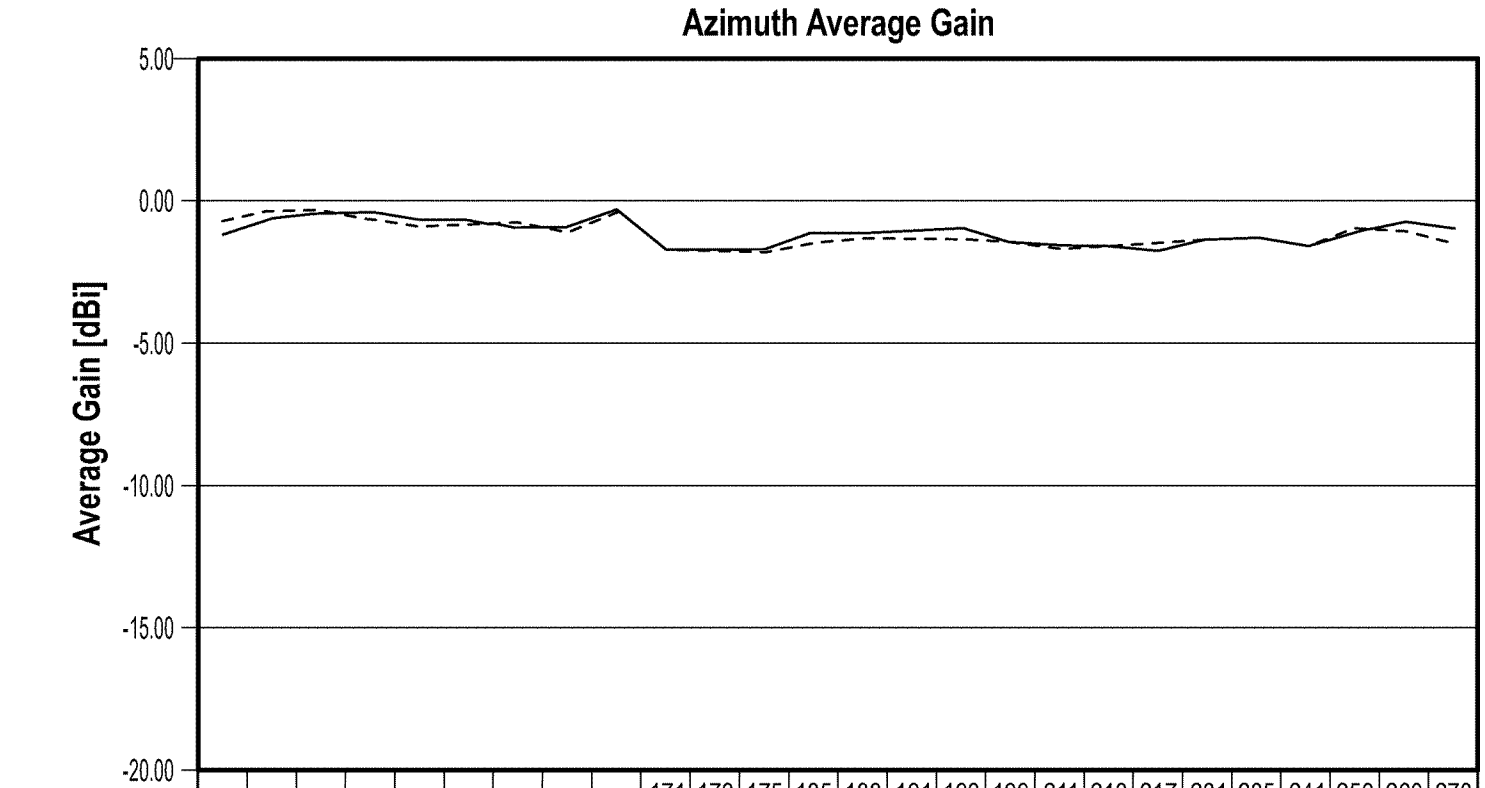
Figure 38D:
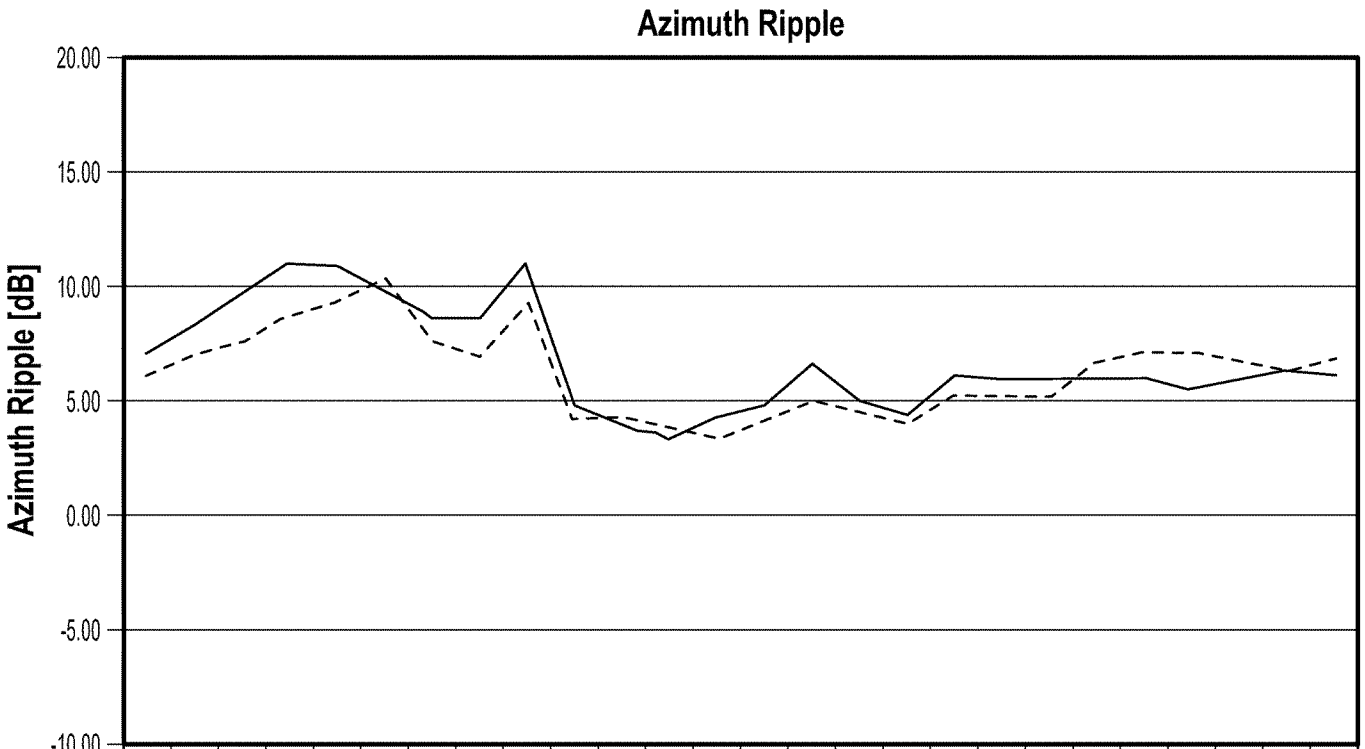

FIGS. 38*a* through 38*d* are exemplary line graphs illustrating measured 3D max gain, total efficiency, Azimuth gain, and Azimuth ripple for the antenna assembly 2200. More specifically, FIG. 38*a* illustrates the 3D max gain (dB) of each antenna 2202, 2204 versus frequency. FIG. 38*b* illustrates the total efficiency of each antenna 2202, 2204 versus frequency. FIG. 38*c* illustrates the Azimuth gain of each antenna 2202, 2204 versus frequency. FIG. 38*d* illustrates the Azimuth ripple of each antenna 2202, 2204 versus frequency.

FIGS. 39-43 illustrate another exemplary embodiment of an antenna system or assembly 4200 embodying one or more aspects of the present disclosure. As disclosed herein, the antenna system 4200 is configured to have low PIM, good bandwidth and isolation, and be operable within one or more frequency bands. For example, the antenna system 4200 may be operable within a first frequency range of about 698 MHz to about 960 MHz and a second frequency range of about 1710 MHz to about 2700 MHz. Or, for example, the antenna system 4200 may be operable within a wide frequency range from about 698 MHz to about 2700 MHz. The antenna system 4200 may be referred to as a four port antenna.

The antenna system 4200 includes a ground plane 4202 and four identical antennas 4204. Each antenna 4204 includes an upper radiating patch element 4206 spaced apart from the ground plane 4202, two feeding elements 4208, 4210 electrically coupling (e.g., via proximity coupling or direct galvanic coupling) the upper radiating patch element 4206 to a feed point, and a shorting element 4212 electrically coupling (e.g., via proximity coupling or direct galvanic coupling) the upper radiating patch element 4206 to the ground plane 4202. The dual feeding elements 4208, 4210 of each antenna 4204 are substantially similar to the feeding elements 108, 110 of FIGS. 1 and 2.

In this exemplary embodiment, the ground plane 4202 is substantially circular and defines an edge (e.g., the circumference of the circular ground plane). As shown in FIGS. 39 and 40, each antenna 4204 is positioned adjacent the edge of the ground plane 4202. This may improve the omnidirectional radiation characteristics of the antenna system 4200. For example, positioning each antenna 4204 adjacent the edge of the ground plane 4202 may improve omnidirectional radiation characteristics at the high band, provide desirable impedance matching of the low band, etc.

Each radiating patch element 4206 may be coupled to its respective feeding elements 4208, 4210 via a dielectric member 4228 (see, e.g., FIG. 41) or the like (e.g., adhesive tape, etc.) such that the feeding elements 4208, 4210 are proximity coupled to the radiating patch element 4206. Alternatively, each radiating patch element 4206 may have direct galvanic contact with its respective feeding elements 4208, 4210.

Each radiating patch element 4206 includes a portion 4214 and another portion 4216 (sometimes referred to as a wing patch or a top patch) similar to the portions 126, 128 of radiating patch element 102 of FIGS. 1 and 2. For example, each wing patch 4216 extends in a slanted relationship relative to the portion 4214 and therefore the wing patch 4216 and the portion 4214 are not co-planar. Additionally, the wing patch 4216 tapers in a similar manner as the portion 128 explained above. Alternatively, the radiating patch element 4206 may not include a slanted portion (e.g., substantially flat) and/or tapered portions if desired.

The wing patch 4216 includes shorting leg portions, which define a recess. For example, and as explained above, this recess may be formed by bending, deforming, etc. a portion of the wing patch 4216. This particular portion may be utilized as or define the shorting element 4212 as explained above.

The shorting element 4212 extends from the radiating patch element 4206 and couples to the ground plane 4202 via a tab 4218. In this exemplary embodiment, the tab 4218 is coupled to, in contact with, etc. a dielectric member 4220 (see, e.g., FIG. 41) or the like (e.g., adhesive tape, etc.) such that the shorting element 4212 is proximity coupled to the ground plane 4202. The tab 4218 may be integrally formed with the shorting element 4212 as explained above or separately formed. Alternatively, each shorting element 4212 may have direct galvanic contact with the ground plane 4202.

As shown best in FIG. 42, the ground plane 4202 includes one or more flaps 4222 (sometimes referred to as a ground flap) extending therefrom. The flaps 4222 may assist in impedance matching, introduce capacitance to the feeding elements 4208, 4210, etc. as explained above.

Similar to the ground plane 104 of FIGS. 1 and 2, the ground plane 4202 of FIGS. 39-43 includes an integrally formed (e.g., stamped and bent tabs, etc.) feature 4224 for soldering a cable braid of a cable feed 4226. This feature provides minimum (or at least reduced) direct galvanic contact surface between the cable braid and the ground plane 4202 as explained above.

In the exemplary embodiment of FIGS. 39 and 40, the antenna system 4200 includes one or more isolators adjacent at least two of the antennas 4204 for isolating those antennas 4204. Thus, the one or more isolators may decrease the likelihood of mutual coupling between the antennas 4204.

The antenna system 4200 of FIGS. 39 and 40 includes a T-isolator 4230 positioned between each pair of adjacent antennas 4204. The T-isolators 4230 of FIGS. 39 and 40 may be supported by two plastic posts 4234 or another suitable structure and/or material.

Each T-isolator 4230 of FIGS. 39 and 40 is integrally formed (e.g., stamped and bent, etc.) with the ground plane 4202. For example, each T-isolator 4230 may be stamped and bent upward to form the isolator. In such examples, the ground plane 4202 defines a recess 4232 corresponding to each T-isolator 4230. Alternatively, the T-isolators 4230 may be formed separately.

In other exemplary embodiments, the isolators adjacent at least two of the antennas 4204 may include one or more alternate isolators in addition to or in alternative to the T-isolator 4230 of FIGS. 39 and 40. For example, FIG. 44 illustrates an exemplary embodiment of an antenna system including the antennas 4204 and an isolator patch 4702 defining slots. Additionally, FIG. 45 illustrates another exemplary embodiment of an antenna system including the antennas 4204 and three isolator goal posts 4802. The isolators 4802 are shaped similarly to soccer goal posts having two vertical shorter side portions and a horizontal longer top portion perpendicular to and extending between the two shorter sides.

Referring back to FIGS. 39-43, one or more components of the antenna system 4200 may be integrally formed from a single piece of material as explained above. For example, such components may be stamped and bent in a desirable direction to form the above described features. Alternatively, any one or more components may be formed separately and joined together via one or more suitable fasteners including, for example, plastic rivets, nylon screws/nuts, etc.

FIGS. 46-49 provide analysis results measured for a computer simulated design of the antenna system 4200 shown in FIGS. 39-43. These analysis results shown in FIGS. 46-59 are provided only for purposes of illustration and not for purposes of limitation.

Figure 46A:
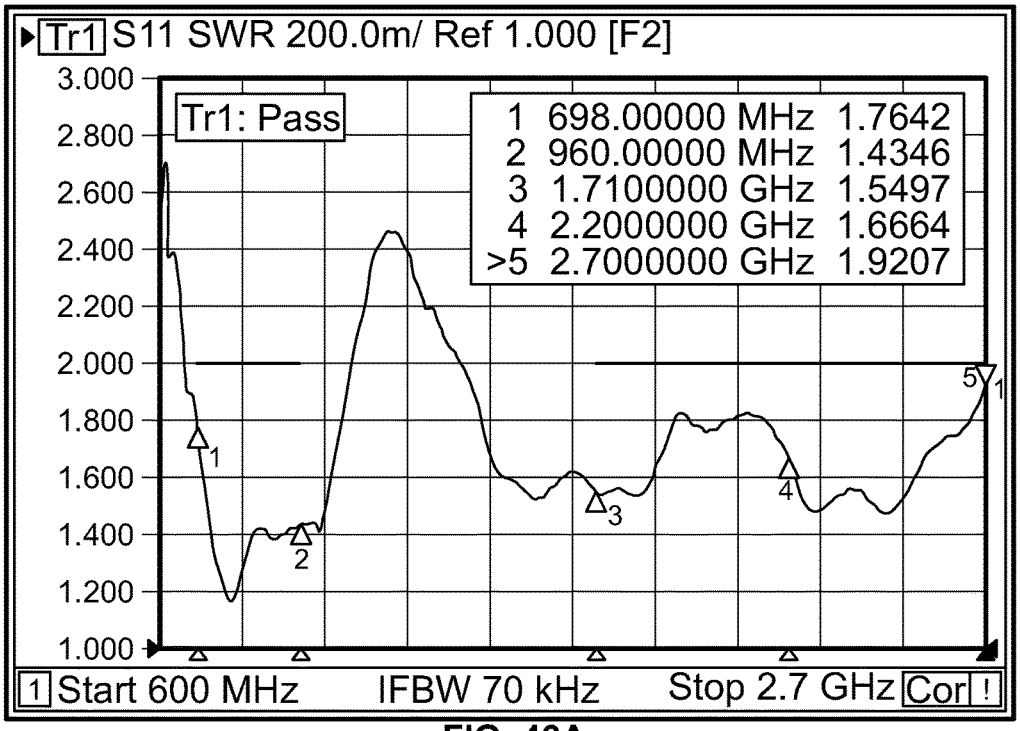
Figure 46B:
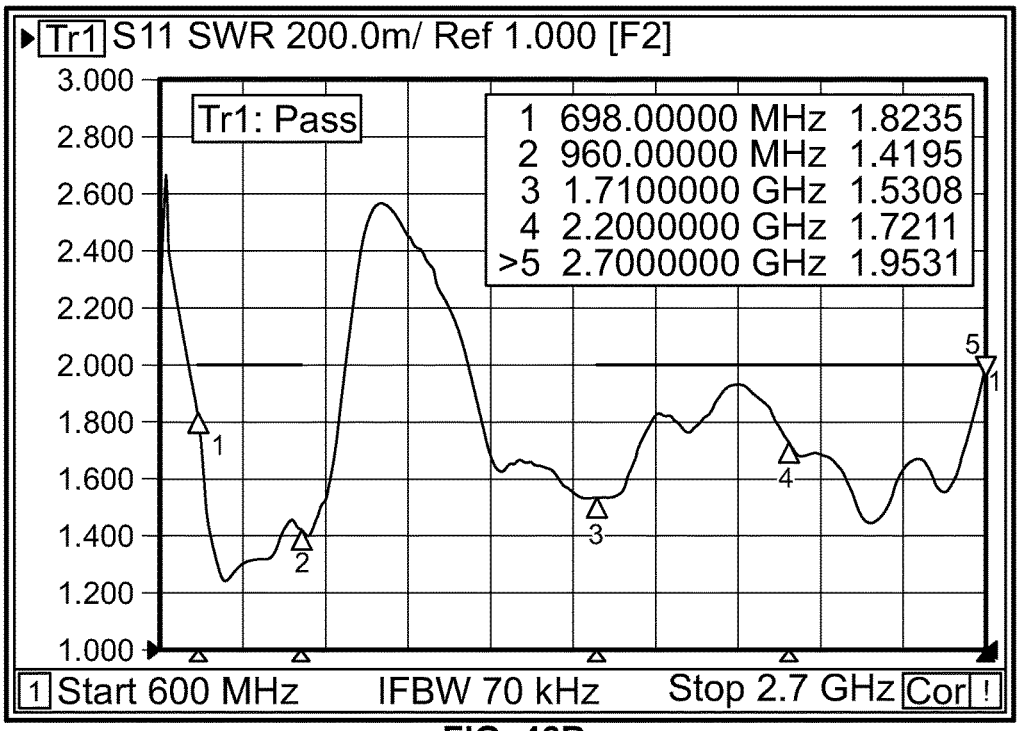
Figure 46C:
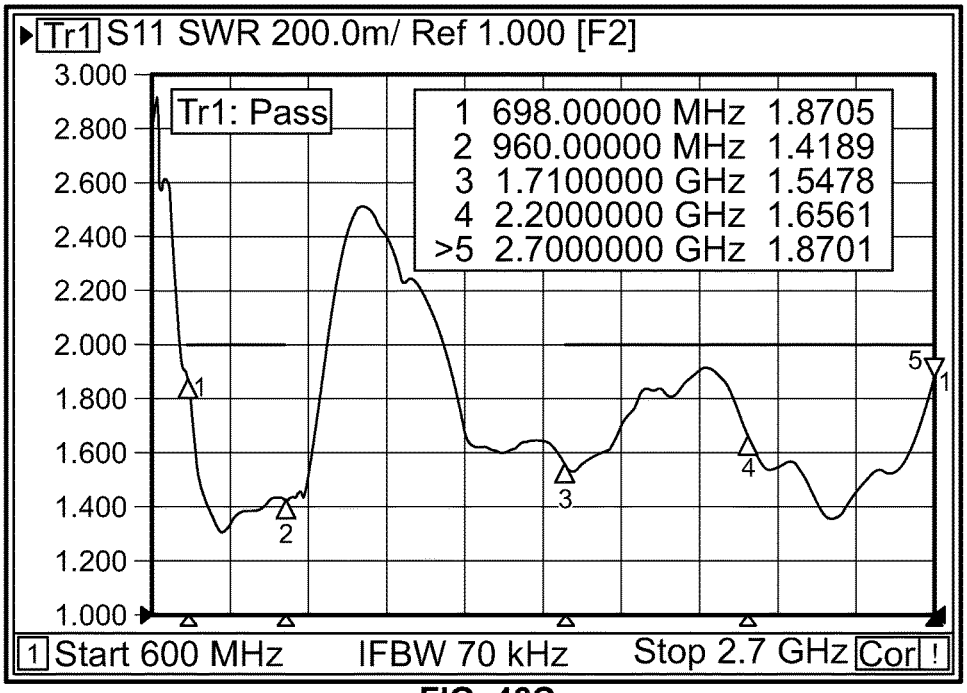
Figure 46D:
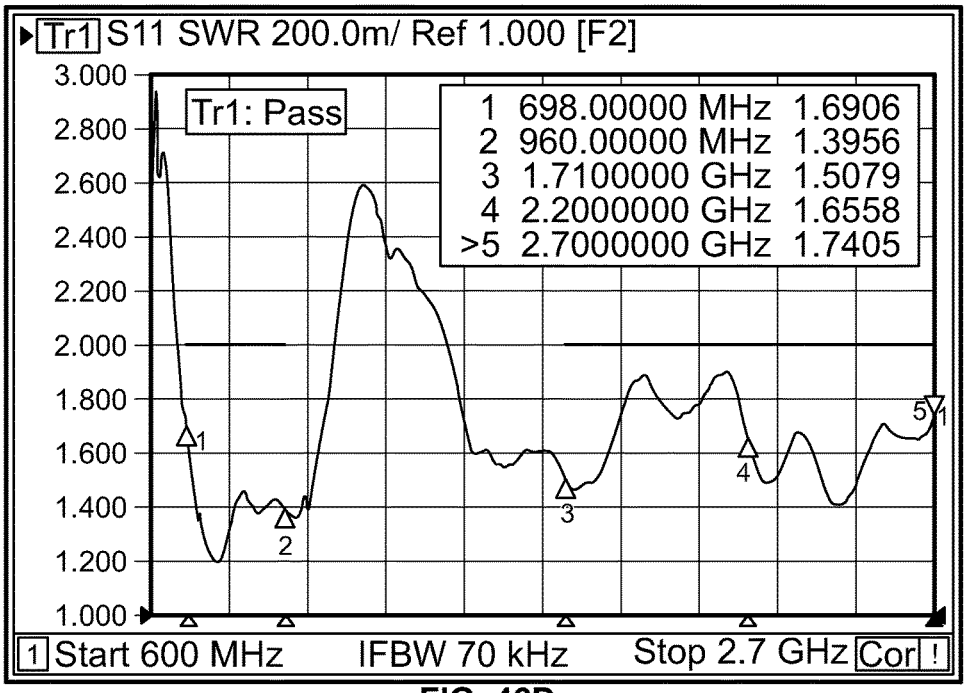

More specifically, FIGS. 46*a* through 46*d* are exemplary line graphs illustrating VSWR versus frequency measured for port 1 (FIG. 46*a*), port 2 (FIG. 46*b*), port 3 (FIG. 46*c*), and port 4 (FIG. 46*d*). The VSWR is provided for the low frequency band (about 698 MHz to about 960 MHz) and the high frequency band (about 1710 MHz to about 2700 MHz).

Figure 47A:
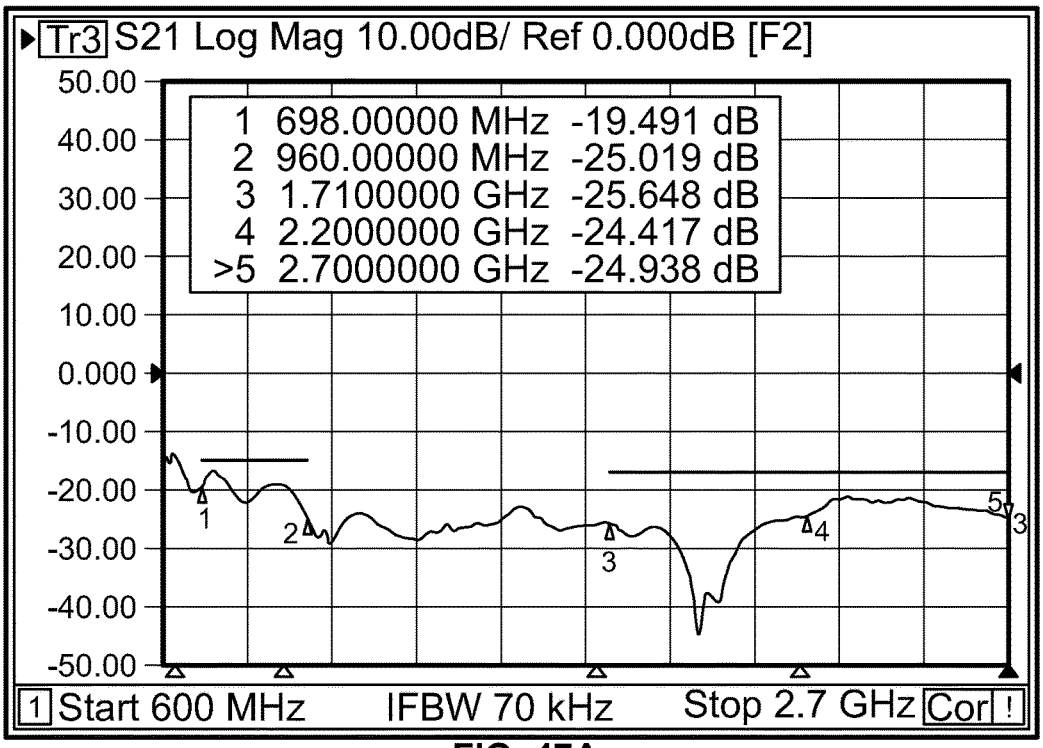
Figure 47B:
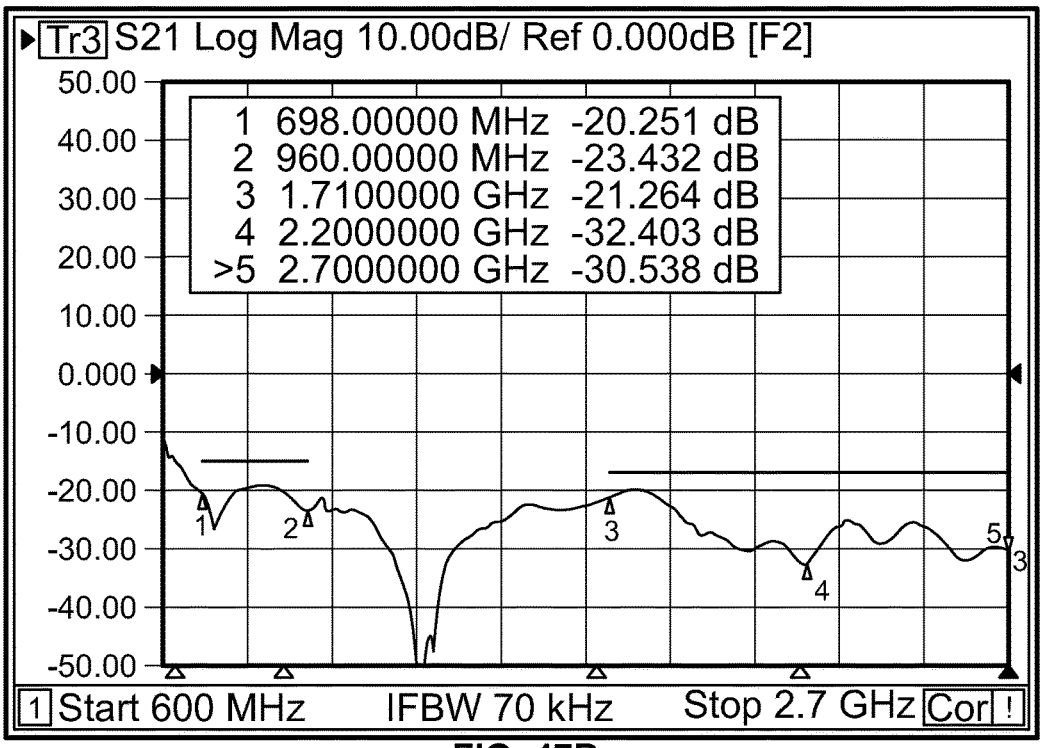
Figure 47C:
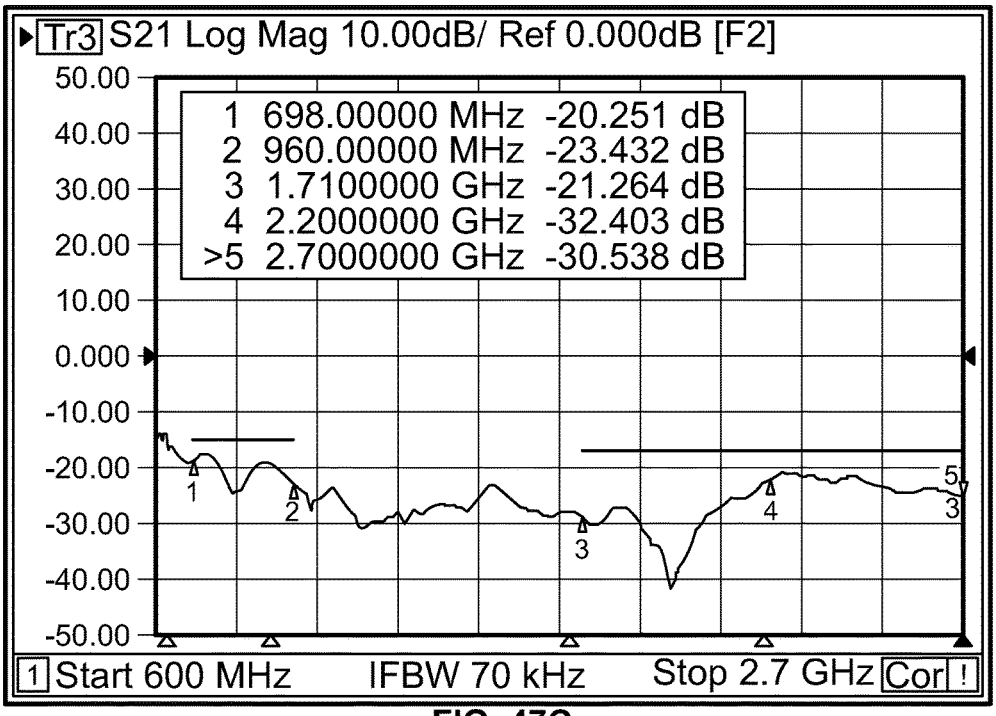
Figure 47D:
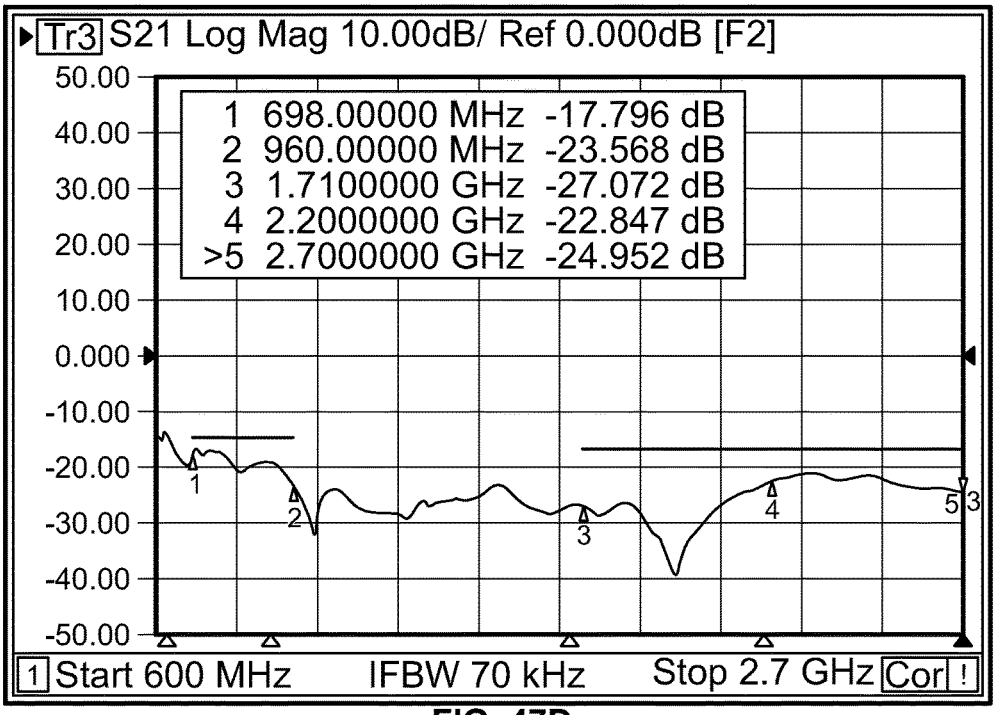
Figure 47E:
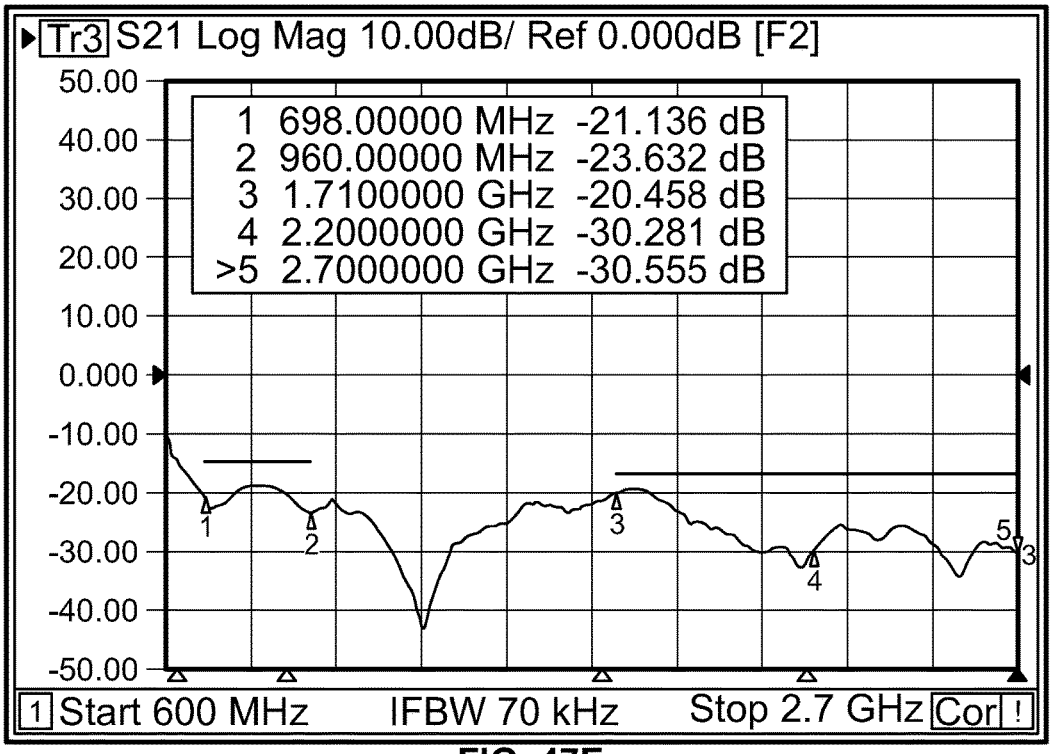
Figure 47F:
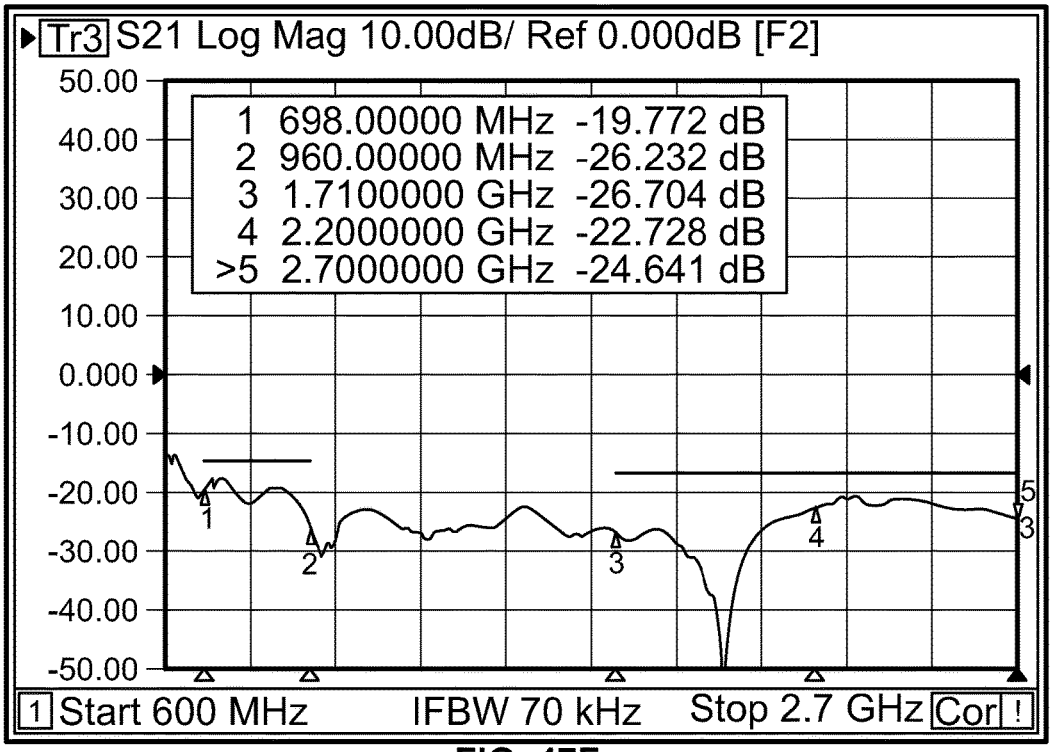

FIGS. 47*a* through 47*f* are exemplary line graphs illustrating isolation versus frequency measured between the multiple ports for the low frequency band (about 698 MHz to about 960 MHz) and the high frequency band (about 1710 MHz to about 2700 MHz). For example, FIG. 47*a* illustrates isolation between port 1 and port 2, FIG. 47*b* illustrates isolation between port 1 and port 3, FIG. 47*c* illustrates isolation between port 1 and port 4, FIG. 47*d* illustrates isolation between port 2 and port 3, FIG. 47*e* illustrates isolation between port 2 and port 4, and FIG. 47*f* illustrates isolation between port 3 and port 4.

FIGS. 48*a* through 48*h* are exemplary line graphs of PIM versus frequency in MHz measured for each of the four ports. Specifically, FIG. 48*a* shows a peak PIM of −156 dBc at 776 MHz for port 1 and FIG. 48*b* shows a peak PIM of −164 dBc at 1910 MHz for port 1. FIG. 48*c* shows a peak PIM of −154.8 dBc at 776 MHz for port 2 and FIGS. 48*d* shows a peak PIM of −162.5 dBc at 1896 MHz for port 2. FIG. 48*e* shows a peak PIM of −159.6 dBc at 776 MHz for port 3 and FIGS. 48*f* shows a peak PIM of −164.6 dBc at 1898 MHz for port 3. FIG. 48*g* shows a peak PIM of −159.9 dBc at 786 MHz for port 4 and FIG. 48*h* shows a peak PIM of −166.4 dBc at 1902 MHz for port 4.

FIG. 49 illustrates various measured radiation patterns for port 1, port 2, port 3 and port 4 of the antenna system 4200. FIG. 49 illustrates azimuth plane patterns (on the left) and elevation 0° plane patterns at frequencies of 698 MHz, 824 MHz, 960 MHz, 1710 MHz, 1880 MHz, 2110 MHz, 2305 MHz, 2412 MHz, and 2700 MHz.

The antenna systems disclosed herein including the radiating patch elements, the ground planes, feeding elements, the shorting elements, etc., may be any suitable size (e.g., height, diameter, etc.). The size of each component of an antenna system may be determined based on particular specifications, desired results, etc. For example, the height of the feeding elements disclosed herein may be determined so that an impedance match in the high band may be substantially achieved. Also, for example, if an antenna system disclosed herein includes a dual port antenna, the diameter of the antenna system may be about 300 millimeters (mm), less than 300 mm, more than 300 mm, etc. In other exemplary embodiments, an antenna system may have a diameter of about 250 mm or less. In some exemplary embodiments, an antenna system may have a diameter of about 230 mm (e.g., an approximate diameter encircling one or more ground planes, etc.) and a height of about 35 mm (e.g., the distance from a ground plane to a radiating patch element, etc.).

Additionally, the shape of each component of the antenna systems may be any suitable shape. For example, the radiating patch elements, feeding elements, shorting elements, etc. may be square, oval, pentagonal, etc. depending on manufacturability of a shape, cost effectiveness, particular specifications, desired results, etc.

By employing one or more of the features disclosed herein, an antenna and/or antenna system including one or more antennas may provide or include one or more (but not necessarily any or all) of the following advantages or benefits. For example, an antennas and/or antenna system may have a low profile, a broad bandwidth, sufficient isolation between ports (if two or more ports are employed), multiple antennas in a reasonable (e.g., smaller, etc.) footprint, desirable omnidirectional characteristics compared to the height of the antennas, etc. Additionally, an antenna and/or antenna system disclosed herein may have a low PIM due in part to having less (e.g., two, etc.) points of galvanic contact for each radiator. Further, an antennas and/or antenna system may provide design flexibly and allow for a modular concept to be implemented. An exemplary modular concept or design disclosed herein may allow an antenna (e.g., antenna 100, etc.) to be reused for a single port, dual port, triple port, quadruple port, etc. during development stage to final product.

Further, although the antenna systems disclosed herein are shown to include one antenna, two antennas, or four antennas, any number of antennas may be employed without departing from the present disclosure. For example, an antenna system may include three antennas, five or more antennas, etc.

Exemplary embodiments of the antenna systems disclosed herein may be suitable for a wide range of applications, e.g., that use more than one antenna, such as LTE/4G applications and/or infrastructure antenna systems (e.g., customer premises equipment (CPE), terminal stations, central stations, in-building antenna systems, etc.). An antenna system disclosed herein may be configured for use as an omnidirectional MIMO antenna, although aspects of the present disclosure are not limited solely to omnidirectional and/or MIMO antennas. An antenna system disclosed herein may be implemented inside an electronic device, such as machine to machine, vehicular, in-building unit, etc. In which case, the internal antenna components would typically be internal to and covered by the electronic device housing. As another example, the antenna system may instead be housed within a radome, which may have a low profile. In this latter case, the internal antenna components would be housed within and covered by the radome. Accordingly, the antenna systems disclosed herein should not be limited to any one particular end use.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms, and that neither should be construed to limit the scope of the disclosure. In some example embodiments, well-known processes, well-known device structures, and well-known technologies are not described in detail. In addition, advantages and improvements that may be achieved with one or more exemplary embodiments of the present disclosure are provided for purpose of illustration only and do not limit the scope of the present disclosure, as exemplary embodiments disclosed herein may provide all or none of the above mentioned advantages and improvements and still fall within the scope of the present disclosure.

Specific numerical dimensions and values, specific materials, and/or specific shapes disclosed herein are example in nature and do not limit the scope of the present disclosure. The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter (i.e., the disclosure of a first value and a second value for a given parameter can be interpreted as disclosing that any value between the first and second values could also be employed for the given parameter). For example, if Parameter X is exemplified herein to have value A and also exemplified to have value Z, it is envisioned that parameter X may have a range of values from about A to about Z. Similarly, it is envisioned that disclosure of two or more ranges of values for a parameter (whether such ranges are nested, overlapping or distinct) subsume all possible combination of ranges for the value that might be claimed using endpoints of the disclosed ranges. For example, if parameter X is exemplified herein to have values in the range of 1-10, or 2-9, or 3-8, it is also envisioned that Parameter X may have other ranges of values including 1-9, 1-8, 1-3, 1-2, 2-10, 2-8, 2-3, 3-10, and 3-9.

The terminology used herein is for the purpose of describing particular example embodiments only and is not intended to be limiting. As used herein, the singular forms "a", "an" and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on", "engaged to", "connected to" or "coupled to" another element or layer, it may be directly on, engaged, connected or coupled to the other element or layer, or intervening elements or layers may be present. In contrast, when an element is referred to as being "directly on," "directly engaged to", "directly connected to" or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The term "about" when applied to values indicates that the calculation or the measurement allows some slight imprecision in the value (with some approach to exactness in the value; approximately or reasonably close to the value; nearly). If, for some reason, the imprecision provided by "about" is not otherwise understood in the art with this ordinary meaning, then "about" as used herein indicates at least variations that may arise from ordinary methods of measuring or using such parameters. For example, the terms "generally", "about", and "substantially" may be used herein to mean within manufacturing tolerances.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath", "below", "lower", "above", "upper" and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The foregoing description of the embodiments has been provided for purposes of illustration and description. It is not intended to be exhaustive or to limit the disclosure. Individual elements, intended or stated uses, or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna comprising:

an upper radiating patch element;

a ground plane spaced apart from the upper radiating patch element;

a feed point positioned adjacent the ground plane;

a first feeding element electrically coupling the upper radiating patch element to the feed point;

a second feeding element electrically coupling the upper radiating patch element to the feed point; and a shorting element electrically coupling the upper radiating patch element to the ground plane;

wherein: the first feeding element includes opposite side edge portions that are tapered, slanted, and/or angled inwardly toward each other along the first feeding element in a direction from the upper radiating patch element towards the ground plane such that a width along the first feeding element decreases in the direction from the upper radiating patch element towards the ground plane; and the second feeding element includes opposite side edge portions that are tapered, slanted, and/or angled inwardly toward each other along the second feeding element in a direction from the upper radiating patch element towards the ground plane such that a width along the second feeding element decreases in the direction from the upper radiating patch element towards the ground plane; and/or tabs extend upwardly from the ground plane such that a cable braid is solderable to the tabs without galvanic contact along a bottom of the cable braid to the ground plane.

2. The antenna of claim 1, wherein the antenna is operable within at least a first frequency range from about 698 megahertz to about 960 megahertz and a second frequency range from about 1710 megahertz to about 2700 megahertz.

3. The antenna of claim 1, wherein the upper radiating patch element includes a first portion and a second portion that are not co-planar, wherein the first portion includes opposite first and second side edges; and the first and second feeding elements include upper portions respectively coupled to and adjacent the opposite first and second side edges of the first portion of the upper radiating patch element.

4. The antenna of claim 3, wherein the shorting element extends from the second portion of the upper radiating patch element and couples to the ground plane via a shorting tab; and the second portion of the upper radiating patch extends from the first portion at an upward slant or angle relative to the first portion.

5. The antenna of claim 1, wherein the upper radiating patch element includes at least one portion having a first edge and a second edge opposing the first edge, the first and second feeding elements include upper portions respectively coupled to and adjacent the opposing first and second side edges by dielectric members such that the first and second feeding elements are proximity coupled to the upper radiating patch element; and the shorting element extends from the upper radiating patch element and couples to the ground plane via a tab that is coupled to a dielectric member such that the shorting element is proximity coupled to the ground plane.

6. The antenna of claim 1, wherein the first and second feeding elements extend from the upper radiating patch element towards the ground plane at an angle such that a spaced distance separating the first feeding element and the second feeding element decreases such that a spaced distance separating upper portions of the first and second feeding elements is larger than a spaced distance separating lower portions of the first and second feeding elements and such that the first feeding element and the second feeding element are not co-planar.

7. The antenna of claim 1, wherein the ground plane includes one or more flaps extending at an angle upwardly from and not co-planar with the ground plane and configured for providing impedance matching.

8. The antenna of claim 1, wherein the ground plane includes a main portion and a stub extending from the main portion, and wherein:

the main portion is substantially circular sector shaped having a geometric figure bounded by two radii and an arc; and/or the stub is in a plane elevated from a plane including the main portion such that the main portion and the stub are not co-planar.

9. The antenna of claim 1, wherein:

the ground plane includes a main portion, an ancillary portion adjacent the main portion, and a stub extending from the ancillary portion; and the main portion and the ancillary portion are both substantially circular sector shaped having a geometric figure bounded by two radii and an arc.

10. The antenna of claim 9, wherein:

the main portion, the ancillary portion, and the stub are not co-planar; and/or the stub includes a first portion and a second portion that are not co-planar.

11. The antenna of claim 1, wherein:

the first feeding element comprises a first triangular tapering feeding element and/or the width of the first feeding element tapers in a direction towards the feed point whereby the width of the first feeding element is narrowest at or adjacent the feed point; and the second feeding element comprises a second triangular tapering feeding element and/or the width of the second feeding element tapers in a direction towards the feed point whereby the width of the second feeding element is narrowest at or adjacent the feed point.

12. The antenna of claim 11, wherein the feed point is defined and/or connected between lower end portions of the first and second feeding elements.

13. The antenna of claim 1, wherein:

the opposite side edge portions of the first feeding element comprise first and second edge portions inwardly slanted towards each other;

the opposite side edge portions of the second feeding element comprise third and fourth edge portions inwardly slanted towards each other;

a first open side is defined between the first and third slanted edge portions and the upper radiating patch element; and a second open side defined between the second and fourth slanted edge portions and the upper radiating patch element.

14. The antenna of claim 13, wherein:

the feed point is defined and/or connected between lower end portions of the first and second feeding elements; and the antenna includes the tabs and a cable feed routed through the first or second open side, the cable feed connected to the feed point and including a cable braid soldered to the tabs.

15. The antenna of claim 1, wherein the antenna includes the tabs that are integrally formed from material of the ground plane and repositioned at an angle relative to the ground plane, such that the cable braid is solderable to the tabs without galvanic contact along the bottom of the cable braid to the ground plane and such that an area underneath the bottom of the cable braid is open or hollow due to the repositioning of the ground plane material to make the tabs.

16. The antenna of claim 15, wherein:

the tabs comprise at least a first pair of tabs stamped from the ground plane and bent at an acute angle relative to the ground plane; and a cable braid is soldered to the first pair of tabs without using solder along the bottom of the cable braid between the ground plane and the bottom of the cable braid such that the area underneath the bottom of the cable braid remains open or hollow.

17. The antenna of claim 1, wherein:

the shorting element couples to the ground plane via a shorting tab; and the shorting tab extends upwardly from the ground plane such that the coupling between the shorting element and the shorting tab is in a plane generally vertical and/or perpendicular to the ground plane.

18. The antenna of claim 1, wherein:

the shorting element couples to the ground plane via a shorting tab; and the shorting tab is coupled to an electrically insulating material such that the shorting tab is proximity coupled to the ground plane.

19. The antenna of claim 1, wherein:

the upper radiating patch element includes:

a first portion having opposite first and second side edges;

a second portion that extends from the from the first portion at an upward slant or angle relative to the first portion;

the first and second feeding elements include upper portions respectively coupled to and adjacent the opposite first and second side edges of the first portion of the upper radiating patch element;

the shorting element extends from the second portion of the upper radiating patch element; and the shorting element couples to the ground plane via a shorting tab;

the shorting tab extends upwardly from the ground plane such that the coupling between the shorting element and the shorting tab is in a plane generally vertical and/or perpendicular to the ground plane.

20. The antenna of claim 1, wherein the antenna includes the tabs, which are integrally formed from material of the ground plane and repositioned at an angle relative to the ground plane, whereby the cable braid is solderable to the tabs without galvanic contact along the bottom of the cable braid to the ground plane and an area underneath the bottom of the cable braid is open or hollow due to the repositioning of the ground plane material to make the tabs.

21. The antenna of claim 20, wherein:

the tabs comprise at least a first pair of tabs stamped from the ground plane and bent at an acute angle relative to the ground plane; and a cable braid is soldered to the first pair of tabs without using solder along the bottom of the cable braid between the ground plane and the bottom of the cable braid such that the area underneath the bottom of the cable braid remains open or hollow.

* * * * *